US011821206B2

(12) United States Patent
Leahy

(10) Patent No.: US 11,821,206 B2
(45) Date of Patent: Nov. 21, 2023

(54) METHODS AND SYSTEMS FOR MODULAR BUILDINGS

(71) Applicant: Charles H. Leahy, Asheville, NC (US)

(72) Inventor: Charles H. Leahy, Asheville, NC (US)

( * ) Notice: Subject to any disclaimer, the term of this patent is extended or adjusted under 35 U.S.C. 154(b) by 433 days.

(21) Appl. No.: 17/033,101

(22) Filed: Sep. 25, 2020

(65) Prior Publication Data

US 2021/0207375 A1 Jul. 8, 2021

Related U.S. Application Data

(63) Continuation-in-part of application No. 15/592,388, filed on May 11, 2017, now Pat. No. 10,787,803, which is a continuation-in-part of application No. 12/322,380, filed on Feb. 2, 2009, now abandoned.

(60) Provisional application No. 61/063,191, filed on Feb. 2, 2008.

(51) Int. Cl.

| | |
|---|---|
| ***E04B 2/00*** | (2006.01) |
| ***E04C 2/00*** | (2006.01) |
| ***E04C 2/34*** | (2006.01) |

(52) U.S. Cl.

CPC ..... *E04C 2/3405* (2013.01); *E04C 2/46* (2013.01); *E04C 2002/001* (2013.01); *E04C 2002/3488* (2013.01)

(58) Field of Classification Search

CPC ..... E04B 1/343; E04B 1/34321; E04B 1/74; E04B 1/741; E04B 1/61; E04B 1/6183; E04B 2001/34389; E04B 2/00; E04B 2/84; E04B 2/74; E04B 2/76; E04C 2/10; E04C 2/20; E04C 2/44; E04C 2/46; E04C 2/52; E04C 2/5821; E04C 2/526

See application file for complete search history.

(56) References Cited

U.S. PATENT DOCUMENTS

| | | | | |
|---|---|---|---|---|
| 2,255,511 | A * | 9/1941 | Muller | E04B 1/6183 52/513 |
| 3,662,507 | A | 5/1972 | Espeland | |
| 3,675,379 | A * | 7/1972 | Lambert | E04H 1/1238 52/274 |
| 3,828,502 | A * | 8/1974 | Carlsson | E04C 2/292 52/125.4 |
| 4,163,349 | A | 8/1979 | Smith | |
| 4,192,113 | A * | 3/1980 | Martin, Jr. | E04B 2/58 52/282.5 |
| 4,196,555 | A * | 4/1980 | Henges, Jr. | E04B 1/344 52/588.1 |
| 4,373,311 | A * | 2/1983 | Artweger | B32B 5/18 52/282.4 |
| 4,575,981 | A | 3/1986 | Porter | |
| 4,748,780 | A | 6/1988 | Vinther | |
| 5,424,118 | A * | 6/1995 | McLaughlin | E05C 3/004 428/318.6 |
| 5,428,388 | A | 6/1995 | Bauer et al. | |
| 5,472,290 | A * | 12/1995 | Hulls | B62D 33/046 296/210 |

(Continued)

*Primary Examiner* — Jessica L Laux
(74) *Attorney, Agent, or Firm* — NEO IP

(57) ABSTRACT

A modular seamless corner component for providing a corner to a structure without having to compromise between structural integrity and energy efficiency. The continuous insulation and structure of the modular seamless corner component provide for a stronger corner because there are no seams to magnify stress and provide for a high energy efficiency because there is no thermal bridging.

14 Claims, 56 Drawing Sheets

(56) References Cited

U.S. PATENT DOCUMENTS

| | | | | |
|---|---|---|---|---|
| 5,497,589 | A | 3/1996 | Porter | |
| 5,608,999 | A * | 3/1997 | McNamara | E04B 2/8641 52/220.1 |
| 5,755,068 | A | 5/1998 | Ormiston | |
| 5,771,645 | A | 6/1998 | Porter | |
| 5,950,389 | A | 9/1999 | Porter | |
| 6,029,416 | A | 2/2000 | Andersson | |
| 6,240,704 | B1 | 6/2001 | Porter | |
| 6,405,491 | B1 * | 6/2002 | Gallant | E04H 3/08 52/64 |
| 6,564,521 | B1 * | 5/2003 | Brown | E04C 2/292 52/309.11 |
| 6,599,621 | B2 | 7/2003 | Porter | |
| 7,090,509 | B1 | 8/2006 | Gilliland et al. | |
| 7,493,731 | B2 | 2/2009 | Zhang | |
| 7,542,295 | B2 | 6/2009 | Imsand | |
| 7,892,631 | B2 | 2/2011 | Bauer | |
| 8,539,732 | B2 | 9/2013 | Leahy | |
| 8,590,264 | B2 | 11/2013 | Leahy | |
| 8,973,337 | B2 | 3/2015 | Hires et al. | |
| 9,179,109 | B1 | 11/2015 | Kasmir et al. | |
| 9,441,363 | B2 | 9/2016 | Lewin | |
| 9,680,656 | B2 | 6/2017 | Rivera | |
| 10,116,102 | B2 | 10/2018 | Randall et al. | |
| 10,175,996 | B2 | 1/2019 | Byrne et al. | |
| 10,418,813 | B1 | 9/2019 | King | |
| 11,408,165 | B2 * | 8/2022 | Kolisnek | E04B 1/34321 |
| 11,473,288 | B2 * | 10/2022 | Kolisnek | E04B 1/344 |
| 2003/0079438 | A1 | 5/2003 | Stephens et al. | |
| 2008/0131197 | A1 | 6/2008 | Hamlen | |
| 2008/0313973 | A1 | 12/2008 | Rolf | |
| 2009/0180261 | A1 | 7/2009 | Angelides et al. | |
| 2010/0095629 | A1 | 4/2010 | Taylor | |
| 2011/0154765 | A1 | 6/2011 | Laprise | |
| 2011/0194858 | A1 | 8/2011 | Rotenstein et al. | |
| 2016/0219728 | A1 | 7/2016 | Balyan | |
| 2016/0286678 | A1 | 9/2016 | Venugopal et al. | |
| 2017/0214224 | A1 | 7/2017 | Wickett et al. | |
| 2017/0306610 | A1 | 10/2017 | Leahy | |

* cited by examiner

PRIOR ART FIG. 13

Panel Front/Rear View
Panel Side View
Panel Front/Rear View
Panel Side View
Remote sensor mounted inside panel and hidden from view Structural Insulated Panel Cross Section Including a Panel Siding having Water Resistant Properties Structural Insulated Panel Cross Section Including a Panel Siding having Flame Resistant Properties Placement of Structural Anchoring Strap in Prefabricated Insulated Panel
FIG. 26A – EXTERIOR VIEW
FIG. 26B SIDE VIEW
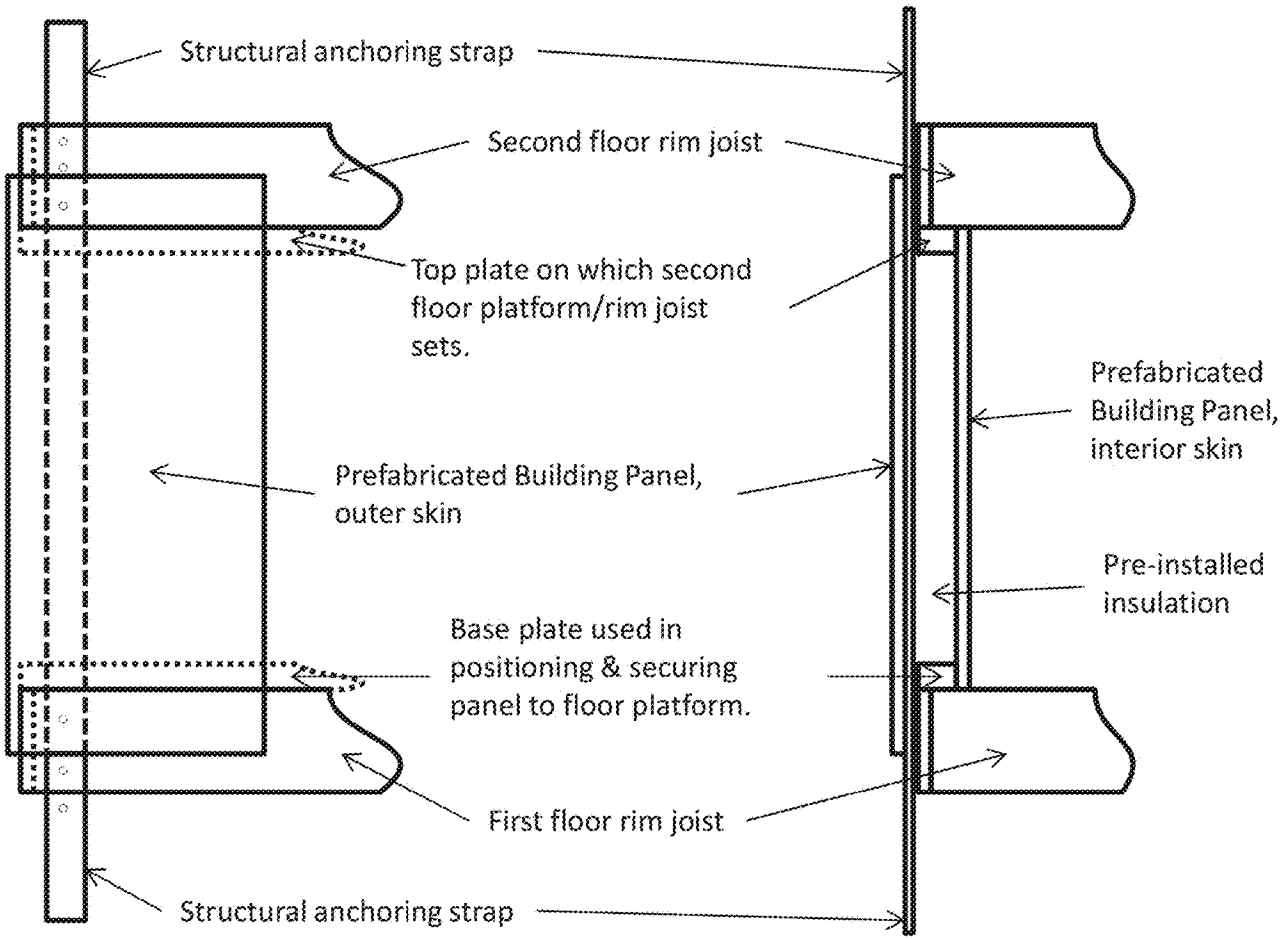

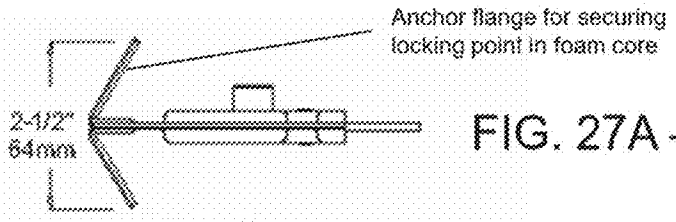
FIG. 27A – PRIOR ART Locking point
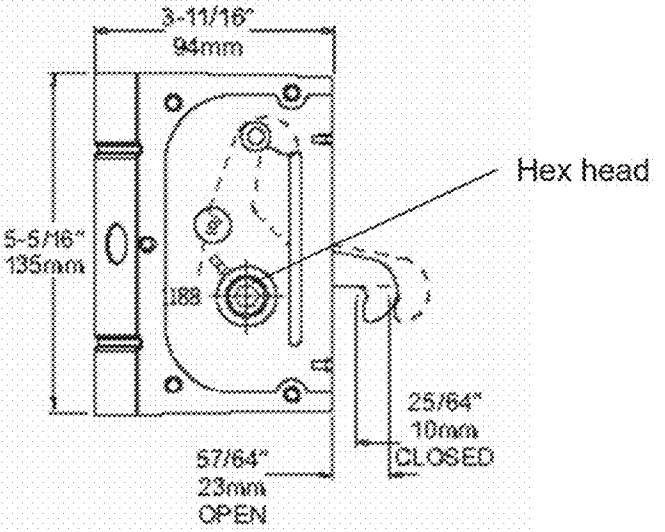
FIG. 27B – PRIOR ART Locking point
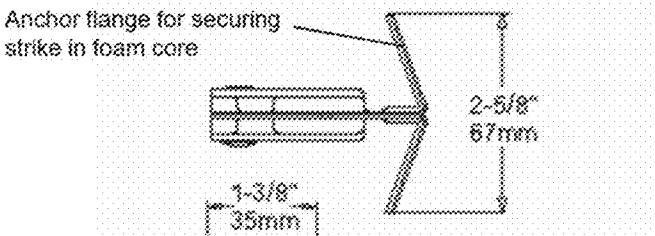
FIG. 27C – PRIOR ART Strike
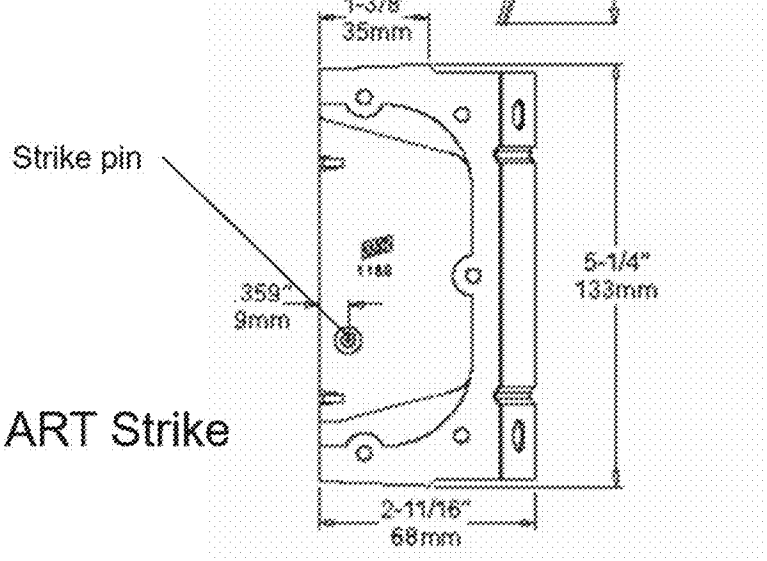
FIG. 27D – PRIOR ART Strike Cam-lock wrench access shaft insert Side view End view FIG. 34B
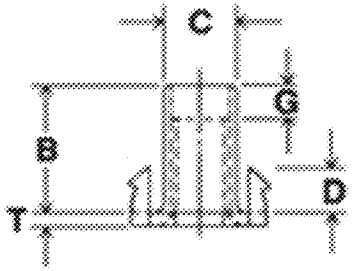
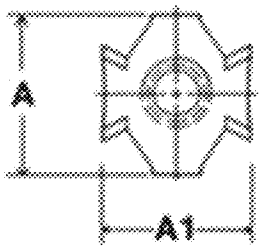
FIG. 34C
PRIOR ART
Rivet T-nut
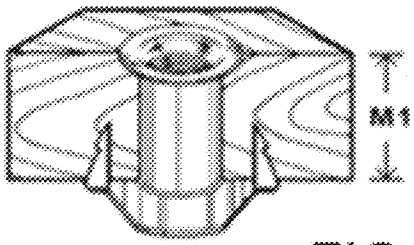
FIG. 34A
T-nut
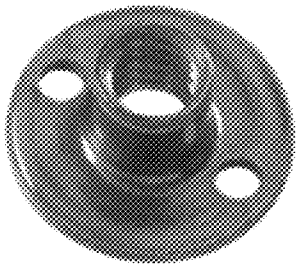
FIG. 33
PRIOR ART Improved Cam-Lock with Structural Utility Mounting Rod System for Up-Armoring a Building
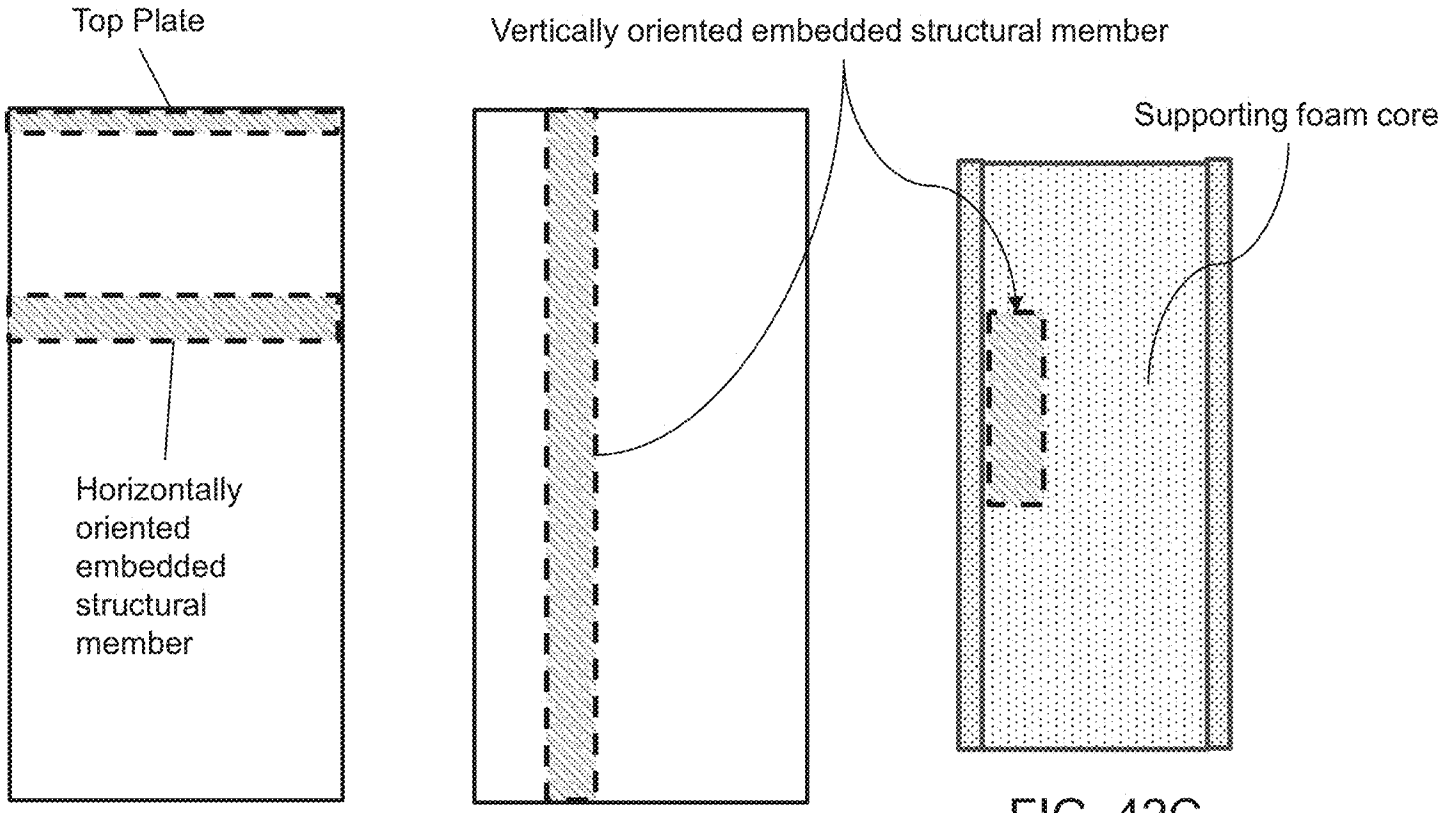
FIG. 42C Top View
FIG. 42B Front View
FIG. 42A Front View Cross-sectional view

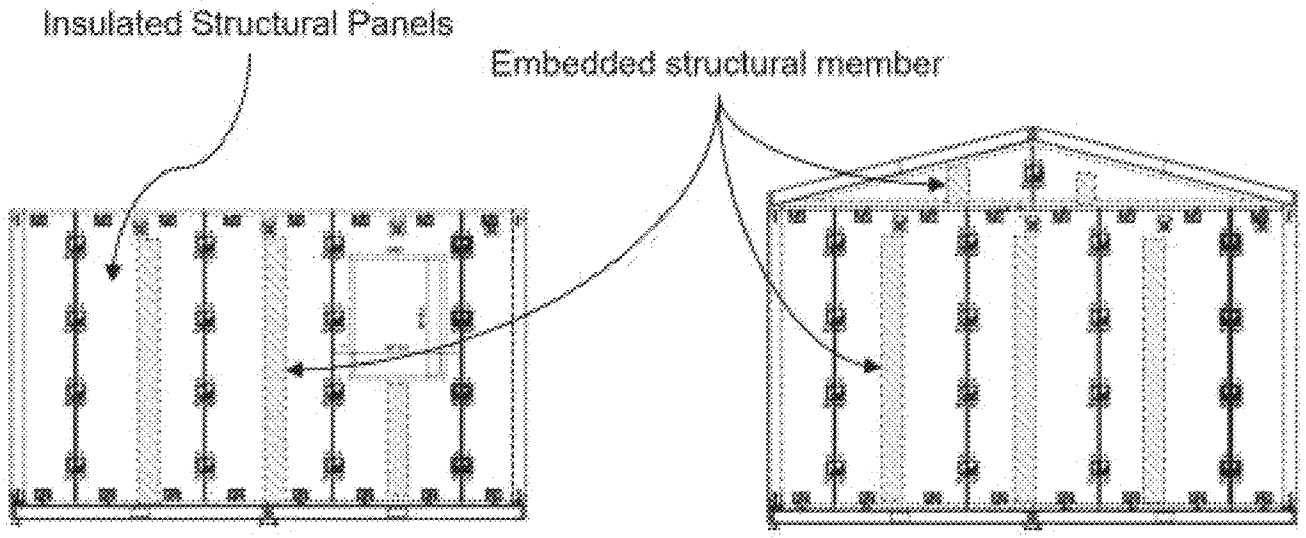
FIG. 44A
FIG. 44B
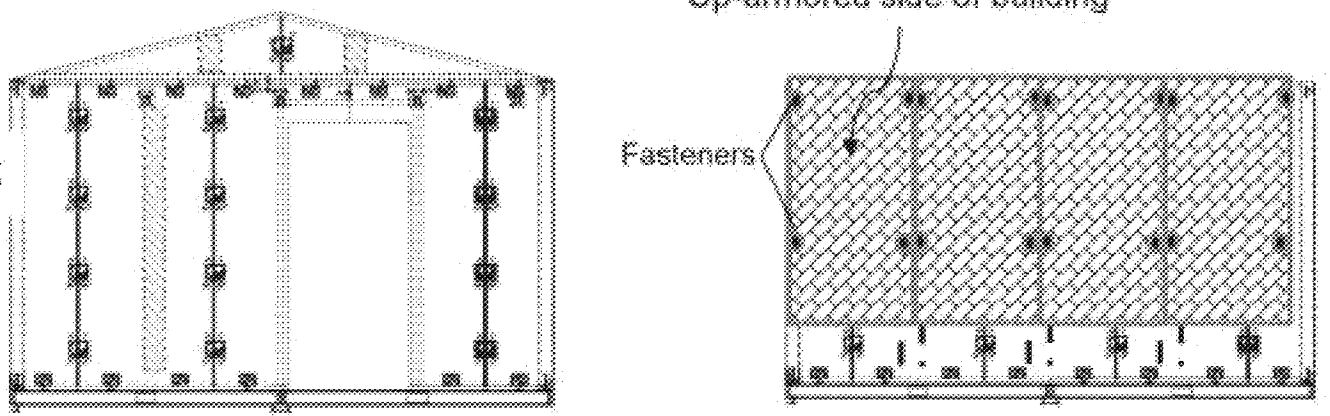
FIG. 44C
FIG. 44D

FIG. 48A-C PRIOR ART

3 SOLID BLOCKED CORNER DETAIL 2 4 STUD CORNER DETAIL W/ BACKER 1 3 STUD CORNER DETAIL

FIG. 48D-F PRIOR ART 4 2 STUD CORNER DETAIL 5 4 STUD U-CORNER DETAIL 6 3 STUD U-CORNER DETAIL

FIG. 48G-I PRIOR ART

4 STUD SHEARWALL CORNER DETAIL

3 STUD CONVENTIONAL CORNER DETAIL

4 STUD CORNER DETAIL

METHODS AND SYSTEMS FOR MODULAR BUILDINGS

CROSS REFERENCE TO RELATED APPLICATIONS

This application is a continuation-in-part of U.S. patent application Ser. No. 15/592,388, filed May 11, 2017, which is a continuation-in-part of U.S. patent application Ser. No. 12/322,380, filed Feb. 2, 2009, which claims the benefit of U.S. Provisional Application No. 61/063,191 filed Feb. 2, 2008, each of which is incorporated herein by reference in their entirety.

BACKGROUND OF THE INVENTION

1. Field of the Invention

The present invention relates generally to modular building systems and methods, and more particularly, to modular building panels configured to be integrated with stud frame construction.

2. Description of the Prior Art

Modular buildings and components used in making them are known in the art. By way of example, prefabricated housing components, including wall, floor and roof panels are known. However, energy losses most commonly occur in the seams, framing or joint regions of structures, including prefabricated buildings and modular structural components. Additionally, while prefabricated panels and other components are known in the art, they are not packaged or provided for quick and easy assembly to form a predetermined completed structure that also provides for an almost continuously insulated and energy efficient structure that is also stable and reliable, i.e., able to withstand the natural elements including storm conditions or man-made elements like hostile fire or blasts.

Prior art patent documents include the following:

U.S. Pat. No. 3,662,507 for Preformed building wall construction by inventor Espeland, filed Mar. 11, 1970 and issued May 16, 1972, is directed to a building wall construction having preformed panels preferably of plastic material for use particularly as basement walls and also as room walls above the basement level. The panels are keyed to each other and to supporting structures and secured by a suitable bonding agent. There are special panel sections with preformed window units and also preformed support areas for heavy beams. There is a selection of preformed corners to accommodate varying situations. The panels include preset bolts for the base plates and in one embodiment are provided on their exterior side with preformed brick ledges to support brick facing.

U.S. Pat. No. 6,564,521 for Structural sandwich panels and method of manufacture of structural sandwich panels by inventor Brown, et. Al, filed May 12, 2000 and issued May 20, 2003, is directed to rigid structural members, profiles, joints, and forms added to structural sandwich panels to provide higher strength, integral joining joint, and single facing sheet manufacturing. Facing sheets, rigid structural members, latch side and pin side cam-locks, fabricated wire truss assembly, and rigid structural headers and an integrated top plate are positioned into containment form assembly in the proper position. Facing sheets are placed in position in the containment form assembly forming a structural sandwich panel assembly. A foam resin core material is injected into the structural sandwich panel assembly and allowed to cure. The resultant structural sandwich panel includes rigid structural members and elongated recesses which also form a joint for joining abutting structural sandwich panels together and cam-locks used to secure adjoining panels together. Comer and angle panels have a comer rigid structural assembly.

U.S. Pat. No. 8,327,593 for Insulated wall filed by inventor Laprise filed Mar. 10, 2011 and issued Dec. 11, 2012, is directed to a section of the wall having a plurality of interspaced structural members mounted between an upper frame member and a lower frame member, and insulating material generally filling the space between the structural members and upper and lower frame members.

U.S. Pat. No. 5,424,118 for Interlocking insulative panel construction filed by inventor McLaughlin on Jan. 25, 1994 and issued Jun. 13, 1995, is directed to refrigeration units such as walk-in coolers and freezers, particularly interlocking insulative panels used in construction of such units. The individual insulative panels are characterized by a densified urethane perimeter and a core of low density insulating urethane abutting the perimeter and held in place by a thin outer skin. The densified urethane perimeters of the panels have a tongue-in-groove configuration, as well as a cam locking means, securing abutting panels together.

U.S. Pat. No. 8,973,337 for Modular sheet metal building kit filed by inventor Hires et. Al., filed Aug. 6, 2013 and issued Mar. 10, 2015, is directed to a modular construction kit for erecting a building. The kit comprises a plurality of base track sections, a plurality of roof receiving tracks, and a plurality of wall panels. The base track is a U-shaped channel that extends around the base of the building and maintains the lower edges of the wall panels in a linear alignment. Wall panels include male, female, and hybrid (male/female) varieties, each variety having a different tongue and groove configuration on laterally opposing ends of the panel. Each wall panel has an outer skin and an inner skin separated by two divider walls and a structural bridge, which provide structural support across two axes. The roof receiving track is affixed to the upper edges of the wall panels to provide a supporting shelf for a roof structure. Thus, the invention is an easy to assemble kit for rapidly erecting buildings.

U.S. Pat. No. 8,002,490 for Corner piece for valance interface in cases and containers filed by inventor Hamlen, filed Nov. 29, 2007 and issued Aug. 23, 2011, is directed to a unitary, bent corner piece for a valance frame having an extending tongue at each end shaped to interfit the hollow cross-section of an adjacent, extruded, valance frame member. Complementary corner pieces so formed provide part of a valance interface between the lid and body of a container, ensuring sealing continuity around corners fitted with such corner pieces. Each corner piece is provided with a mating valance surface for presentation to the valance interface to provide an intimate engagement with the mating valance surface of the complementary, opposed corner piece. Gaskets fitted within the corner pieces may form part of the interface. Tongues formed a at the respective ends of a corner piece are provided with a groove to accommodate the inclusion of a gasket into the interior core of the longitudinal frame members. Corner pieces may also be formed with two or more cavities beneath the valance surface, such cavities being defined by bridging walls extending from an inside surface of the corner piece to an outside surface of the corner piece. The outside surface of a corner piece may be provided with one or more perforated fastener openings, penetrating the outside wall of the corner piece, for attaching sidewalls of a container to the corner piece.

U.S. Pat. No. 4,163,349 for Insulated building panels was filed by inventor Smith, was filed May 26, 1977 and issued Aug. 7, 1979 is directed to an insulated building panel including a core and overlapping skins, the interior skin at the panel's bottom covering a panel foot plate and the exterior skin at the panel's bottom covering the foot plate and extending beyond to form an erection stop. End panels have relieved core areas for receiving bearing members associated with a wall splice bearing post, and double parallel spaced header beams have offset splice areas within a several panel wall section. Two end panels include improved end structure for forming an improved corner at the panel's intersection. Methods are provided for making and erecting a multiple panel wall section.

U.S. Pat. No. 4,192,113 for Corner assembly for wall panels filed by inventor Martin, filed Mar. 23, 1978 and issued Mar. 11, 1980, is directed to a covering and sealing assembly for concealing and sealing the gap between a pair of edge adjoining wall panels which are disposed at an angle to each other, such as at a corner. The assembly includes an exterior trim piece, a supporting member for the exterior trim piece, fastening means to tighten the supporting and clamping members together to squeeze the edges of the panels at the corner and to thus provide a structural tie therebetween, and an interior trim piece which snaps over the free vertical edges of the clamping member and hides the fastening means and the clamping member. The structural tie between the two corner panels is effected by the squeezing action of the legs of the supporting member and of the clamping member upon the faces of the adjoining wall panels at the points of contact between the faces and the supporting and clamping members.

U.S. Patent Pub. No. 2010/0095629 for Insulating thin-brick, thin-stone, and thin-block siding system filed by inventor Taylor, filed Oct. 20, 2009, and published Apr. 22, 2010, is directed to surface facing materials structured for facing indoor and outdoor surfaces, consisting of facing sections having interdigitating connectors on opposing first and second surfaces so as to securely connect a long connecting-side of a section to a long connecting-side of an adjacent section and/or interdigitating connectors on each end so as to securely connect each section end to an end of an adjacent section, so as to provide light weight, moisture resistant, sound and heat insulating facing. One style of the facing section comprises a single row of thin-bricks positioned short end to short end securely adhered to an elongate, lightweight, insulating backing-panel having interdigitating connectors sized so as to accept a single row of bricks so as to result in a thin-bricked panel. In one preferred embodiment, from 2 to 10 thin-bricks are adhered end to end to a backing-panel forming an elongated row of thin-bricks on a backing panel.

SUMMARY OF THE INVENTION

The present invention provides modular building systems with integrated electronic technologies. One aspect of the present invention is to provide modular building panels with embedded electrical supply components and embedded electronic devices. Another aspect of the present invention is to provide a modular building constructed with modular building panels; the building controlled by a central computer system in communication with the embedded electronic devices in the panels. These and other aspects of the present invention will become apparent to those skilled in the art after a reading of the following description of the preferred embodiment when considered with the drawings, as they support the claimed invention.

BRIEF DESCRIPTION OF THE DRAWINGS

FIG. 1A is a standard flat wall panel. FIG. 1B is a 90-degree corner panel. FIG. 1C is a 135-degree transition panel. FIG. 1D is a wall panel with a window opening. FIG. 1E is a wall panel with a door opening.

in FIG. 7A a top view of two edges of modular wall panels having mating multi (two or more) railing for alignment and locking mechanism; FIG. 7B illustrates an end perspective view illustrating the parallel spaced apart multi-track or railing system; FIG. 7C illustrates a side view and cut-away of joined panel edges with the interlocking cam-based locking mechanism. While the interlocking cam mechanism is desirable for providing additional securement at the joints between two panels, it is not a requirement for some level of stability.

FIG. 9A shows a partially assembled building.

PRIOR ART

FIG. 15A is a cross-sectional view through the center of the header. FIG. 15B is a cross-sectional view through the end of the header. FIG. 15C is a cross-sectional side view.

FIG. 16A is a cut-away side view of a side wall with embedded conduits and junctions. FIG. 16B is a cut-away side view of an end wall with embedded conduits and junctions. FIG. 16C is a cut-away side view of another end wall with a door and embedded conduits and junctions. FIG. 16D is a cut-away side view of a side wall with a window and embedded conduits and junctions.

FIG. 20A is an exterior perspective view showing the camera. FIG. 20B is a cross-sectional side view showing the camera monitor and chase. FIG. 20C is an interior partially transparent, perspective view showing the monitor and chase for power connection.

FIG. 23A is a transparent view of a panel with a single sensor. FIG. 23B is a side view of a panel with a single sensor. FIG. 23C is a transparent view of a panel with multiple sensors. FIG. 23D is a side view of a panel with multiple sensors.

FIG. 26A illustrates an exterior view of vertically oriented straps integrated into the assembly of the prefabricated panel.

FIG. 26B illustrates a side view of vertically oriented straps integrated into the assembly of the prefabricated panel.

FIGS. 27A-D PRIOR ART illustrate a prior art cam-lock system. FIG. 27A is a top view of the locking point. FIG. 27B is a side view of the locking point. FIG. 27C is a top view of the strike. FIG. 27D is a side view of the strike.

FIG. 28A is a top view of the anchor flange attached to a cam lock. FIG. 28B is perspective view of the anchor flange.

FIG. 29A is a side view of a panel with two pairs of cam-locks individually reinforced with cable. FIG. 29B is a side view of a panel with two pairs of cam-locks reinforced with a single cable.

FIG. 30A is a side view of the cam-lock access shaft. FIG. 30B is an end view of the cam-lock access shaft.

FIGS. 33&34A-C PRIOR ART illustrate prior art T-nuts.

FIG. 33 is a perspective view of a prior art T-nut. FIG. 34A is a cut-away view of a prior art T-nut embedded in wood.

FIG. 34B is a cross-sectional side view of the T-nut.

FIG. 34C is a top view of the T-nut.

FIG. 35A is a side view of the cam-lock access shaft. FIG. 35B is an end view of the cam-lock access shaft.

FIG. 41A shows building panels locked together with cam-locks. FIG. 41B shows utility structural supporting rods and ledgers mounted on the panels. FIG. 41C shows a bed and cabinet mounted to the utility structural supporting rods.

FIGS. 42A-C illustrate embedded structural members inside of insulated building panels in different locations and orientations as part of a system for up-armoring or structurally reinforcing a building according to the present invention. FIG. 42A is a transparent view of a horizontally oriented structural member embedded in a panel. FIG. 42B is a transparent view of a vertically oriented structural member embedded in a panel. FIG. 42C is another transparent view of vertically oriented structural member as embedded in the supporting foam core.

FIGS. 44A-D illustrates various embodiments of a building with embedded structural members for up-armoring a building according to the present invention. FIG. 44A is a transparent view of a side wall composed of several panels with a window and embedded structural members. FIG. 44B is a transparent view of an end wall composed of several panels with embedded structural members. FIG. 44C is a transparent view of an end wall composed of several panels with a door and embedded structural members. FIG. 44D is a view of a side wall covered with armor.

Prior Art FIG. 48A shows a 3-stud corner detail, FIG. 48B shows a 4-stud corner detail with a backer, FIG. 48C shows a solid blocked corner detail, FIG. 48D shows a 2-stud corner detail, FIG. 48E shows a 4-stud U-corner detail, FIG. 48F shows a 3-stud U-corner detail, FIG. 48G shows a 4-stud corner detail, FIG. 48H shows a 3-stud conventional corner detail, and FIG. 48I shows a 4-stud shearwall corner detail.

FIG. 49A shows the lip formed between the bottom edge of the insulation and the lower portion of the outer sheath.

FIG. 50A shows reinforcements embedded in the modular seamless corner component, while

FIG. 51A shows an outside view of the modular seamless corner component, with one sidewall installed and a second sidewall being raised into place. FIG. 51B shows an outside corner view of the modular seamless corner component. FIG. 51C shows an outside view of the modular seamless corner component opposite to the view of FIG. 51A. FIG. 51D shows an interior view of the modular seamless corner component from above. FIG. 51E shows an outside view of the modular seamless corner component from above.

FIG. 52A shows a side view of an attachment of a side wall to the modular seamless corner component.

FIG. 53A shows the attachment of a modular seamless corner component to a bottom plate and a secondary base plate.

DETAILED DESCRIPTION

Figure 1E:
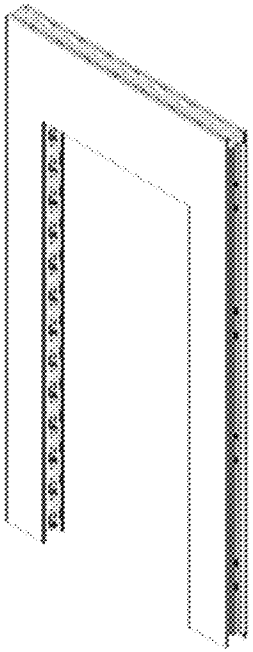
FIGS. 1A-E illustrate example application specific standardized panels (ASSPs) according to the present invention.
Figure 1D:
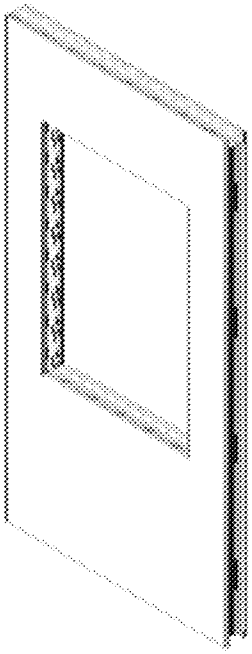
Figure 1C:
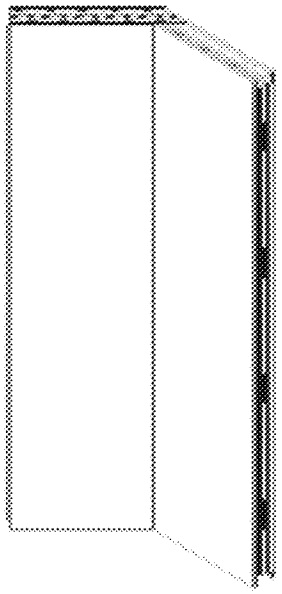
Figure 1B:
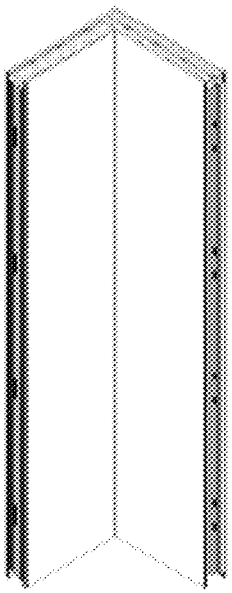

In the following description, like reference characters designate like or corresponding parts throughout the several views. Also in the following description, it is to be understood that such terms as "forward," "rearward," "front," "back," "right," "left," "upwardly," "downwardly," and the like are words of convenience and are not to be construed as limiting terms.

Figure 1A:
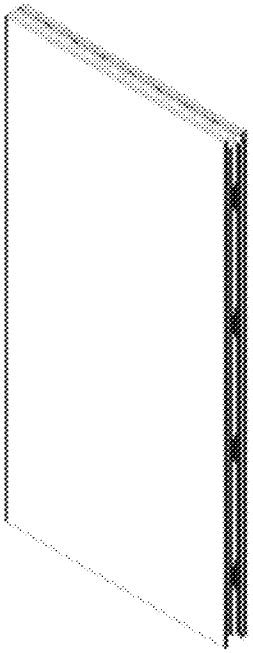

None of the prior art addresses the longstanding need for stable, energy efficient modular building structures, including kits for installing same, in particular having an almost continuously insulated and structurally locked wall, floor and roof panel components that are aligned with a mating edge system with the potential for embedding additional technologies inside of the panels. Thus there remains a need for energy efficient and stable modular building systems and methods for installing them, including providing containerized packaging to facilitate shipment, assembly and installation of the building offering improved value for the consumer through integrated technologies The present invention provides systems and methods for a modular building that is self-contained within a standard shipping container, wherein the pre-fabricated panel wall components are easily assembled to form a predetermined structure using a cam-based component connector system. Another aspect of the present invention is to provide a modular building system for a portable, storable complete building kit wherein the kit is completely optimally provided within a standard shipping container or other pre-specified configuration or delivery mechanism. The present invention also provides a modular building system with prefabricated composite wall panels that include conduits provided within the panels; alternatively, these conduits may be pre-wired. As shown in FIGS. 1A through 1A, each panel is separately a structural element to be used in construction. While framing lumber, structural sheathing and insulation are traditionally sold separately, a structural insulated panel combines the capability of all three materials yet with a significantly reduced amount of framing lumber and therefore much less energy loss through thermal bridging of the building envelope. And while normal structural insulated panels are sold as part of a kit to be assembled as a set, ASSP can be sold separately as money becomes available. The panels are thus assembled in any number of alternative configurations and moved around as desired by the owner, allowing them to create an almost infinite number of designs from a very limited number of panel types.

In another embodiment, the continuously insulated panels are angled in shape or forming a t-wall or other multi-segment single panel to aid in both strength and structure assembly such that they tessellate. Other regular and irregular shapes that tessellate are provided for in the present invention.

Methods for installation of the modular building system include the steps of providing a prefabricated modular building kit having all components and instructions for assembly optimally disposed within a standard shipping container for portability and storage; removing the kit from the shipping container; assembling the modular housing by arranging and connecting the composite wall panels, which include conduits for electrical and/or plumbing disposed within the interior section of the composite wall panels, including input/output openings for wiring, and complimentary technologies like lighting, cameras, sensors, etc.

The structure size is predetermined before packaging or panels erected as changing conditions require, but ranges in size from small to very large buildings, by way of example and not limitation, such as an emergency shelter, a home or a command shelter or office or simply as an item of convenience for a consumer. The size of the panels generally requires only two or three persons to manually maneuver the panels for complete structure erection. The material of both the interior and the exterior siding of the panels is selected based upon the needs of the customer and the environment, but in any case the panels are both insulated and portable. Preferably, the panels are super-insulated and portable to allow the builder to get under roof and into a comfortable space in a very short period of time.

In another embodiment, a structural insulated panel has a finished exterior that provides a drainage plane over which other siding is applied.

Referring now to the drawings in general, the illustrations are for the purpose of describing a preferred embodiment of the invention and are not intended to limit the invention thereto. As best seen in the figures, especially FIGS. 2-6, an illustration of a container for housing a modular building kit is shown; in FIGS. 7-8, a modular building materials are shown including interlocking pre-engineered and pre-insulated panels that are constructed and configured to be quickly attached together by properly aligning their respective edges to form the walls, roof, or floor of a structure.

Figure 2:
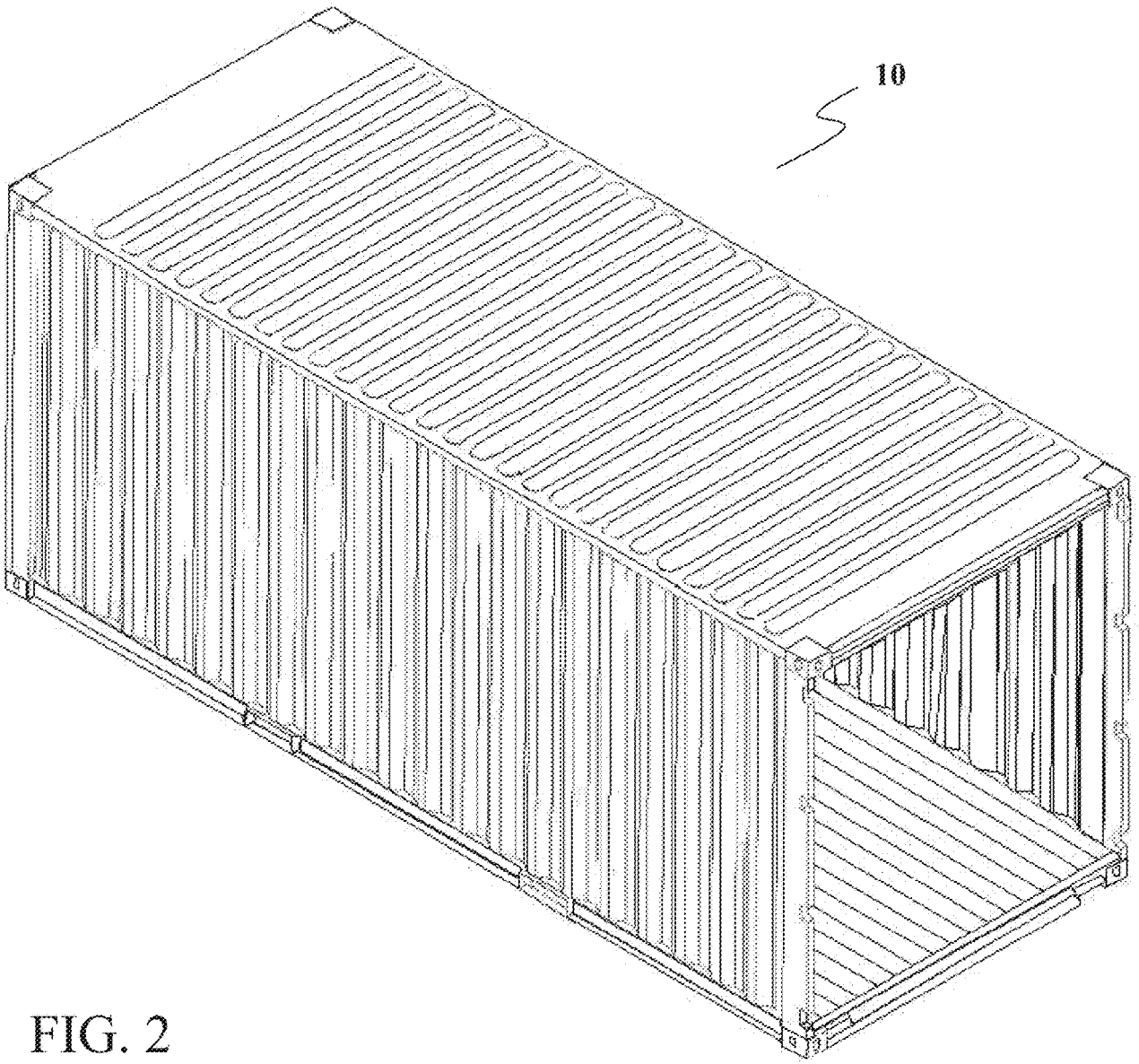
FIG. 2 shows a perspective view of a container for housing the modular building system according to one embodiment of the present invention.
Figure 3:
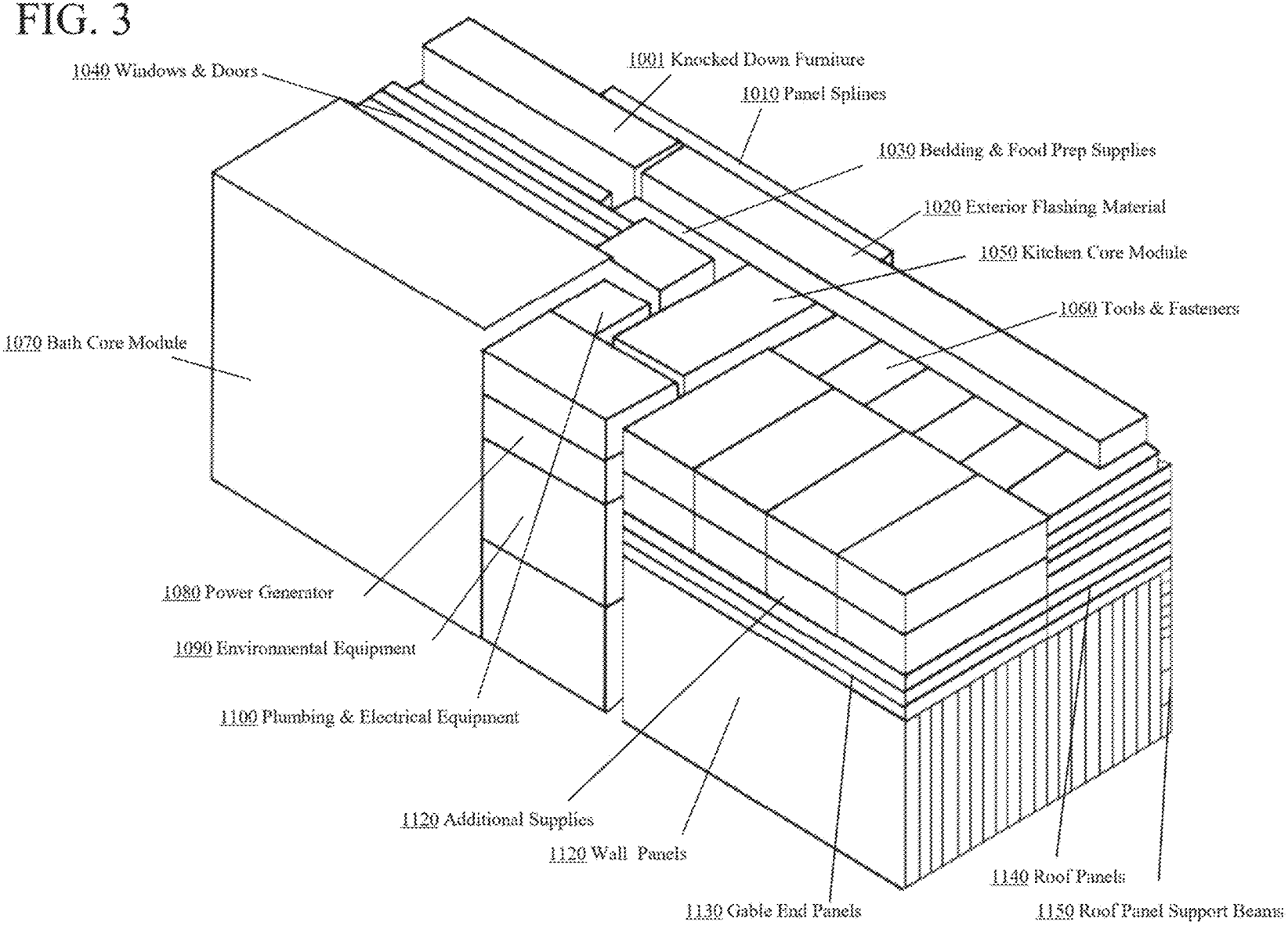
FIG. 3 illustrates a perspective view of stacked contents of the kit for modular building structures of the present invention, configured to fit within the container shown in FIG. 2.
Figure 4:
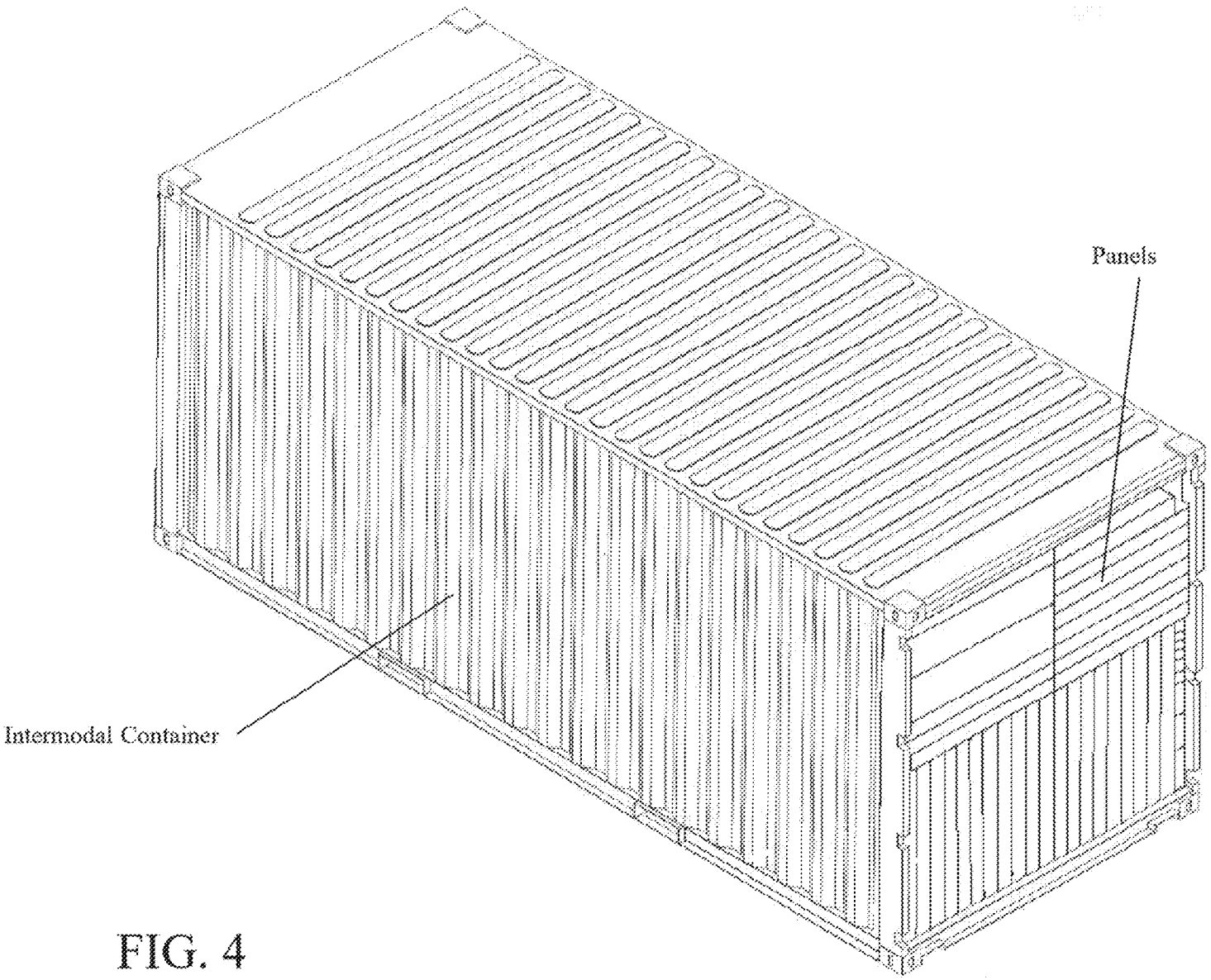
FIG. 4 shows a loaded container of FIG. 2 with the components of FIG. 3.
Figure 5:
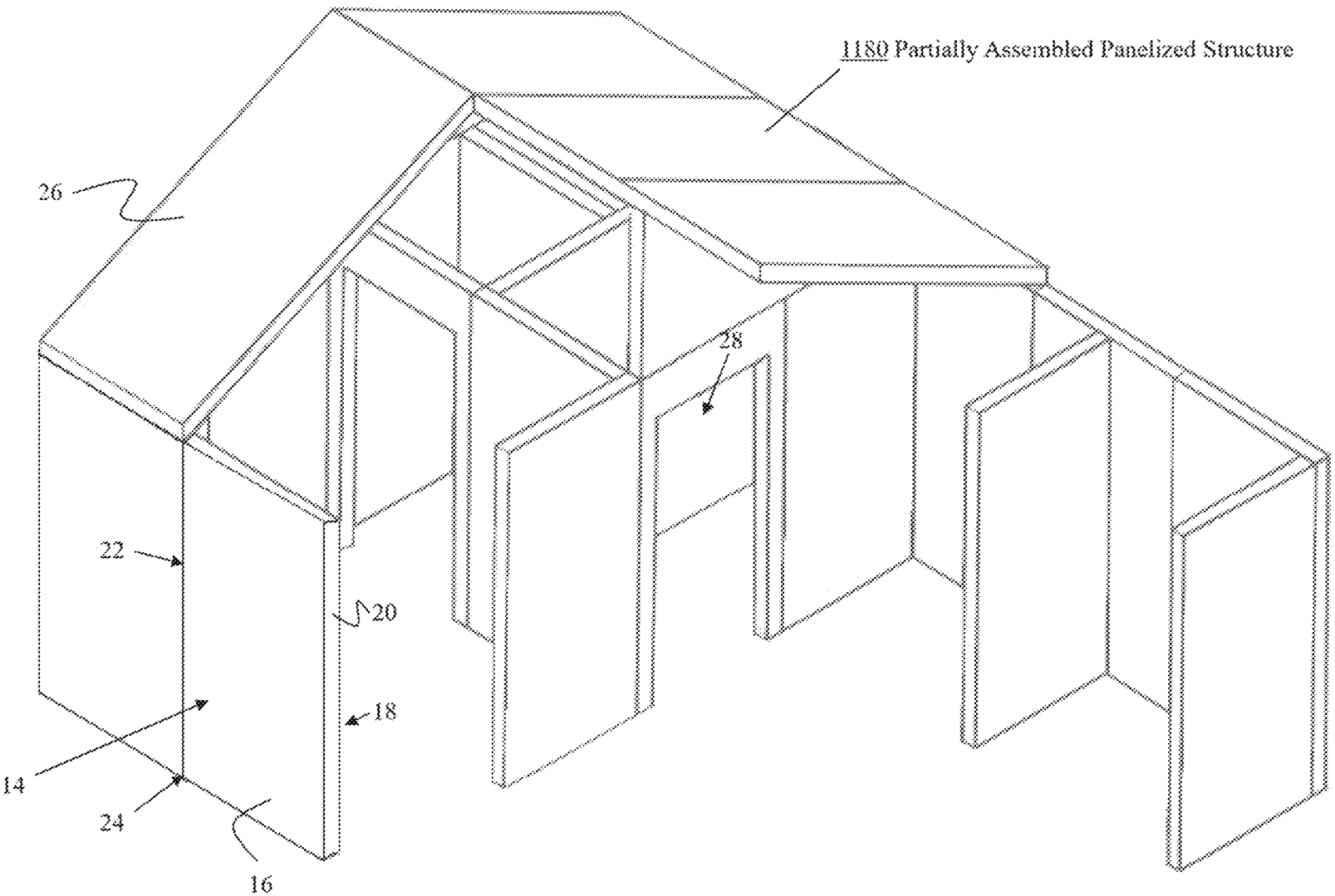
FIG. 5 illustrates a perspective view of a partially assembled modular building structure.
Figure 6:
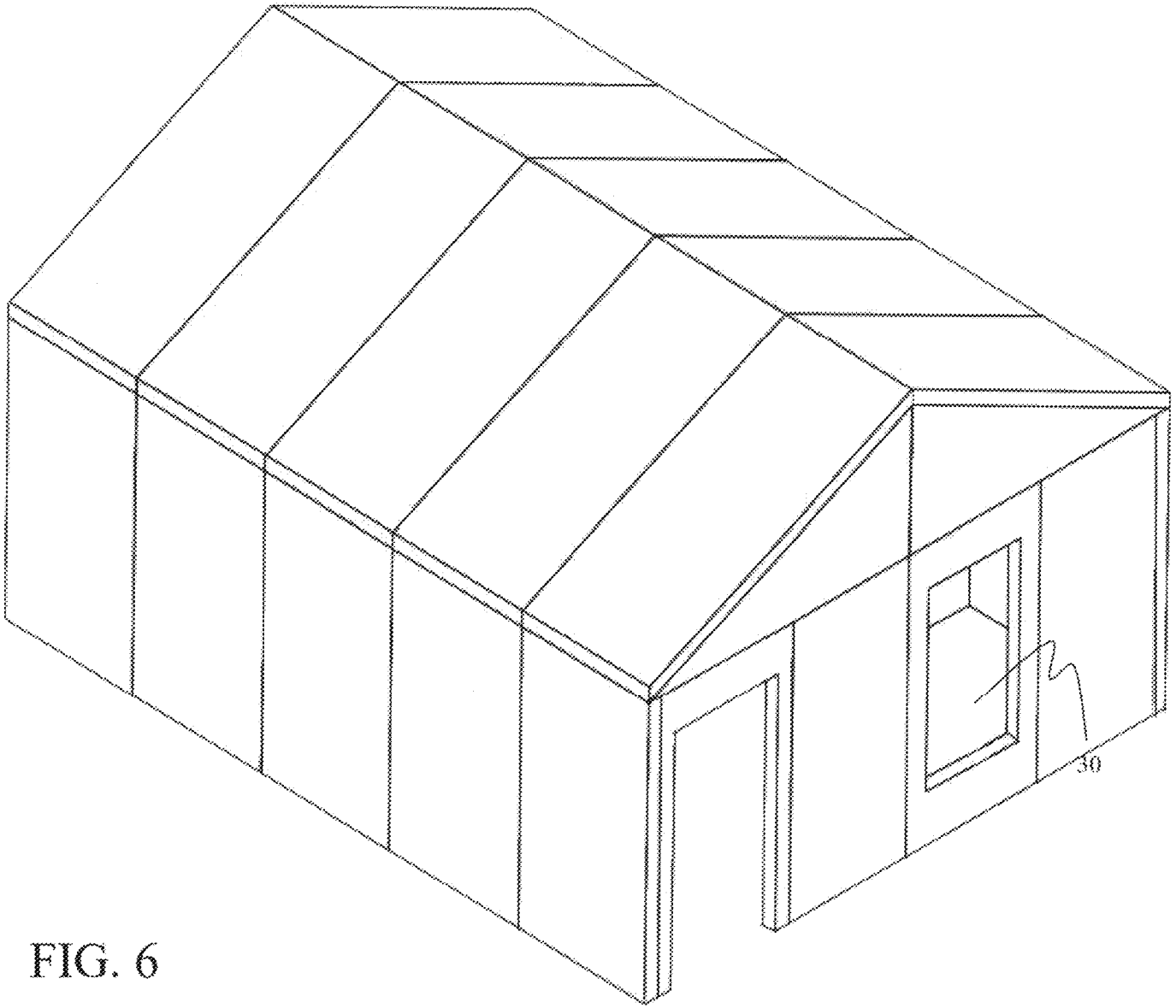
FIG. 6 illustrates a perspective view of a completed modular building from the partially completed illustration of FIG. 5.
Figure 7A:
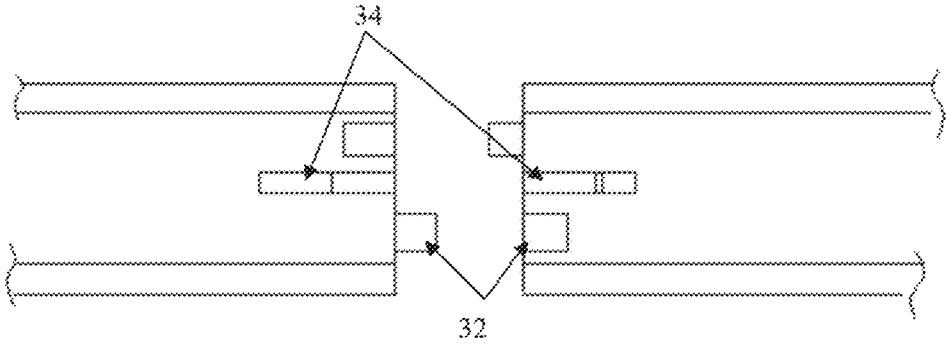
FIGS. 7A-C illustrate several related views.
Figure 7B:
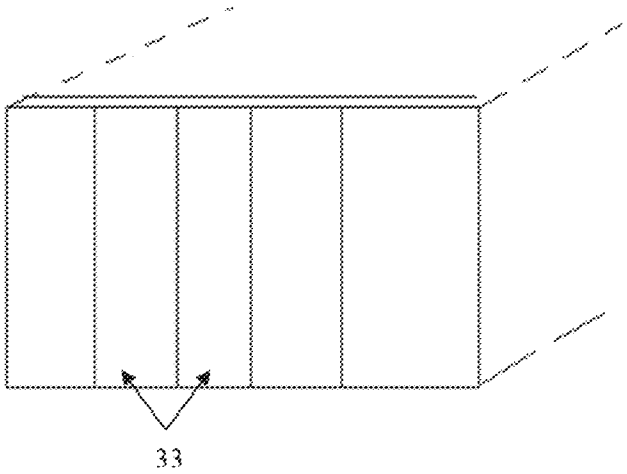
Figure 7C:
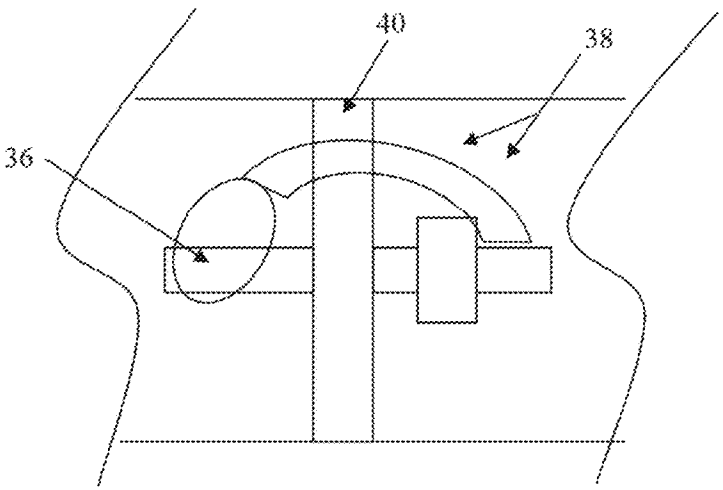
Figure 8:
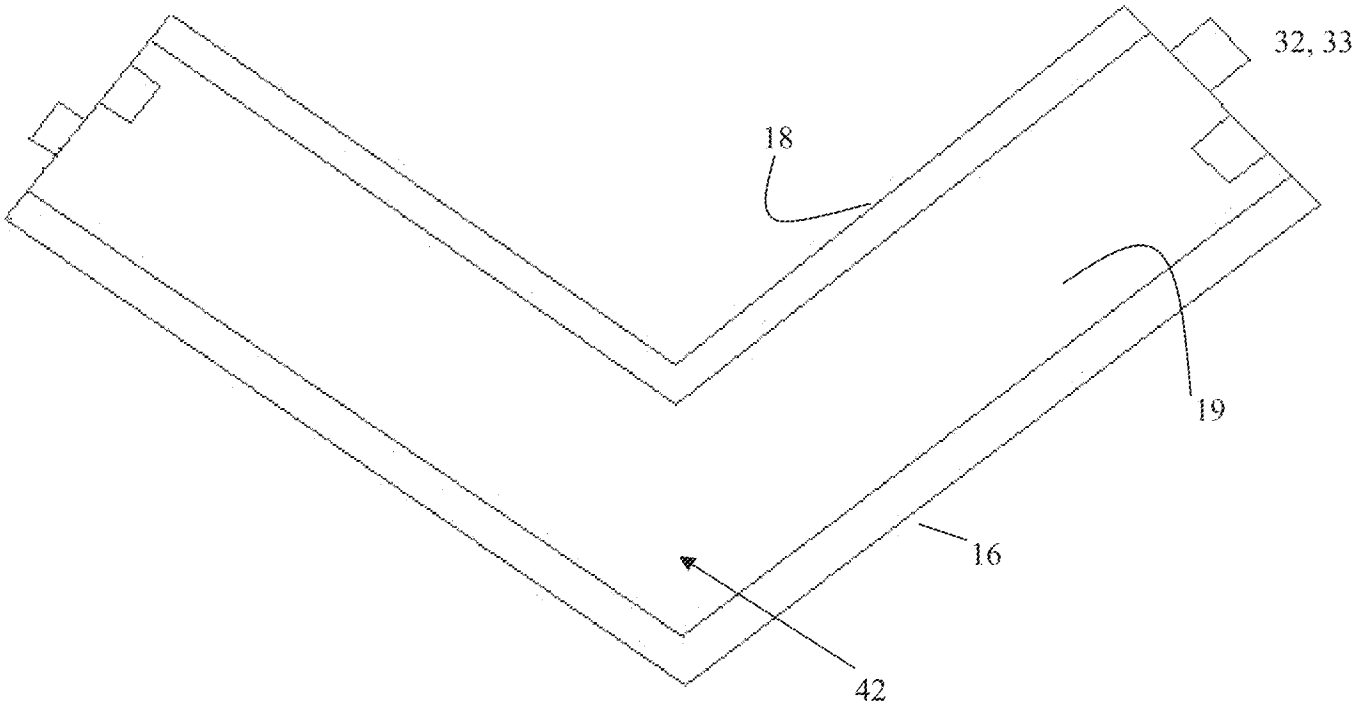
FIG. 8 illustrates a top view of a corner wall panel modular component with seamless corner having continuous insulation to eliminate thermal bridging.
Figure 9A:
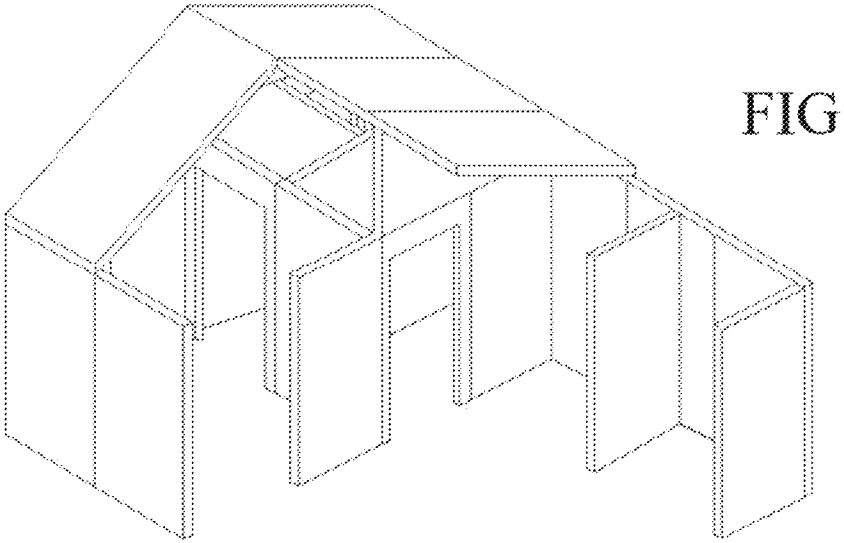
FIGS. 9A and B illustrate perspective views of the modular building components in various stages of installation.
Figure 9B:
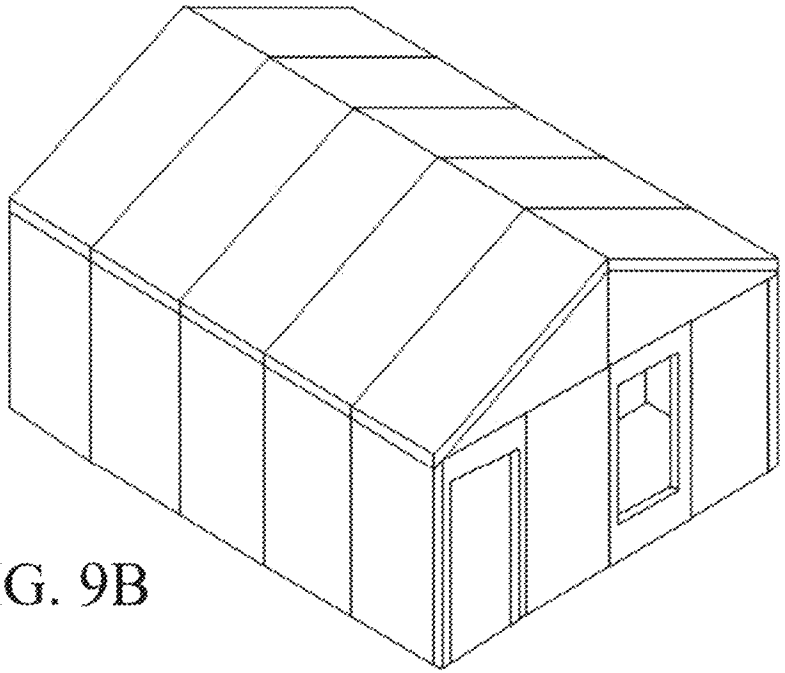
FIG. 9B shows a completely assembled building.
Figure 45:
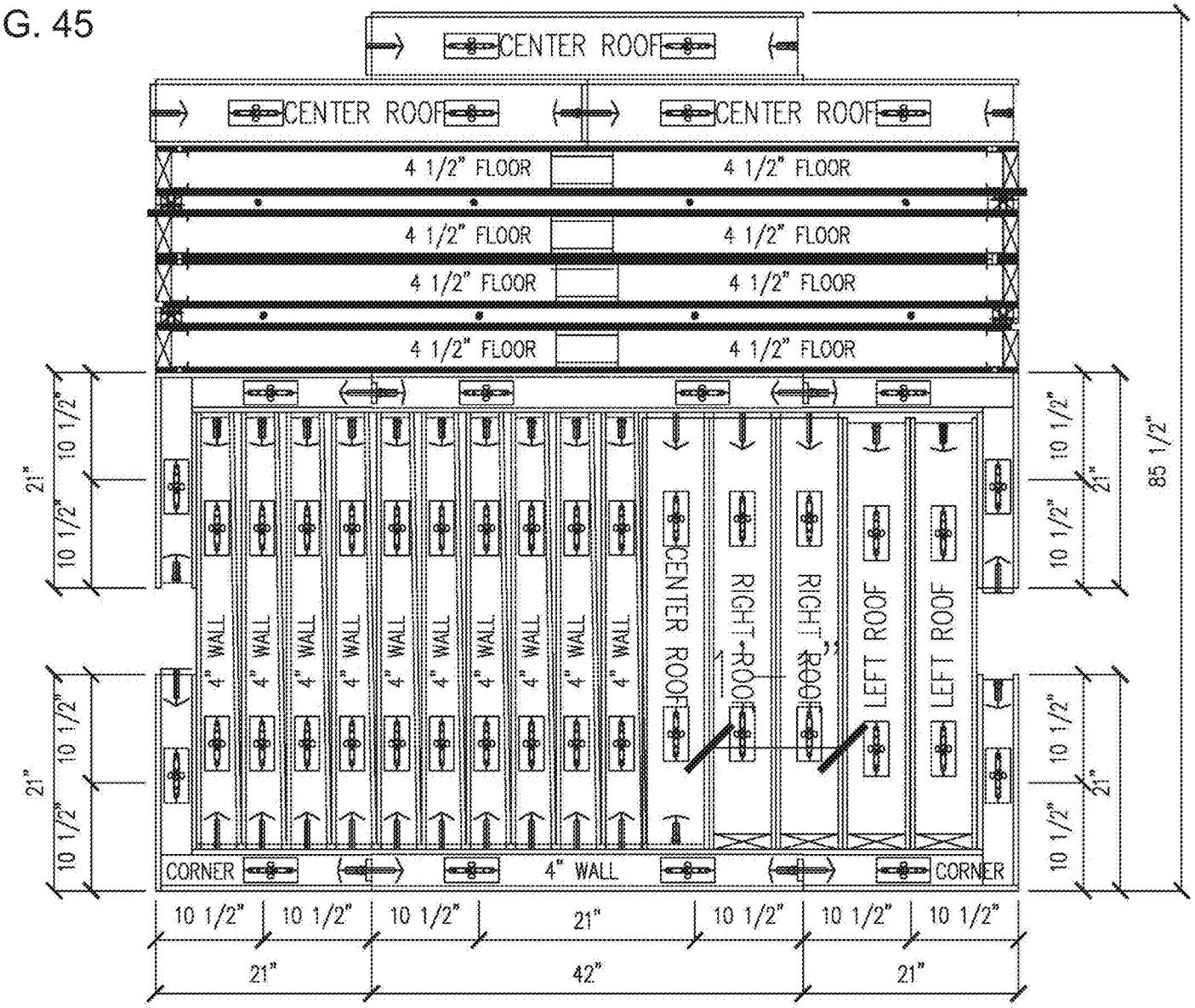
FIG. 45 illustrates a side view of a knock-down building packaged using the corner panels to hold and protect the flat panels.

FIG. 2 shows a perspective view of a container 10 for housing the modular building system according to one embodiment of the present invention. FIG. 3 illustrates a perspective view of stacked contents of the kit for modular building structures as one example (since not all will require the same materials) of the present invention, configured to fit within the container shown in FIG. 2; the contents of this illustration include furniture 1001, panel splines 1010, bedding & food prep supplies 1030, windows & doors 1040, exterior flashing material 1020, kitchen core module 1050, tools & fasteners 1060, bath core module 1070, power generator 1080, environmental equipment 1090, plumbing & electrical equipment 1100, additional supplies 1120, wall panels 1128, gable end panels 1130, roof panels 1140, and roof panel support beams 1150. FIG. 4 shows a loaded container 12 of FIG. 2 with the components of FIG. 3. FIG. 45 illustrates a side view of a knock-down building packaged using the corner panels to hold and protect the flat panels. FIG. 5 illustrates a perspective view of a partially assembled modular building structure 1180, including door component 28, wall panel edges 20, 22, wall panel face side 16, and back side 18, wall panel (generally referenced 14), joined edges or seam 24, roof panel 26. FIG. 6 shows a perspective view of a completed modular building from the partially completed illustration of FIG. 5 including a window unit 30. FIGS. 7A-C illustrate several related views; in FIG. 7A a top view of two edges of modular wall panels having mating double railing 32 for alignment and locking mechanism 34; FIG. 7B illustrates an end perspective view illustrating the parallel spaced apart double track or railing system 33; FIG. 7C illustrates a side view and cut-away of joined panel edges with the interlocking cam-based locking mechanism (cam 36, locking arm 38, seam 40). FIG. 8 illustrates a top view of a corner wall panel modular component with a continuously insulated seamless corner 42 with insulation 19 a face side 16 and back side 18 of the wall panel, and double rail mating alignment components 32, 33. FIG. 9 illustrates several perspective views of the modular building components in various stages of installation.

Doors and windows are also preferably delivered with and included in the building kit. Preferably, openings for the windows and doors are pre-framed in the panels in a manner that allows for rapid window and door installation on site, without additional time or materials required for framing and installation. Doors and windows may also be pre-installed within individual panels at the factory prior to packing into the container. Roof beam pockets are also preferably pre-set in the top of panels to facilitate the placement of rafter or ridge beams to allow for the support of the insulated roof panels.

Magnetic Locking

Figure 10:
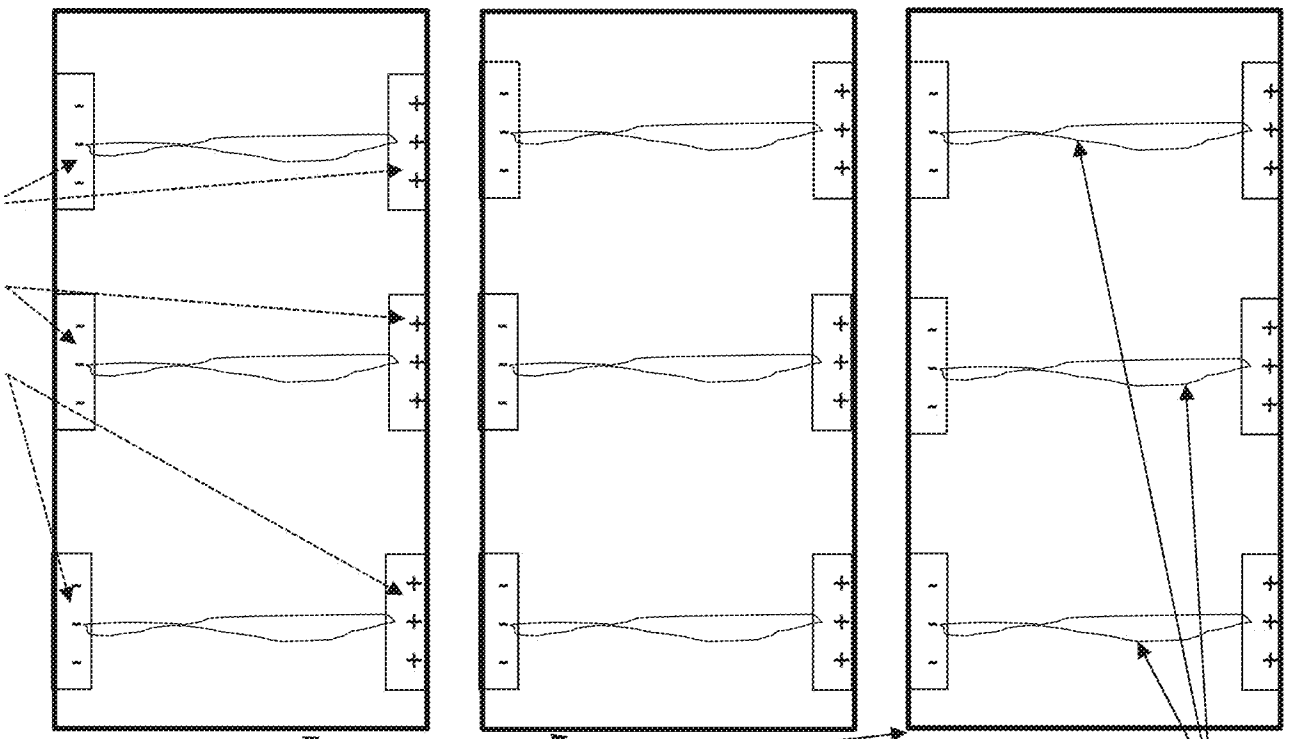
FIG. 10 illustrates a system for locking panels together with magnetic locks.

In an alternative embodiment, the panels are locked together with a magnetic locking system, generally described in FIG. 10. Magnets or electro-magnets on the opposing peripheries of a panel are further inter-connected via a rod or cable to each other contained within a single panel. In this manner the magnetic locking system connects an entire structure with structural reinforcement. The magnets may be permanent magnets or electro-magnets, which are rendered non-functional by either turning off the electric current for the electro-magnet or by sliding segments of a magnet orthogonally to the direction of the magnetic field to facilitate assembly or disassembly or electromagnets, which are activated once they are in place. Alternatively, the electromagnets are deactivated during normal conditions, and are activated or even increased in strength compared to normal operation during events that stress the structure, such as during earthquakes, hurricanes, tornados, floods, explosions, and the like.

Figure 11:
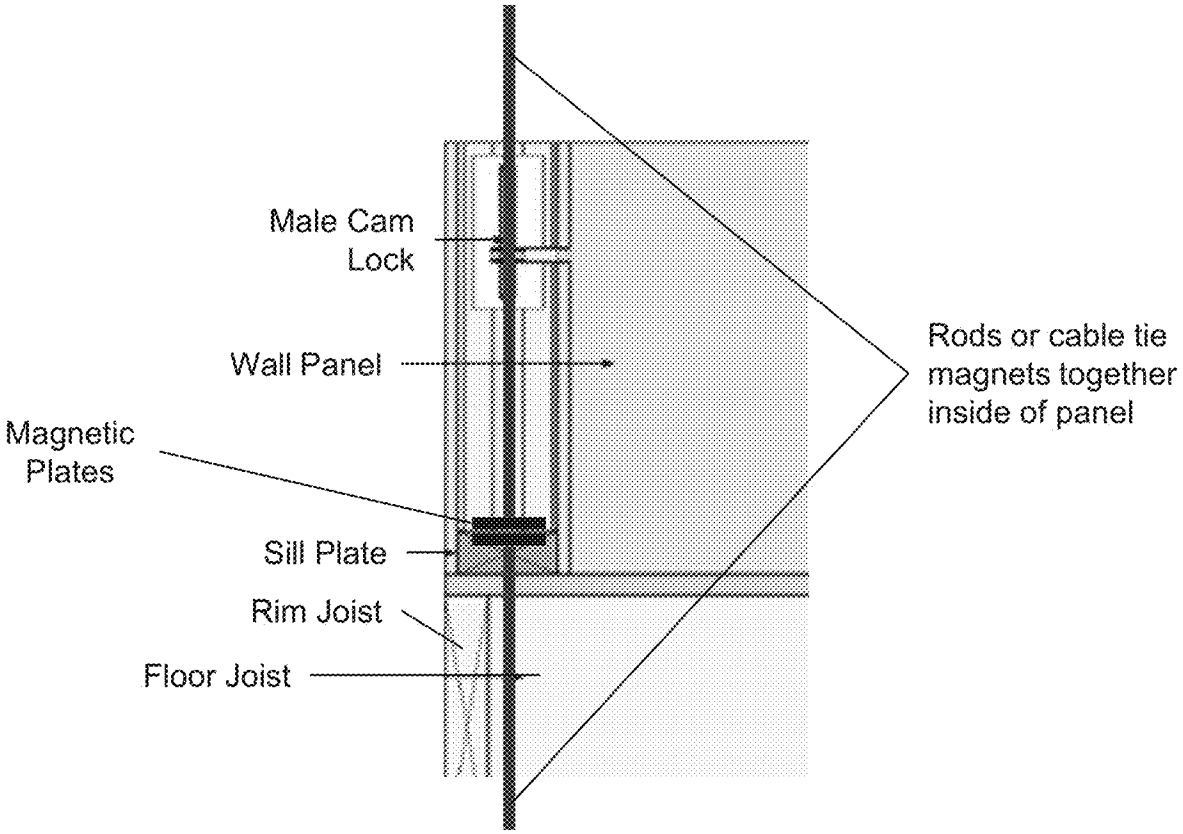
FIG. 11 illustrates a system for locking panels to other structures with magnetic locks.
Figure 12:
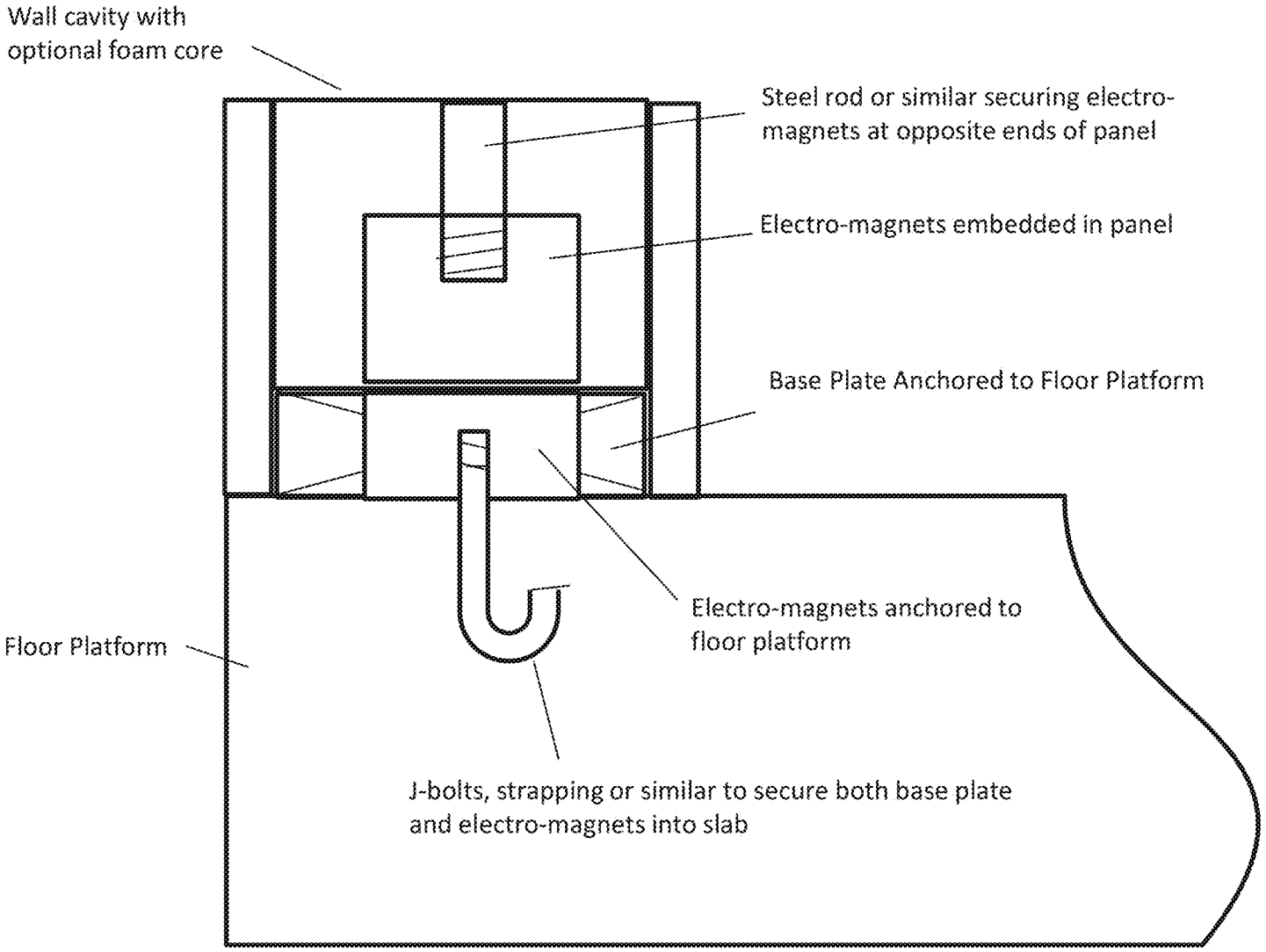
FIG. 12 illustrates another system for locking panels to other structures with magnetic locks.

Another magnetic locking system, used to anchor the structure to a floor or footing or to a truss or other structural member of a roof is shown in FIGS. 11 and 12. Not only is this magnetic locking system used to attach one panel to another panel, but it is also used to attach a panel to a non-panel structural member, or to attach two or more non-panel structural members to each other.

Header

Figure 13:
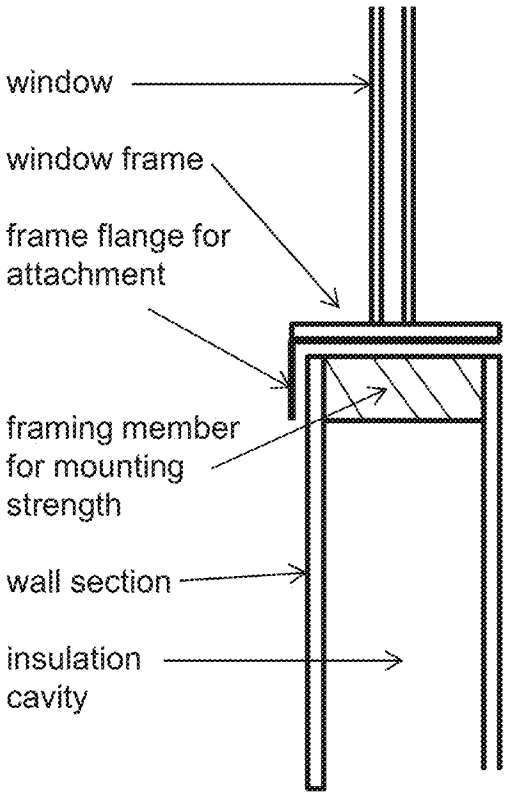
FIG. 13 illustrates a prior art header.
Figure 14:
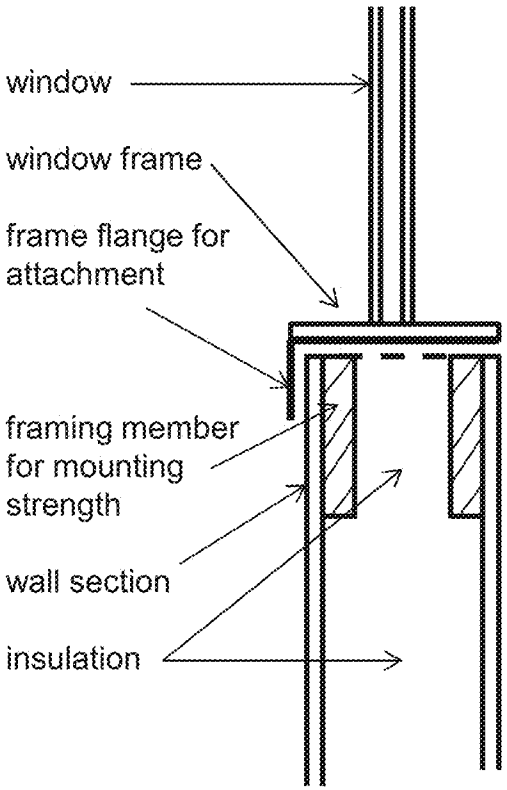
FIG. 14 illustrates a header according to the present invention.
Figure 15A:
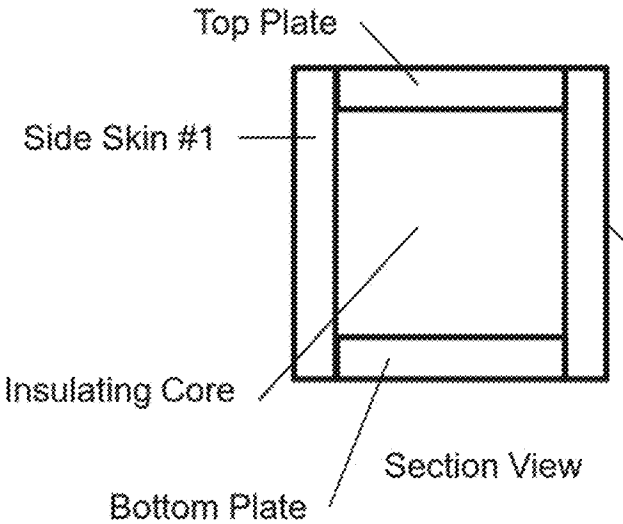
FIGS. 15A-C illustrate a header according to the present invention.
Figure 15B:
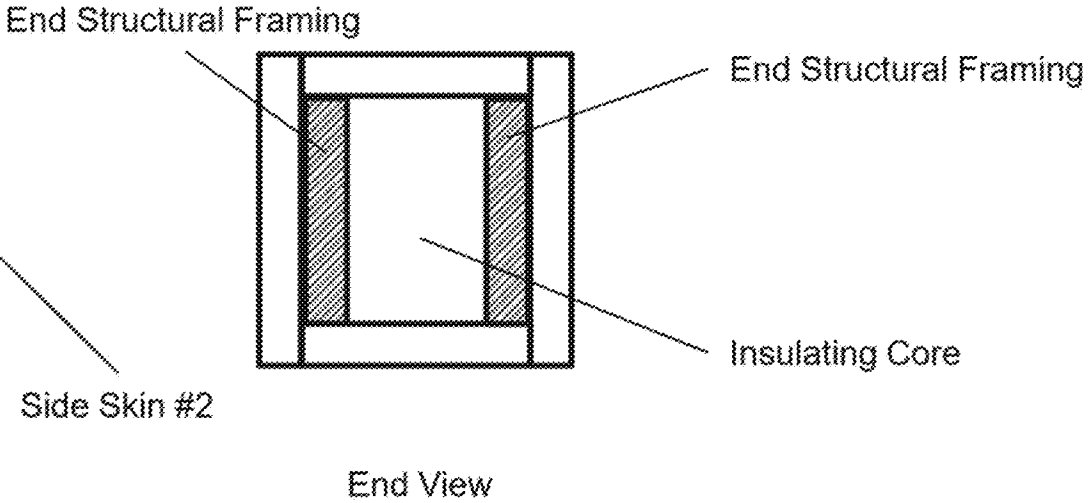
Figure 15C:
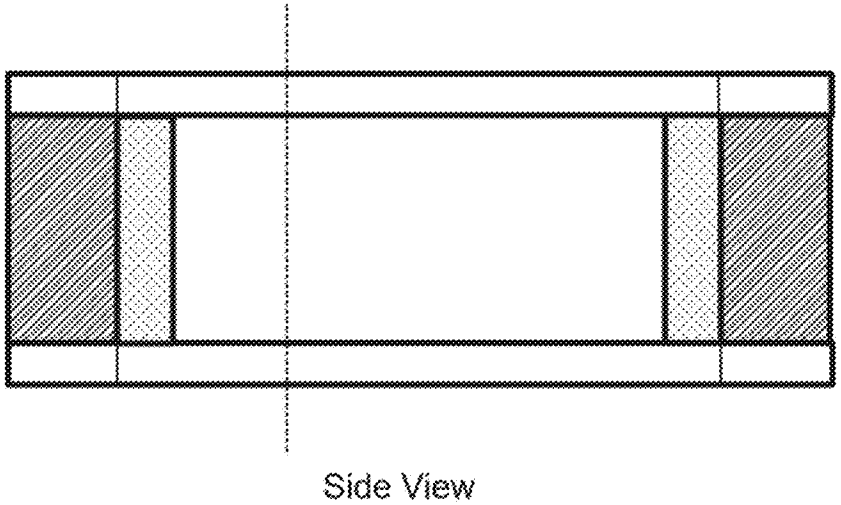
Figure 16B:
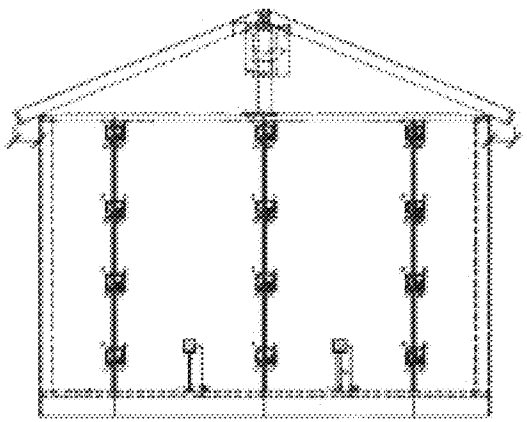
FIGS. 16A-D illustrates assembled panels with embedded conduits and junction.
Figure 16A:
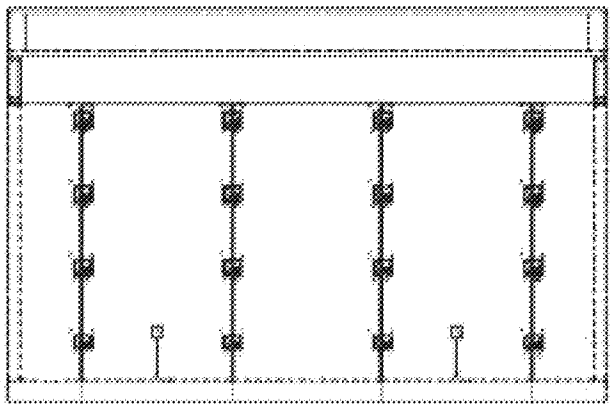
Figure 16D:
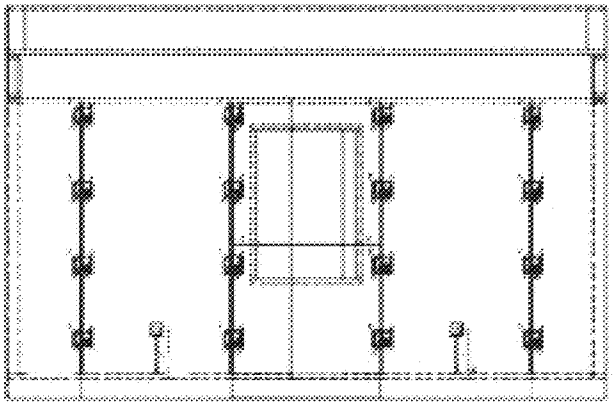
Figure 16C:
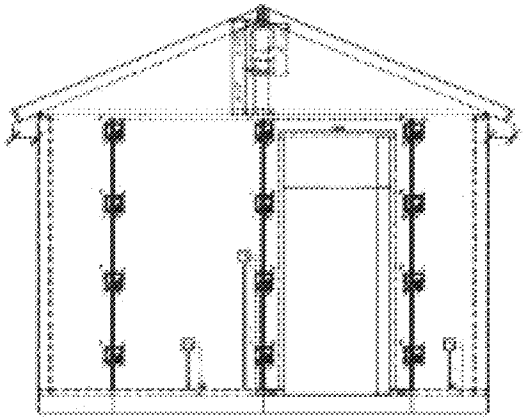

A header panel is a load bearing member that goes over a large opening like a window or a door. Standard industry practice is to have this member be a continuous framing member such as laminated veneer lumber (LVL) or similar and having very high strength but low insulation value. Prior Art FIG. 13 shows a standard wall section detail at a framed opening, which allows thermal bridging (energy loss) where the framing member bisects the wall. The present invention is an insulated box beam offering a continuous end-to-end insulated core and still offering very high structural strength. FIGS. 14 and 15A-C show this energy efficient method of mounting a window or door section. FIG. 14 shows a wall section detail at a framed opening where a continuous framing member has been replaced with a much more energy efficient configuration while still providing structure for window or door mounting. FIG. 14 illustrates both a top and bottom chord (typically framing lumber) of the header or footer and its adjoining panel skins along with additional framing lumber at the ends of the header or footer to allow attachment to adjacent panel. FIG. 15B shows that there is minimal thermal bridging from one side of the panel to the other while still retaining significant structural strength by virtue of the interior foam insulation.

Thus, the header or footer panel is provided that eliminates much of the thermal bridging normally associated with the framing of the opening for a window or door type panel.

Embedded Conduits

In another embodiment of the present invention, the present invention includes electrical supply components. The electrical supply components include electrical junction boxes, conduit and/or radiant heating coils, wherein the electrical supply components are preferably molded inside of the panels. Beneficially, the structure is assembled quickly and is pre-fitted with conduit (as delivered to the site in the self-contained kit, preferably in a shipping container), to allow for quick installation of a fully-equipped building, including electrical functionality (FIGS. 16A-D). The panels include a standardized box which is hot pluggable by consumers to facilitate changing out the modular device contained in the box. For example, the modular device is a standard electrical socket, or a networking interface, or a USB charger, or a sensor array. These modules also preferably include a locking mechanism, so that they can't be easily removed from the wall. This is useful in public buildings.

In another embodiment, the panels are pre-wired to include embedded technology modules, wherein the embedded technology modules include embedded data+power access points. In a preferred embodiment, these access points are mounted flush with the panel surface, and opened, for example by popping out, to provide a connection interface.

The present invention provides for pre-installation of devices in the panels. Thus, the panels arrive at the construction site with devices such as microphones or wireless transceivers already installed or easily inserted because receiving hardware is already installed within the panel.

Pluggable, embedded technology modules as provided for by the present invention are also used in structures that are not entirely built with the modular panels. The pluggable, embedded technology modules are configured for network connectivity. For example, in a building wherein only the ceiling is built with panels or not at all built with panels, a data/power access box in a panel in the ceiling is used for a pluggable light or a camera. In another example, in a building without panels these new technologies could be installed in sockets or receivers of the same or similar form factor, like a common 4"×4"×2" electrical box normally used for wall power outlets or light switches.

Lighting

The system provides for mounting LED lighting within the panels. For example, on the upper part of the wall, LEDs are mounted to provide illumination. The longevity of LEDs means that they rarely need to be changed. With ambient light sensors, they are also used to produce a constant amount of light making the space more pleasant.

Embedded Devices

Figure 17A:
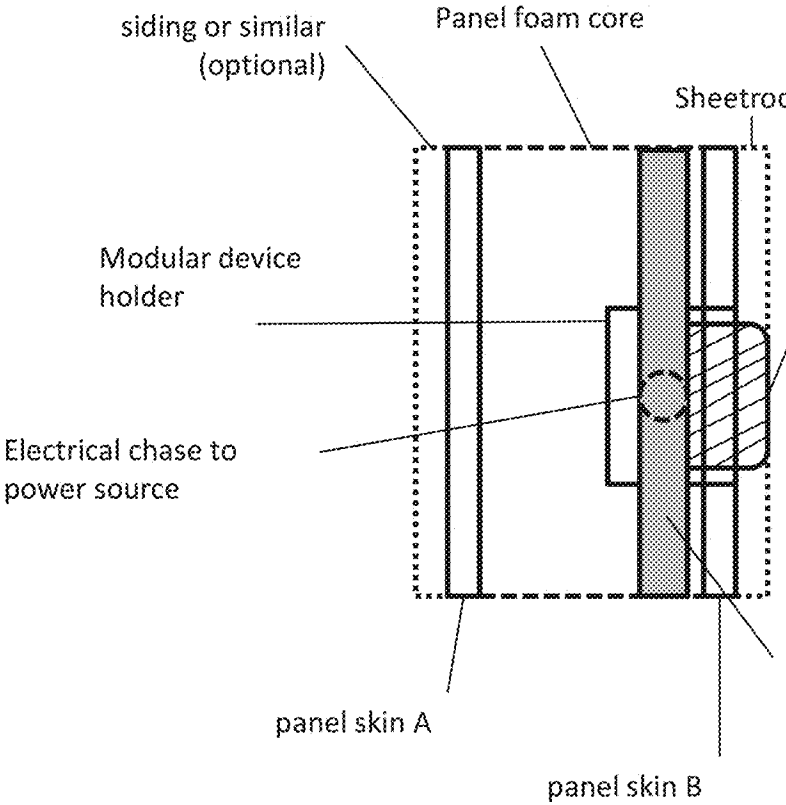
FIG. 17A is a cross section top-down view of a prefabricated building panel with embedded modular electronics technology that is either embedded at the factory prior to delivery to the build-site or simply have a socket for future receipt of a desired technology module to be installed after future purchase by someone who controls the finished building
Figure 17B:
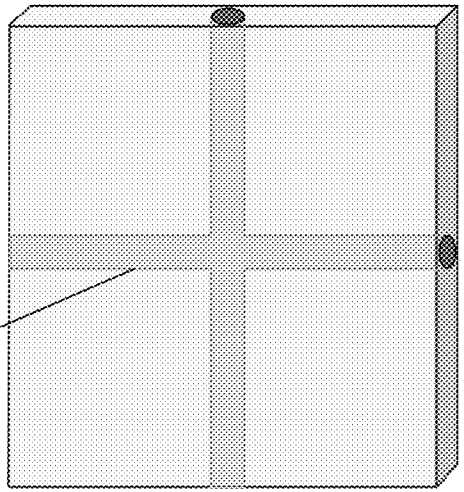
FIG. 17B is a semi-transparent, perspective view of a panel with a 4-way chase.
Figure 18:
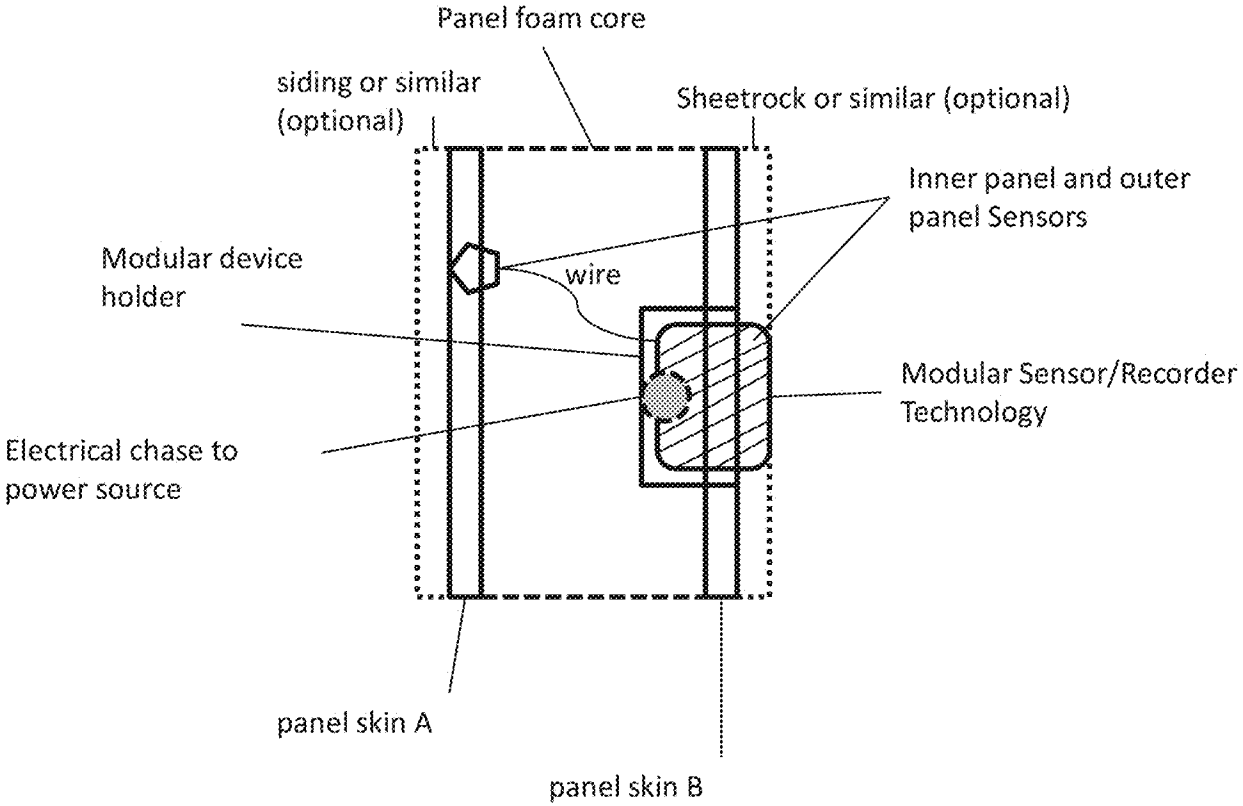
FIG. 18 is a cross section top-down view of a panel with embedded temperature, moisture and/or humidity sensors or any combination thereof.

As shown in FIG. 17A and FIG. 18, the panels are embedded with power technology, electronics, software, sensors, and network connectivity that enable them to collect and exchange data and control the structure and its accessories. Multiple technologies are utilized, ranging from wireless communication to the Internet and from embedded systems to micro-electromechanical systems (MEMS). Thus, the panels merge embedded systems, wireless sensor networks, control systems, and home and building automation into the structure. Electronics are embedded in panels at factory or on the job-site. FIG. 17B is a semi-transparent, perspective view of a panel with a 4-way chase. The 4-way chase allows circuits to be run from horizontally and vertically.

Figure 19:
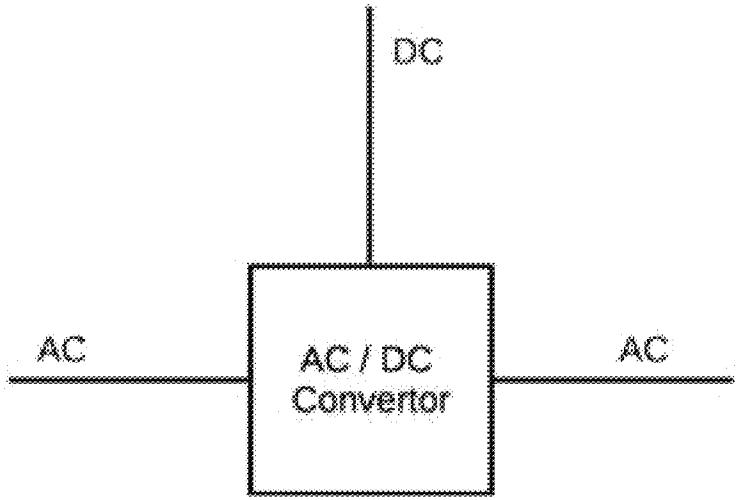
FIG. 19 illustrates a Texas Instruments port device for converting A/C power into D/C power.

The panels also include an AC/DC converter or inverter. For example, a Texas Instruments-port device (FIG. 19), which takes in AC power and then pass out DC power for lighting and other building management functions. The TI port box looks like a standard wired AC device, but it outputs a DC supply at an Intermediate Bus Voltage (IBV). IBV is preferred to be below 48V for safety reasons. In an embodiment, the output is floating.

Additionally or alternatively, the panel includes an AC/DC inverter, such that a DC electrical supply can be plugged into the system via one of the panels to power the system.

IR or light based communication devices are also used in the present invention. For example, these are used to turn off appliances, such as a TV or stereo, if no one is in the room. Likewise, ultrasonic communication is used in some embodiments.

In another embodiment, a power lines networking system is included. The system preferably has a security that is unique to the building.

The communication lines for the communication system are pre-installed or pulled through the same conduit (chase) as the power lines or having dedicated communications chases to prevent signal degradation through conflicting electrical fields.

Network Devices

Preferably, the embedded technology modules are modular network electronics, such as: wireless access point (router); wireless signal repeater; antennae; access control technology such as remote-controlled magnetic locking device for doors; and the like. FIG. 17 shows a panel with embedded wireless or data technology for standard residential installation. The panels include and/or are pre-configured to accommodate various networking technologies, including: RFID and near-field communication; bidirectional optical technology; optical tags and quick response codes; Bluetooth low energy; Low energy wireless IP networks, such as embedded radio in system-on-a-chip designs, lower power WiFi, and sub-GHz radio in an ISM band; ZigBee; Z-Wave; LTE-Advanced; WiFi-Direct and the like. These devices are connected wirelessly or via wires run through the chase. Any number of chases are provided in a panel, either independent or connected. FIGS. 17A-B illustrate a panel with a 4-way chase. In one embodiment, Smart RFID tags help ensure adjacent panels are supposed to be connected together.

Wireless relays are also be mounted to the access points to create or extend a communication network. The communication network created by the assembled panels are wired, wireless or combinations thereof. In a preferred embodiment, the panels contain wireless relays that provide a wireless mesh network.

Sensors and Recorders

In another embodiment, the embedded technology modules include sensor and recorder technologies. Preferably the sensor technologies are modular and either embedded during manufacturing or on the job-site. Information from either side of the panel or the interior of the panel is captured. By way of example and not limitation, sensors include: temperature sensors, humidity sensors, video, smoke/fire sensors, image capture (still image for comparison), air quality, radiofrequency (RF), gas (CO2, CO, etc.), sound sensors (microphone), volatile organic carbons (VOC) sensors, ion mobility spectrometry (IMS), accelerometers, and motion sensors. Accelerometers can be used to determine if a panel is vibrating abnormally, and therefore indicate that the cam-locks might be failing. The sensors generate panel events, which are recorded in a database in the central computer system.

Recorders are also mounted with the sensors at the data access points (FIG. 18). By way of example and not limitation, video recorders are mounted with the video cameras.

Monitor "Window"

Figures 20A, 20B, 20C:
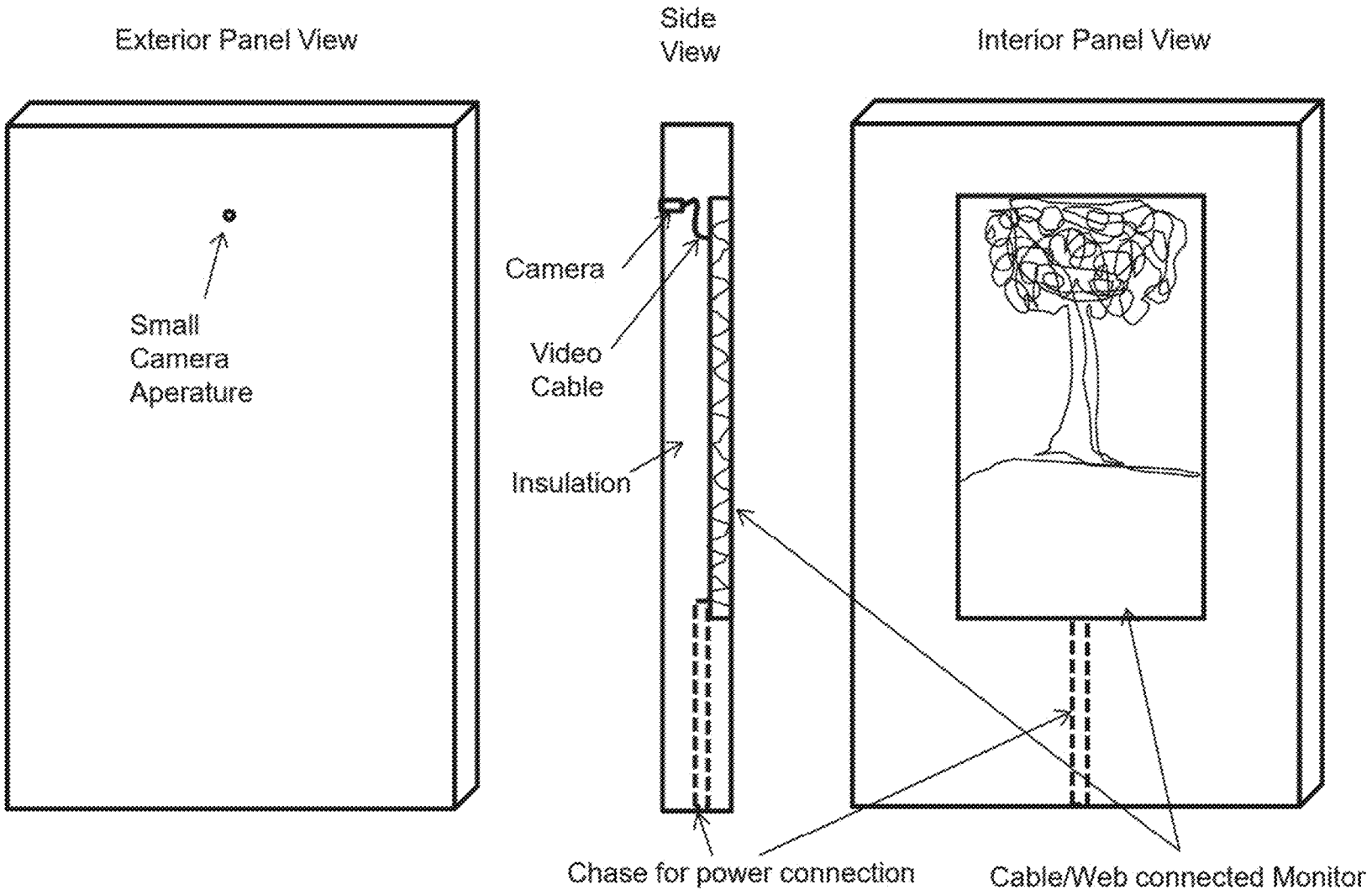
FIGS. 20A-C illustrates a panel with an external video camera and at least one interior monitor whose video signal either comes from the attached video camera or from another video source if panel is linked either by wire or wirelessly to another data source, such as the Internet.

Another type of panel provides an external video camera and at least one monitor mounted on, or embedded in, the interior side of the panel, thus providing inhabitants with a view of the exterior (FIGS. 20A-C). The "one-sided-window" is preferably a web-enabled camera and monitor embedded in a panel for energy saving, security and/or entertainment purposes. In an example embodiment, a small aperture high quality camera is mounted to penetrate the exterior of the panel skin and is connected to a video monitor viewable from the interior side of the panel, thus serving as both an inconspicuous surveillance device and as a "one sided window" offering a view of the outside. This system provides significantly higher insulation value than a standard window, thereby saving energy. Additionally, in another embodiment the monitor windows are mounted in the reverse direction beside a door, thereby providing external visitors with a view of the approaching occupant. These same panels are provided as skylights; enabling the user to control the amount of lighting throughout the day. The monitor windows are also used for teaching: when a particular topic is discussed, the windows change from a view of the exterior to the topic of discussion. The present invention also provides for a panel with a camera with a monitor mount. Thus, the panel with camera are shipped separately from the monitor.

Alternatively, a web-connected monitor allows a user to experience different vistas by connecting to remote cameras all over the world. For example, a viewer "wakes up in the Caribbean" by having a view from a Caribbean island transmitting in the morning. In conjunction with an exterior motion detector, the system switches to the exterior view when motion is detected; otherwise, the monitor displays a predetermined view.

Alternatively, a structure erected in Afghanistan could have camera/monitor panels allowing someone in Nevada to "remote monitor" the outside of the structure while the occupants slept in the interior or while they were not there at all. This is much like remote flying of an aerial drone.

Automatic door unlocking is also provided for, such that emergency response personnel can unlock the building quickly in case of medical emergency. The audio sensors with cameras and RF doppler are programmed to determine if an occupant has collapsed or is not moving when they are expected to, or gives an alert. Once the central computer system determines that there is an emergency situation, it alerts the appropriate emergency services. For example, in case of a fire, the fire department will be notified by the central computer system. If the building is occupied while on fire, the fire department and the EMS will be notified. The central computer system also unlocks the doors, windows and other access points, or alternatively enables the emergency unlock system, which allows the emergency services to unlock the doors, windows and other access points. When the emergency services arrive, they trigger a pre-determined electronic signal, such as an RFID or EMS band radio, which signals the doors and windows to unlock. In this manner, the access points cannot be unlocked by these emergency signals when there is no emergency.

Solar

Figure 21:
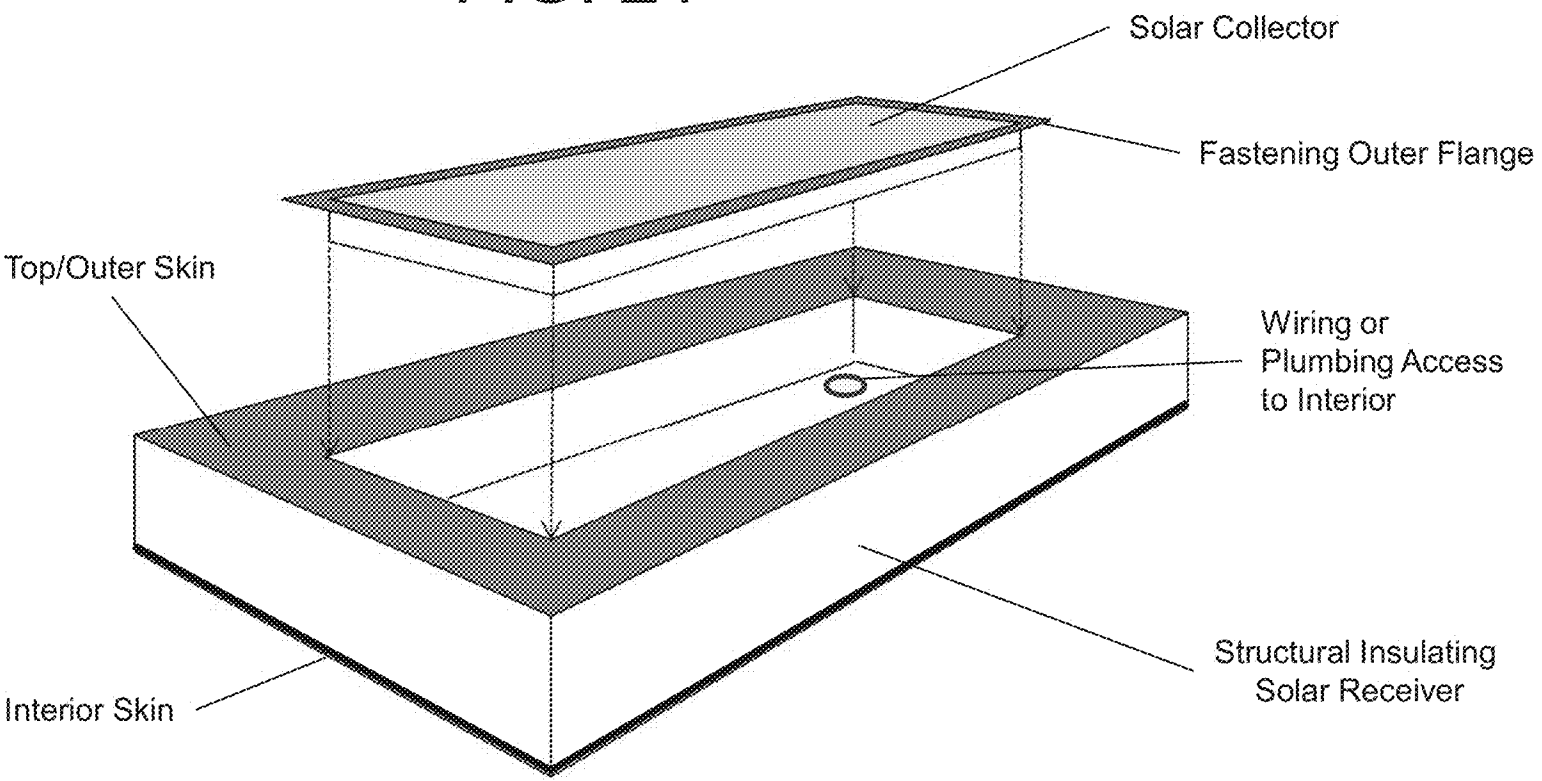
FIG. 21 illustrates a panel with an integrated solar collector.

In a preferred embodiment, as shown in FIG. 21, the solar panels are integrated with the building panels such that the exterior surface of each solar panel is ideally flush with the exterior surface of the building panel. A structural insulating panel is modified to receive a solar collector that produces either solar thermal or electrical energy for power or water or air heating.

Standard practice for the mounting of a solar collector panel is to mount it on top of the wall or roof panel as an entirely separate assembly. Large air cavities or gaps often exist between a solar thermal collector and the roof, for example, and this creates very large losses of thermal energy. By mounting a solar collector contained within an insulating wall or roof panel the efficiency of the thermal collector is increased while at the same time moving connections (plumbing or electrical) to the interior, where they are better protected.

Furthermore, in another embodiment the panels include concentrating photovoltaic systems comprising high efficiency multi junction solar cells that use optics to concentrate sunlight.

Climate Management System

Figure 22:
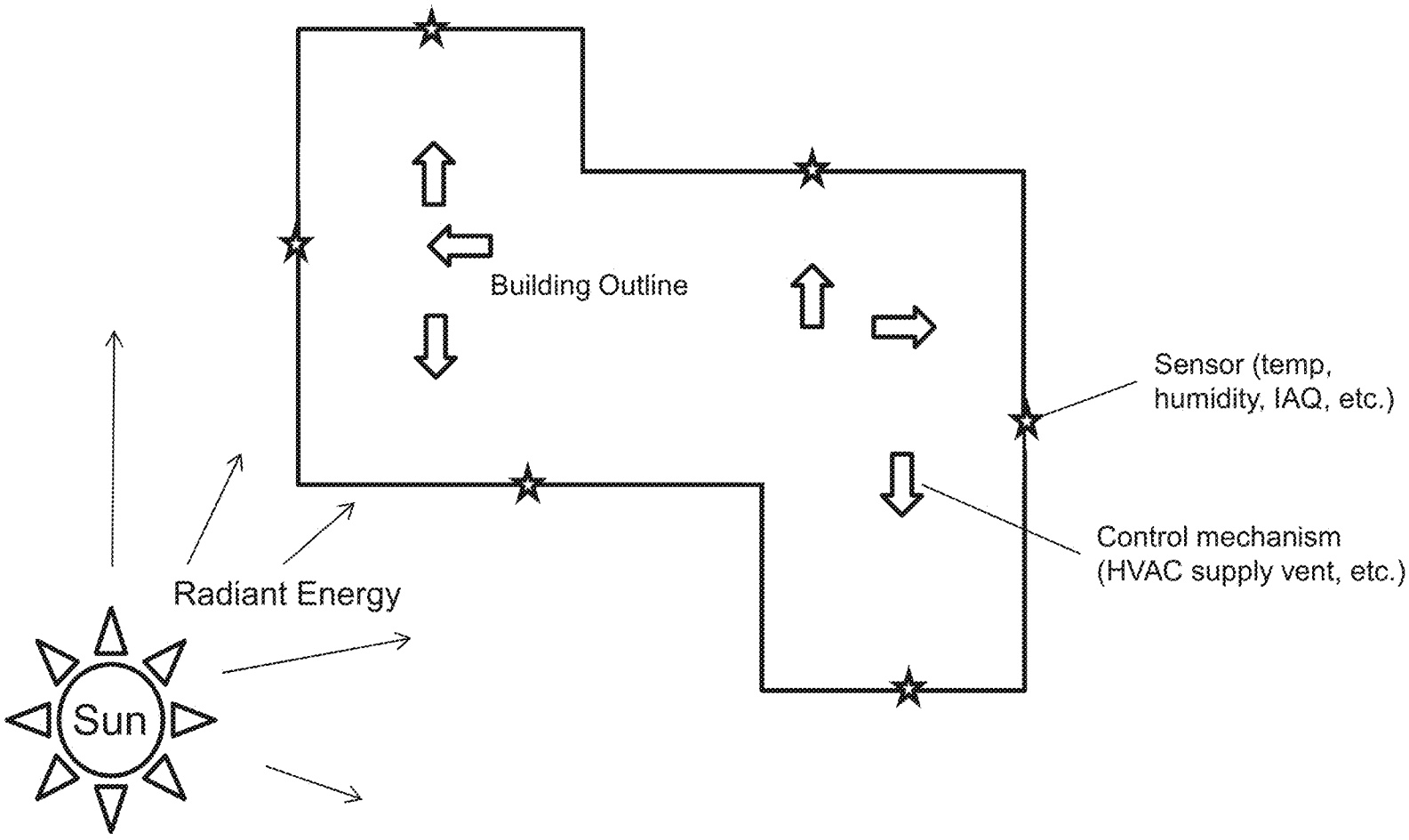
FIG. 22 illustrates a schematic diagram of a distributed sensor network for interior climate control.
Figures 23A, 23B, 23C, 23D:
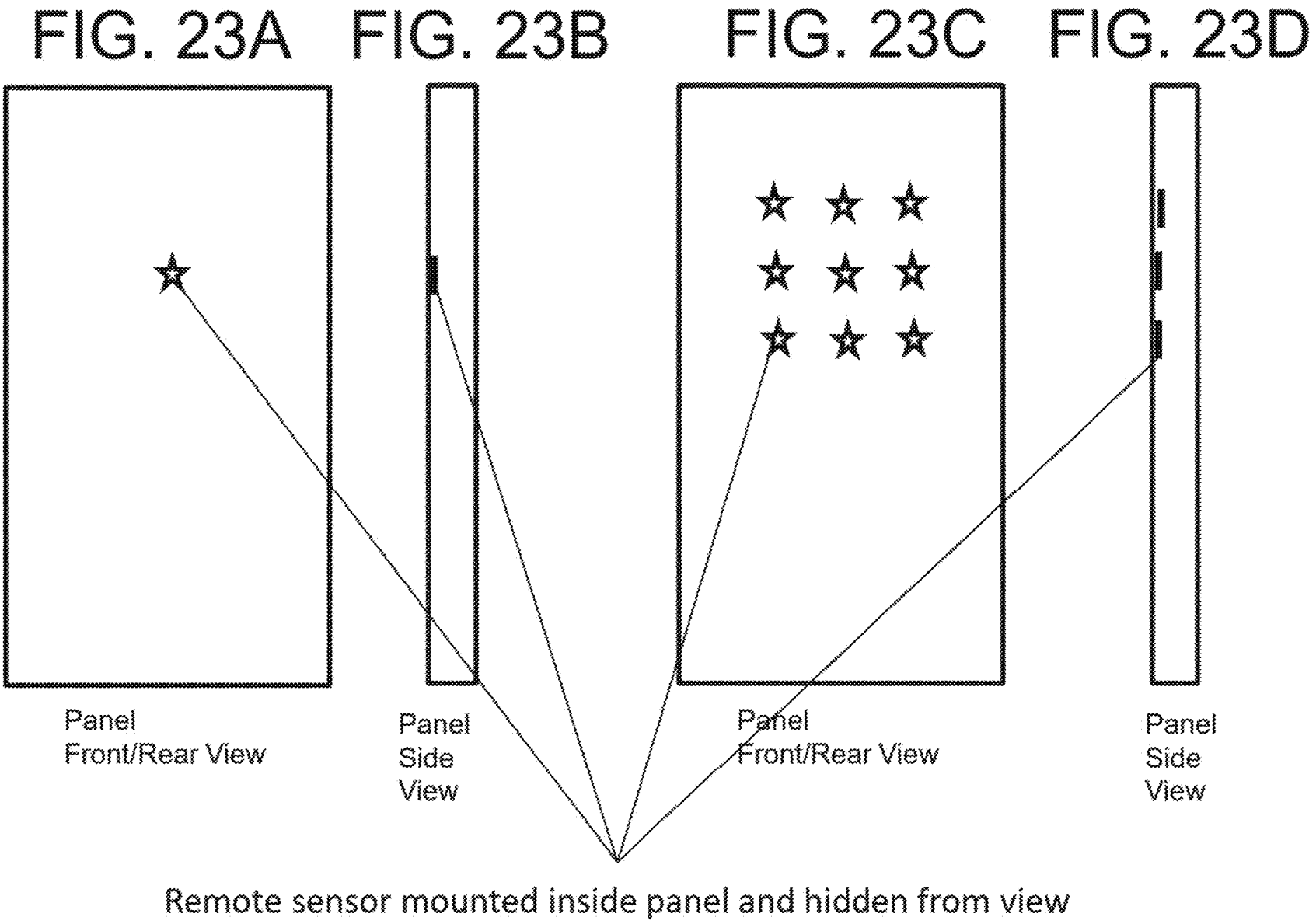
FIG. 23A-D Illustrate a wall panel with embedded sensors for controlling entry.
Figure 24:
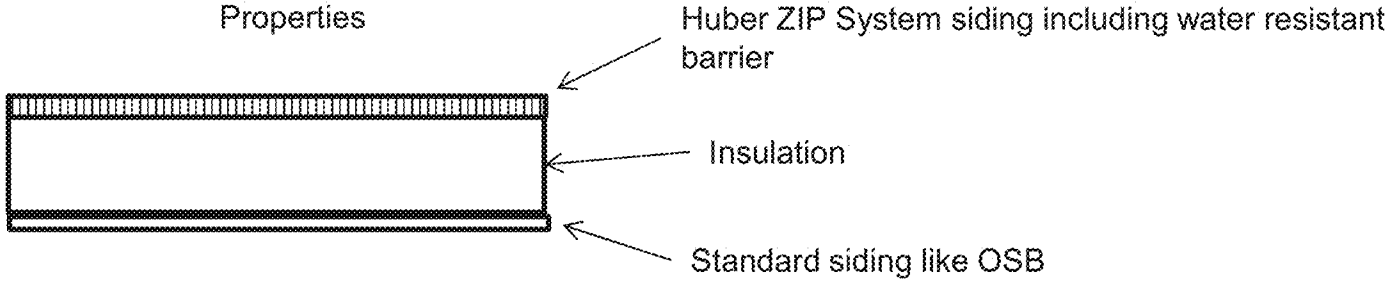
FIG. 24 illustrates the structural siding materials of the panels employing complimentary technologies useful in building envelope construction such as embedded housewrap employed by the Huber ZIP System sheathing offering both a water resistant barrier and an air barrier for the panel skin.

The invention provides for a climate management control (CMC) system (FIG. 22), which senses the external environment of the structure through the distribution of temperature sensors communicating through wireless technology with a central control point and embedded in panels at particular locations all around the building envelope, both interior and exterior. This system anticipates changing room temperature, humidity and comfort levels to better maintain the interior in a predetermined comfort zone. By so doing, the networked structure achieves similar or greater comfort for the occupants at similar or lesser cost of previous systems.

The panels include temperature, humidity, light (especially infrared), and other sensors embedded in the panel's exterior and interior surfaces (FIG. 18) to sense and transmit the environmental data to other devices on the network. Since outside energy conditions have a tremendous impact on interior conditions it is desirable to move the environmental sensing technologies (like a standard thermostat or an IP enabled thermostat) to the exterior of the building envelope and have those sensors communicate with a central unit controlling different zones in a house.

Because thermal flow through the panel takes time, the CMC will know how hot or cold it is outside the wall or inside the wall or at the interior of the wall and then be able to react accordingly as the temperature profiles of the structure itself changes. For example in the northern hemisphere the north side of the structure will almost never see the sun (unless reflected off of something else) and will have a different thermal profile than the south side (most sun), east side (morning sun) or west side (evening sun) walls or roof of the structure. Through this data of the very dynamic nature of the thermal profile of the structure throughout the day and night the CMC more efficiently manages the interior temperature of the structure and thereby save significant money over a period of time compared to the traditional "thermostat" technology.

A traditional thermostat does not know if it is a hot day or a cold day, if the sun is out or if it is cloudy or rainy, merely it tracks the interior temperature long after the conditions outside have affected most of the building's interior, creating additional work for any interior climate control system triggered by this thermostat.

Thus, a distributed sensor network for interior climate control (FIG. 22) monitors different environmental parameters (temperature, humidity, visible light, infrared radiation, etc.) at the outer perimeter of the structure and a central information processor uses the data to anticipate what interior environmental conditions will be in the future and directs a distributed HVAC vent system to more accurately control interior conditions with significantly fewer resources, saving energy, money, etc.

The climate control system opens windows (e.g. cloister windows) to cool (or warm) the house in an energy efficient way. These may also consider variables such as temperature, humidity, wind speed and occupancy to determine whether to open windows.

Panel ID

Each panel has a unique electronic identifier, which is accessible through the network and provides both a network location and a physical location relative to the other panels, and therefore the location of the panel in the structure is determined. In an example embodiment, the unique identifier is an RFID tag. In this manner, the exact location of each panel is known, and therefore any malfunctions or misplacements are quickly located.

For example, some panels have an embedded iBeacon for locating the panel. In addition to being active and compatible with cell phones, the iBeacon is used after installation to know what the capabilities of a particular panel are.

In an alternative embodiment, each panel includes an LED, which is modulated to allow easier physical location of the panel by user.

Panels embedded with an electronic identifier, either RFID or otherwise, are able to detect when they are connected to a correct adjacent panel and signal through the network to an output device. The panels are programmed to detect the identity of an adjacent panel, then signal if the identity matches a stored identity. Each panel contains an RFID and a database of matching panel identifiers. When the RFIDs are activated by the assembler using a reader, they transmit their signals. The signals are received and checked against the database. Alternatively, the central system controller receives the identity of the two panels, and check that their placement is correct. The panels are able signal the correct placement of two panels as they are connected, through the central controller and/or by lighting the two LEDs of the panels, such that the assembler immediately knows if the panel just added is correct. The panels also signal through the network to an output device when all the panels are assembled and connected for a given structure.

The central computer system maintains a database of events for each panel. For example, the database maintains records of the electronic devices plugged into the panel, the records of the sensors plugged into the panel, and the like.

Building Control

The network connectivity is extended across modules for a building control system or across buildings for a building complex control system.

FIGS. 23A-D illustrate a wall panel with embedded sensors for controlling entry. either singularly or in an array to facilitate a positive response (such as entry access) with someone having a key device (smartphone, watch, wristband, vehicle, etc.) triggering the sensors in a code-affirmative actuation.

A remote sensor, or an array of remote sensors contained within one or a multiple of panels is used for access control mechanisms where the "key" device is provided by the person desiring access and access is acquired by a simple remote sensing or a specific pre-determined pattern of sensing (similar to code on a keypad sequence).

Magnetic door locks are also integrated into the panels. These are controllable through the embedded data network (described herein), thereby providing an access control system that is integrated into the panels and ready for activation immediately upon assembly of a structure.

Containerized

In a preferred embodiment, the entire system is packed as a complete kit within a cargo container or standard shipping container as illustrated in FIG. 2. This optimized packaging for using the container facilitates the delivery and storage of multiple containers in a central location until such time as needed for rapid erection of a structure, for example in the case of an unexpected natural disaster. This building kit also preferably includes a complete tool kit to facilitate complete assembly of the structure; the building kit also includes items such as an electric generator, limited fuel for the generator, a renewable power source such as solar panels or wind turbines, water and basic non-perishable foodstuffs, thereby providing for a complete emergency shelter that can be occupied and used immediately upon delivery and installation, without requiring any separate tools, supplies, or equipment to be a fully-functioning facility or shelter. The container also includes cabinets, sinks, toilets, showers and even furniture for installation within the modular building to provide for immediate and also possibly long-term occupancy in the shelter. The cargo container is then used as a secondary structure for storage if left on the site.

Advantageously, the panels of the present invention are the most advanced structurally insulated building panel on the market today. Except for corner panels, all flat panels are provided so that they will stack tighter. In some configurations corner panels can efficiently be used to "wrap" the flat panels. The present invention provides a modular building system for creating an energy-efficient structure including: a multiplicity of pre-fabricated panel wall components and roof components, each having a face side and a back side and four edges including a pair of spaced-apart parallel tracks that run the length of at least two opposite edges for aligning the edges together to form a seam, wherein the components further include locking components for securedly attaching the components together along the seams.

Also, methods for providing a modular building structure including the steps of:

providing a containerized kit wherein the kit is sized and configured to be enclosed by a housing and includes therewithin a modular building system further comprising a predetermined number of modular wall components, a roof system, and at least one door;

providing instructions for assembling the modular building system for forming a complete building unit, including aligning the modular wall components along their opposite edges via a mating profile that extends along the length of the wall to provide an energy efficient seam when wall components are joined.

One application for the present invention includes a structure or building for a command or support center after an emergency to be erected on a flat surface. Other applications include but are not limited to medical center, school or residential structures.

In preferred embodiments of the kits for modular buildings, preferably included with the modular panel components for assembling to form a basic structure are the following:

Panels in a pre-configured kit including ventilation technology, window panels, door panels, two segment and multi-segment corner panels, beam pocket panels and window(s) pre-set into at least one panel; at least one door frame is fitted to allow final site placement quickly and easily; alternatively, the door is pre-installed. The panels have at least some finishing on the face side that would be externally or outwardly facing upon assembly and installation for the building structure, by way of example and not limitation the face side finish includes a pre-finished exterior siding such as commercially offered by Hardi Panel or LP SmartSide; a plurality of structural members for supporting roof structure including a modular box beam with joints secured by pins; at least one composite sill plate and secondary base plate with flashing for foundation; tools required for structure assembly including panel cam-locks, sealant foam, foam applicators, etc.; instructions, plans, and figures illustrating assembly in at least one language or even multiple language(s) as required, preferably including figures showing step-wise assembly and installation, as well as an indication or listing of all the parts and components within the kit and how they relate to each other; rigid flashing for the top roof ridge (at the junction of the two different panel slopes), roof lining material, finished roofing material, modular electrical baseboard outlet kit; communications system or equipment (such as by way of example and not limitation, a communication system for satellite-based telecommunication of voice and/or data); scaffolding if wall panels were greater than about 8 ft. in height; Universal Power Supplies & filter (UPS) for sensitive electronic equipment; solar panels (PV or solar-thermal) for attachment or integration with select panels, preferably roof panels; FRP laminated panel interior (like for medical or school application); at least one bathroom module including sink and toilet, and preferably a shower unit.

Additionally, it is preferred to have equipment and/or appliances included with the kit to provide a fully functioning building structure with energy, heat and/or cooling, testing equipment, refrigeration, cleaning equipment, portable beds and/or bedding (in particular in the case of a medical structure application), at least one generator with fuel storage tanks safe for long term storage (LP, LNG, etc.), a potable water supply or container therefor (such as for about 250 gal of water), meals ready to eat (MRE) wherein the quantity depends upon user specification, cooking equipment, such as portable camping-type ovens; matches or other flame source, a ladder, solar oven or solar-powered cooking or heating equipment; water purification system for point-of-use water treatment; water collection system (including but not limited to rain collection), portable battery-powered and/or rechargeable lighting, computers and electronic equipment, etc.

Other optional supplemental items for inclusion in the kit include the following: basic modular furniture (tables, chairs, filing cabinets, locked storage cabinets, etc.), First Aid Kits; portable transportation for personal use, such as all-terrain vehicles, motorized or manual, or bicycles (mountain bikes); surveillance equipment.

Optional extras further include: additional consumable supplies, including but not limited to food, water, medical supplies, batteries, water filters or point-of-use purification equipment; medication or first aid supplies; bedding and clothing; protective gear specific to predetermined location, by way of example and not limitation, gas masks, impermeable gloves, hat, clothing, to protect from contamination or toxic agents; rope, chainsaws, other tools.

Also, supplemental or specific power supply alternatives is provided, including by way of example and not limitation, a wind power generator, water power generator, solar power generating equipment, power inverters if required, etc. These alternative power supplies provide DC power to the various accessories, such as wireless repeaters, video cameras, microphones, etc.

One application of the kits for modular buildings according to the present invention is to provide emergency shelter kits that would be deliverable to a site or location in advance of or following an emergency situation, such as weather catastrophe, illness outbreak, or is provided in advance of construction of larger buildings. While the present invention modular buildings formed from the kits an components described herein are suitable for long-term use, they are also used for temporary buildings or for limited time specific use buildings. As such, the containers housing the kits for modular buildings preferably are rated and/or have a "storage life" where some items like tool batteries, MREs, water, and other items having some predetermined shelf life, would have to be replenished after a predetermined time, by way of example about 5 years. Replenishment kits are included within the kit or separately and independently ordered periodically based on the number of containers originally ordered and not yet used.

The panels are arranged in a variety of configurations to create a structure, and the present invention provides for rules-based panel design methods and software, that allowed panels to be arranged in any configuration the user desired. The panels are purchased on-line through a menu that allows the manufacturer real-time access at demand to make more efficient the manufacturing process. The user is not necessarily ordering a home, he is merely ordering a kit of panels. Further the user would be able to design custom panels. The manufacturer could have many factory locations manufacturing the standard panels and just a few factories manufacturing the custom panels so that the user is able to achieve the design they want and the manufacturer is able to achieve the volume efficiencies that they need.

The present invention further provides for a scale model or "toy" of the full-size invention. The scale model is used to design and display different structures using miniature panels and other components. For example, architectural firms use the scale model to offer clients a realistic model of a planned home. The model kit is also used to teach or entertain students and children. The scale model kit includes scale-model panels and other associated parts, such as LED lights and fans, and solar panels to power the various appliances in the model.

Further, the manufacturer of these structures could partner with other product manufacturers to market associated or complimentary items in the same panel product offering, including items like, but not limited to: LED lighting solutions, windows, energy recovery ventilators, HVAC or mini-split systems, cabinets or countertops, siding or roofing materials, etc.

Figure 25:
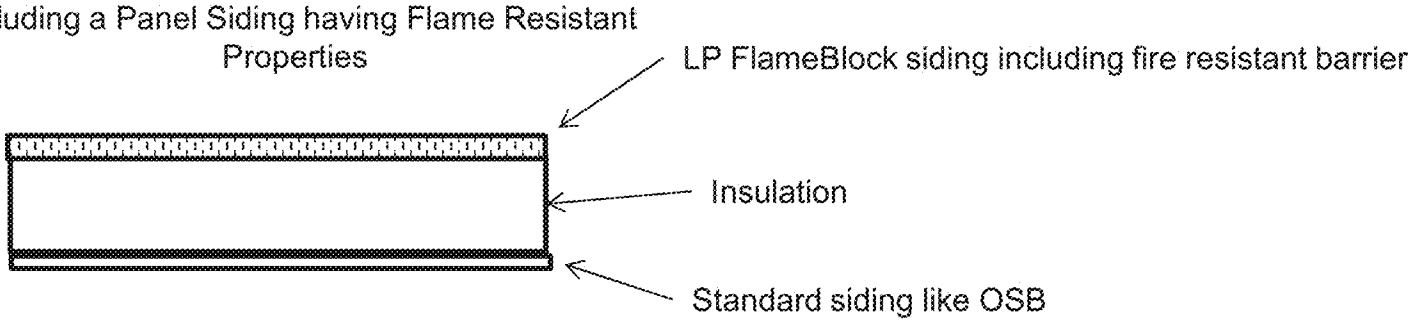
FIG. 25 illustrates the structural siding materials of the panels employ. Complimentary technologies useful in building envelope construction such as a flame-resistant coating such as that found on structural grade sheathing in Louisiana Pacific's FlameBlock fire-rated OSB sheathing are used to provide fire resistance to the building panel.

The panels employ structural siding materials that are complementary technologies (FIG. 25) in building envelope construction such as a flame-resistant coating such as that found on structural grade sheathing in Louisiana Pacific's FlameBlock fire-rated OSB sheathing to provide fire resistance to the building panel.

Vertically oriented straps of varying width but of sufficient tensile strength are integrated into the assembly of the prefabricated panel (FIGS. 26A-B) between the skin of the panel and the insulation so as to allow additional retention strength for the entirely assembled structure. Straps of this type may be known as "hurricane straps or ties" or similar offered by Simpson Strong-Tie or other such companies. Alternatively, the straps include carbon fiber, Kevlar or other synthetic or composite types or material whose increased strength in tension compliments the strength of the panel itself and aids in improving the overall strength of the structure.

Cam-Lock Bracket System

The present-invention uses cam-locks, which are well-known in the prior art. An exemplary prior art cam-lock system is shown in FIGS. 27A-D. The prior art cam-lock system includes a locking point (male) and a strike (female). An anchor flange is embedded in the foam core for securing the locking point and the strike in the foam core. The prior art anchor flange is in the form of a vee. The prior art cam-lock is designed and configured for operation by a hex key wrench or similar. The cam has a hex head incorporated into it and the hex key wrench is inserted into the hex head to turn the lock. Some prior art cam-locks include an access shaft that extends to the surface of the panel. The access shaft prevents insulation from entering the hex head and interfering with the operation of the cam-lock.

Figure 28A:
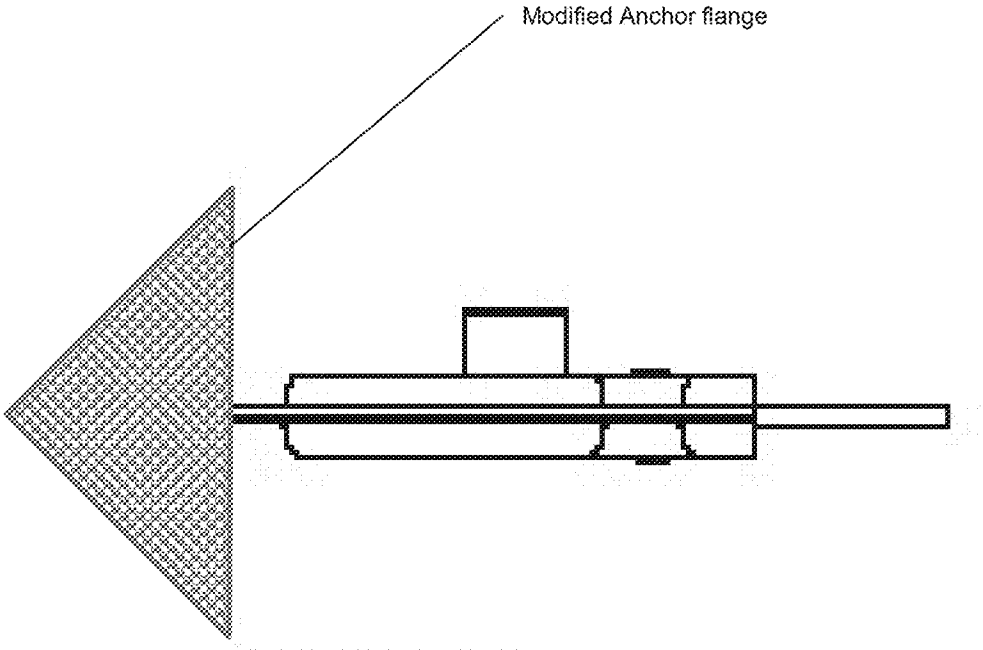
FIGS. 28A-B illustrate an anchor flange according to the present invention.
Figure 28B:
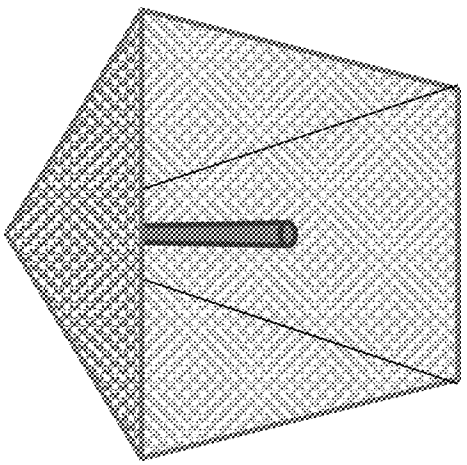

In the present invention, the anchor flange is designed and configured to ensure that the cam-lock cannot be torn from the panel when under a specified load. The anchor flange is a pyramidal shape to add more structural strength to the anchor flange (FIGS. 28A and 28B). Preferably the flange is perforated to allow air to escape during manufacturing.

Figure 29A:
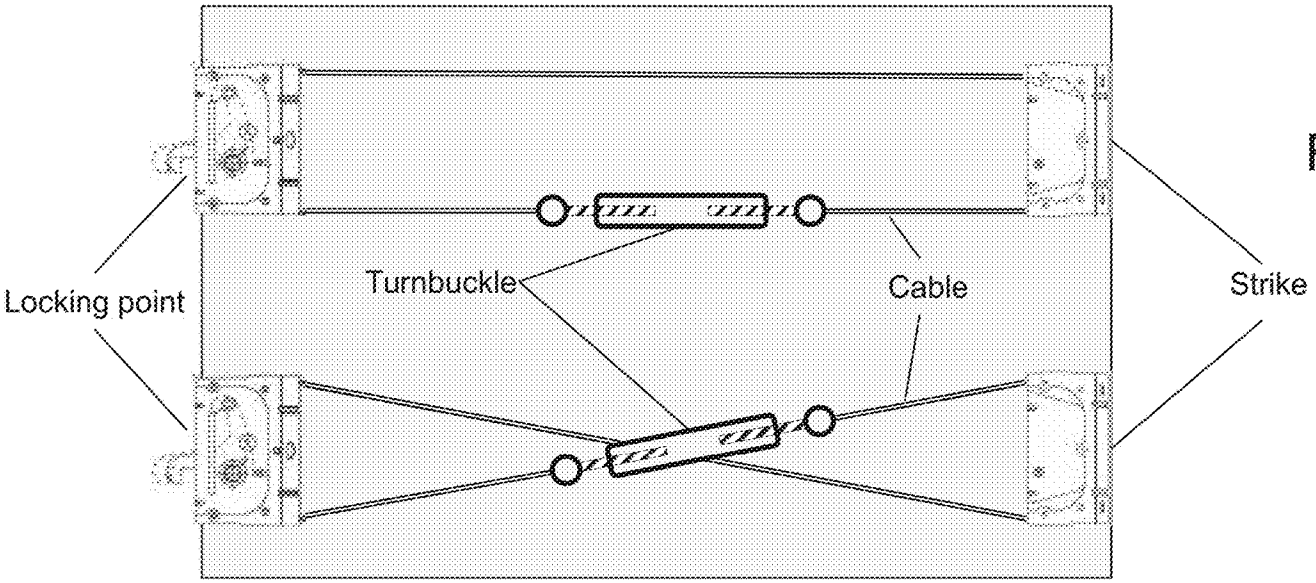
FIGS. 29A-B illustrate a system for reinforcing cam-locks with cable according to the present invention.
Figure 29B:
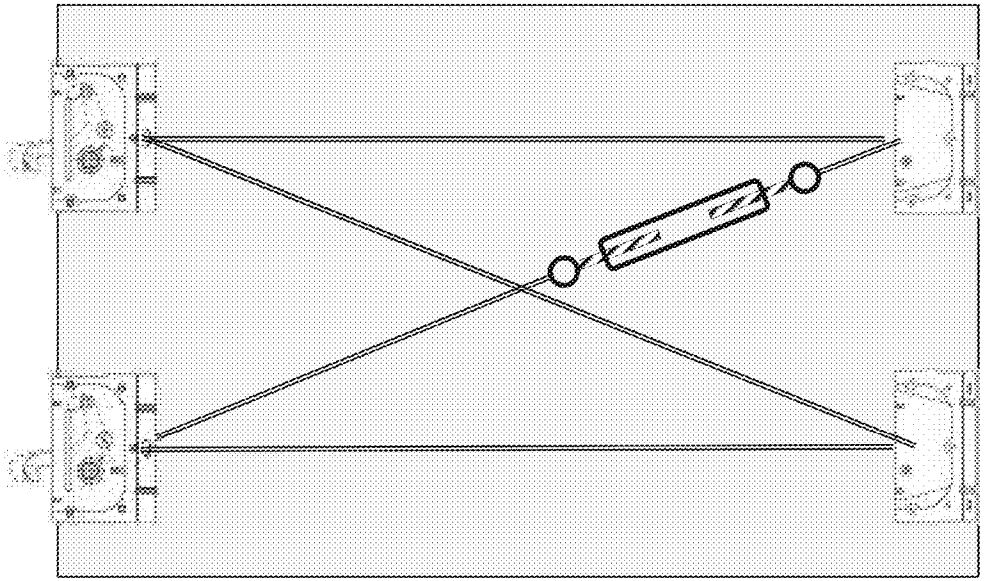
Figure 30A:
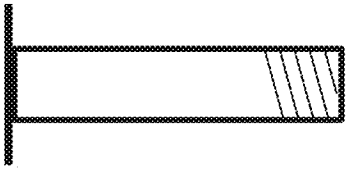
FIGS. 30A-B illustrate a camlock access shaft insert according to the present invention.
Figure 30B:
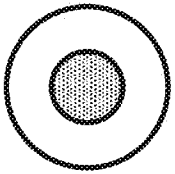
Figure 31:
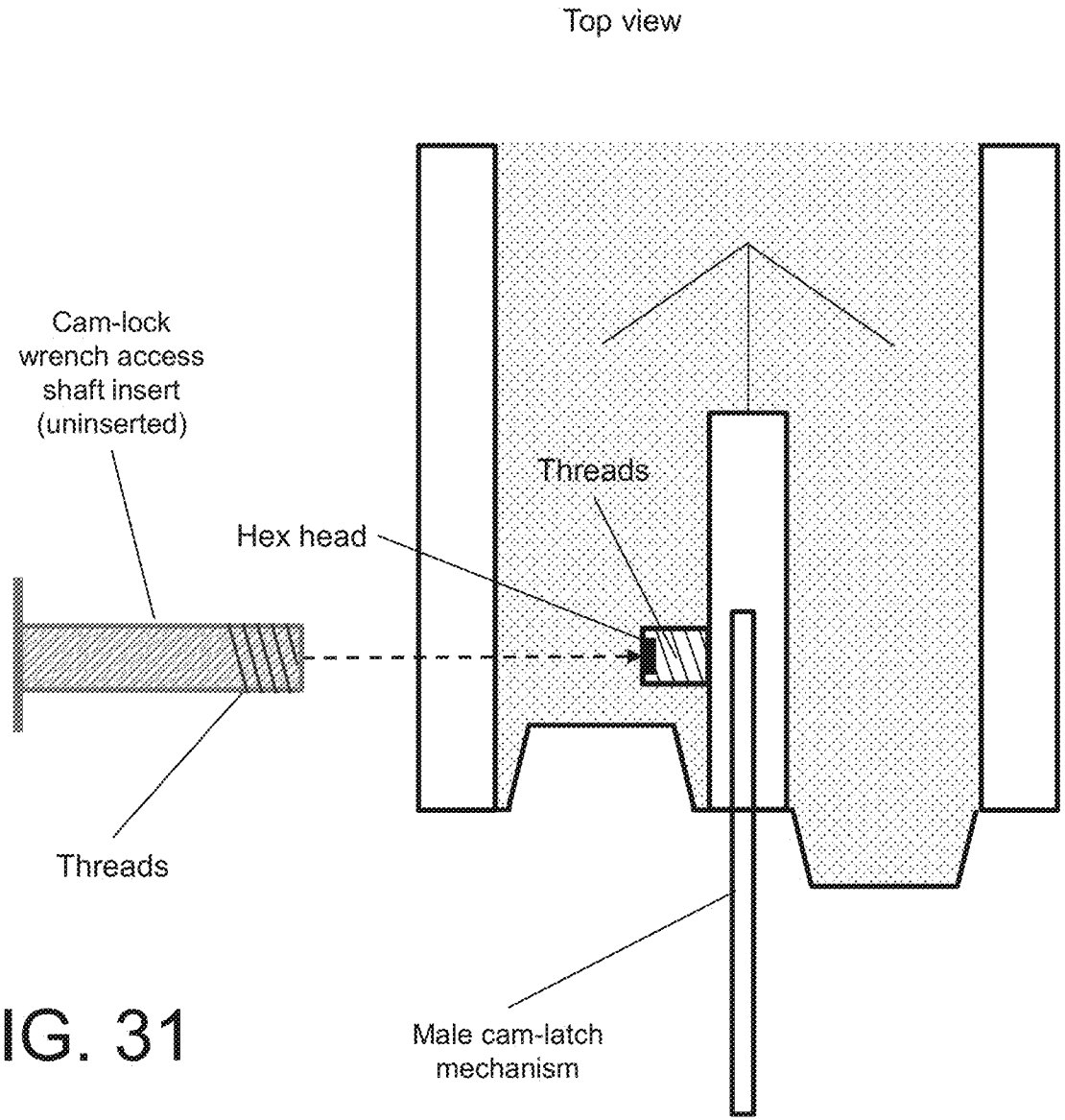
FIG. 31 illustrates an unassembled view of the cam-lock access shaft insert of FIGS. 30A-B prior to assembly with a cam-lock.
Figure 32:
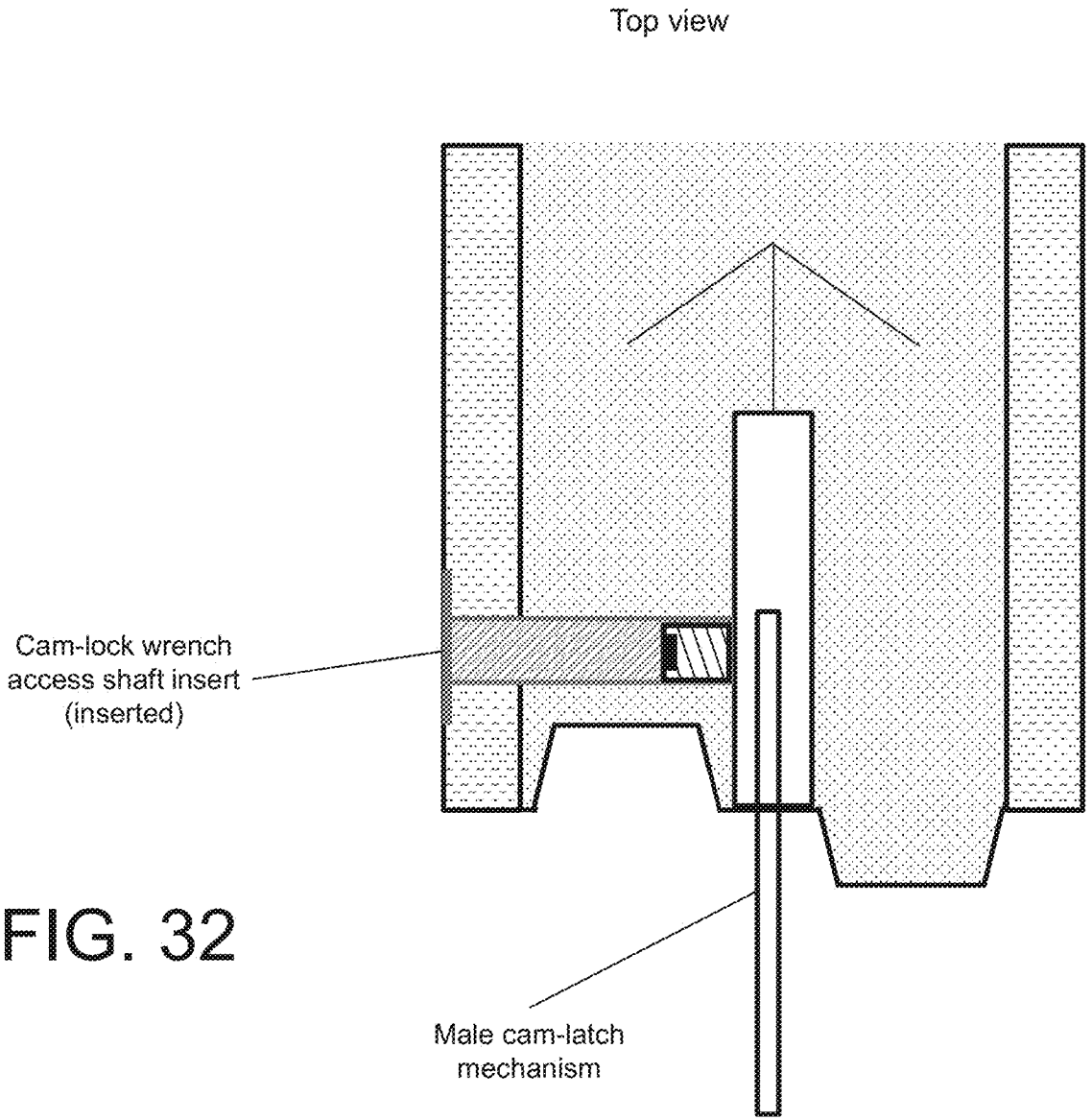
FIG. 32 illustrates an assembled view of the cam-lock access shaft insert of FIGS. 30A-B after assembly with a cam-lock.
Figure 35A:
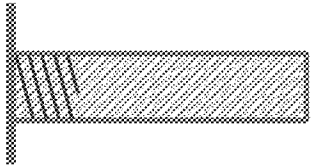
FIGS. 35A-35B illustrates another cam-lock access shaft according to the present invention.
Figure 35B:
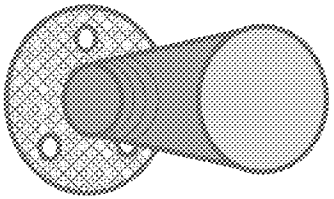
Figure 36:
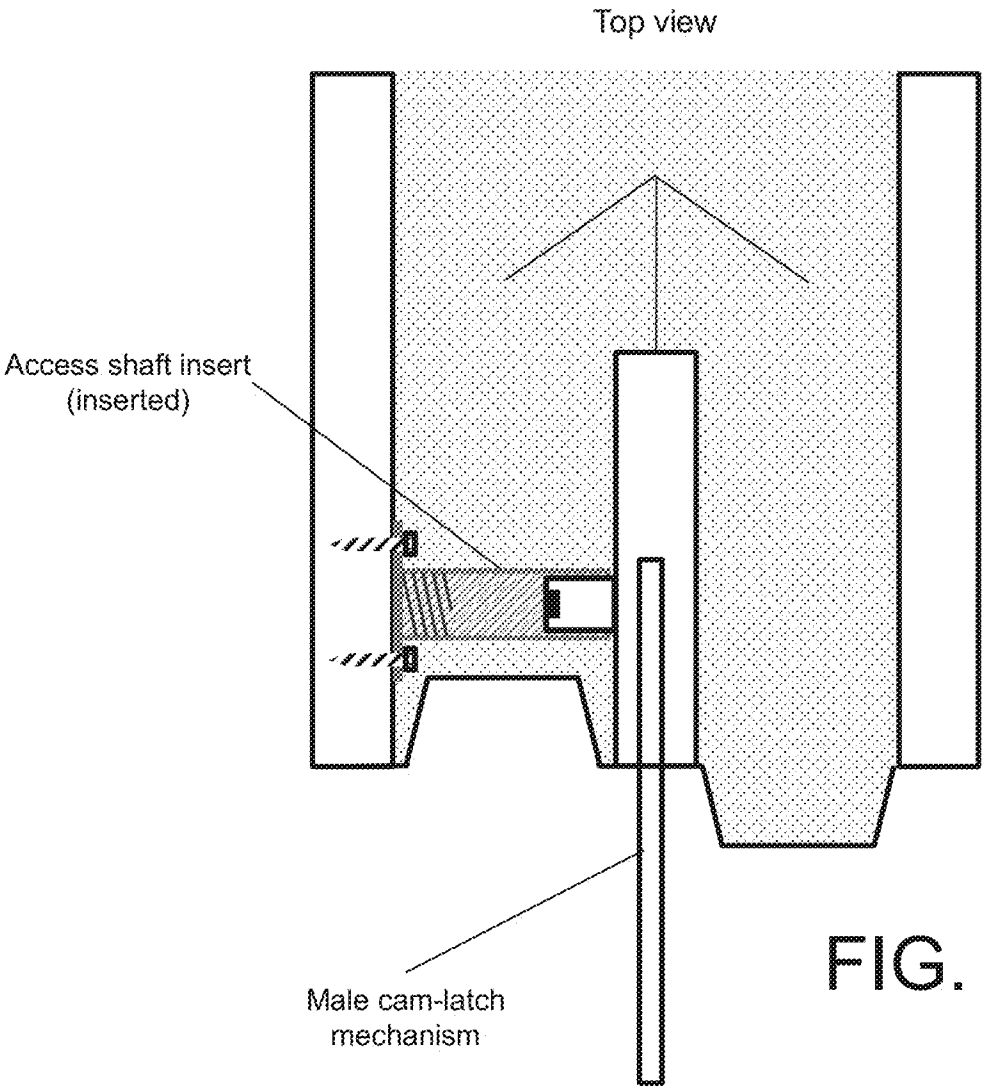
FIG. 36 illustrates an assembled view of the cam-lock access shaft insert of FIGS. 35A-B after assembly with a cam-lock.
Figure 37:
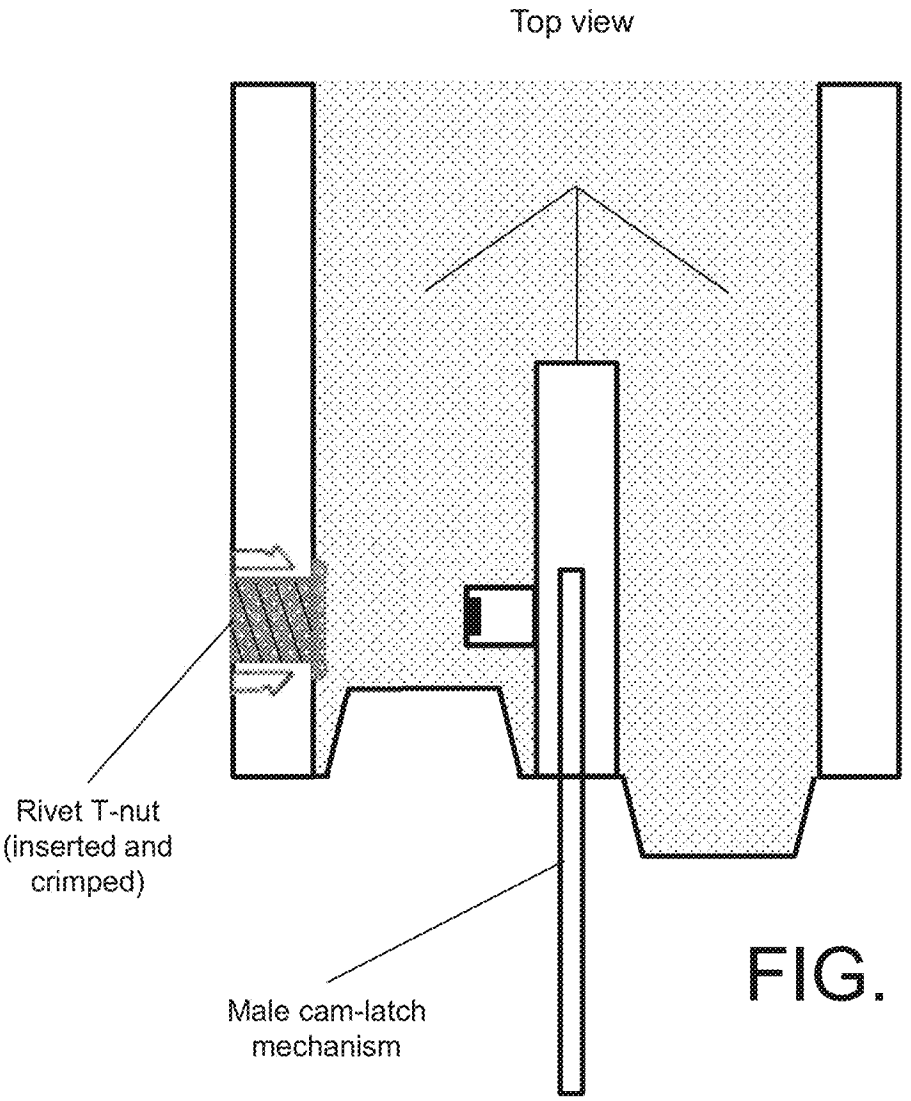
FIG. 37 illustrates the rivet T-nut of FIGS. 34A-C assembled in a cam-lock according to the present invention.

Additionally or alternatively, opposing cam-lock components can be connected by a high-tensile device, such as a high-tensile steel cables or zip-ties to provide more load resistance. In an example embodiment, a high-tensile cable is looped through the cam-lock components and tensioned with a turnbuckle (FIG. 29A). In another example, multiple cam-lock components are connected by a single cable (FIG. 29B). By weaving the cable diagonally between cam-lock components, the cable forms triangular structures which provide additional bracing, especially bracing against shear forces or blast forces, to the panel and the overall structure. When the high tensile steel cable is combined with reinforced strength cam-locks the structure effectively becomes "wrapped" entirely by high tensile strength steel (or similar carbon fiber, etc.) to further strengthen a structure.

In the present invention, a cam-lock wrench access shaft insert is provided to extend the access shaft past the surface of the panel. Generally, the access shaft insert is a cylinder designed to receive a support rod, which is described later. Preferably, the access shaft insert is flush with or recessed in the exterior surface of the panel, such that the panels slide across one another during stacking and unstacking.

As shown in FIGS. 30-40, the access shaft insert can be of different designs and configurations. In one example embodiment (FIGS. 30-32), the shaft insert is threaded and threads over the cam-lock hex head, which is matingly threaded on its exterior. In another example embodiment (FIGS. 33, 35, 36), the access shaft insert is a T-nut that inserts into the panel but only slides over the hex head. In this embodiment, the T-nut does not thread onto the hex head.

In another embodiment, the T-nut is a rivet T-nut (FIGS. 34A-C and FIG. 37). The rivet T-nut provides a sturdy insert into which a support rod can be threaded. The rivet T-nut is installed on the panel skin prior to manufacture of the pane.

Figure 39:
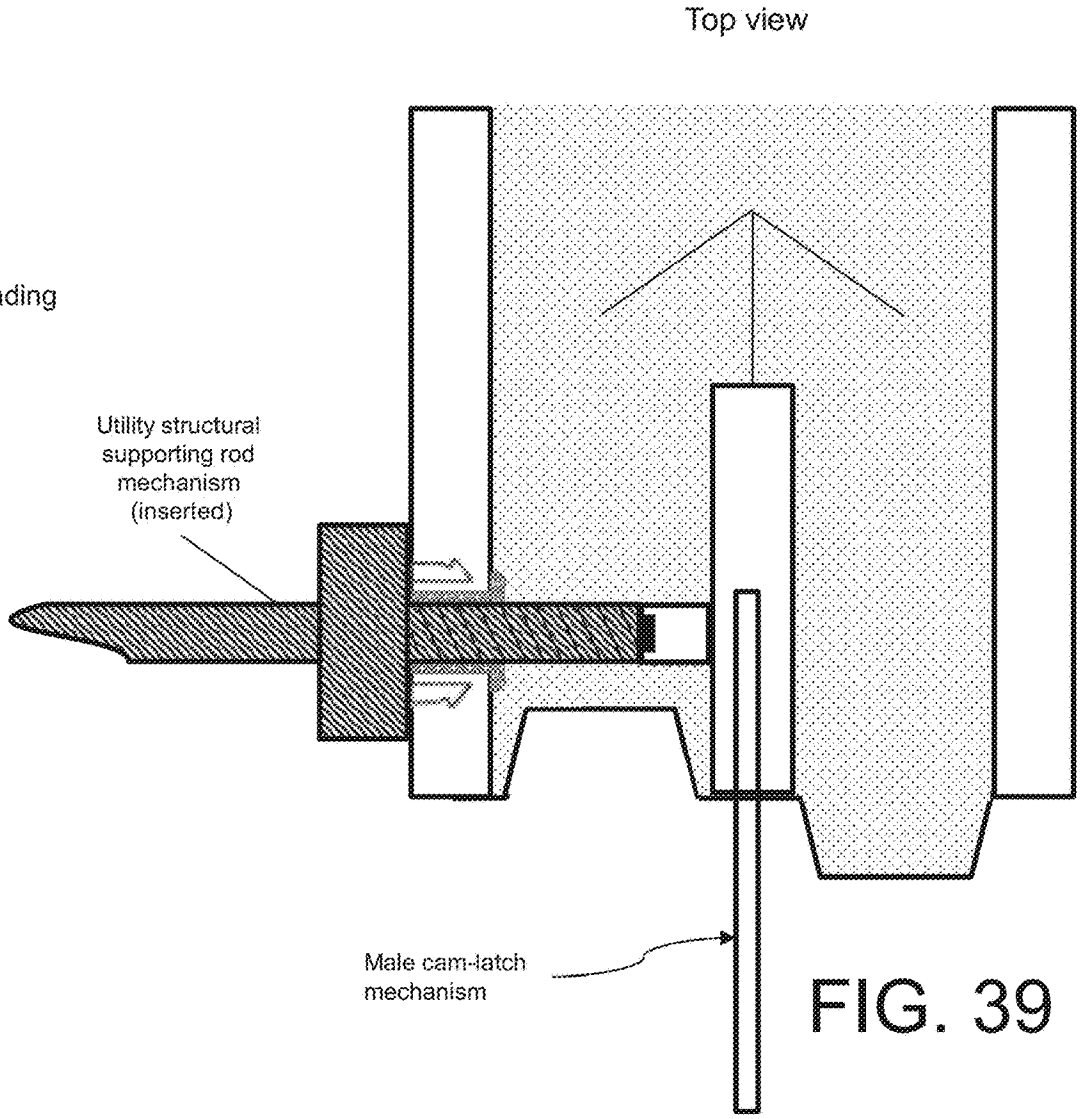
FIG. 39 illustrates a bracket mounted in a cam-lock according to the present invention.
Figure 38:
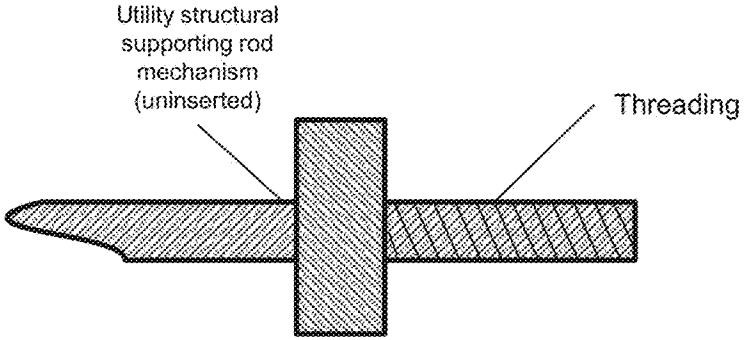
FIG. 38 illustrate a bracket according to the present invention.
Figure 40:
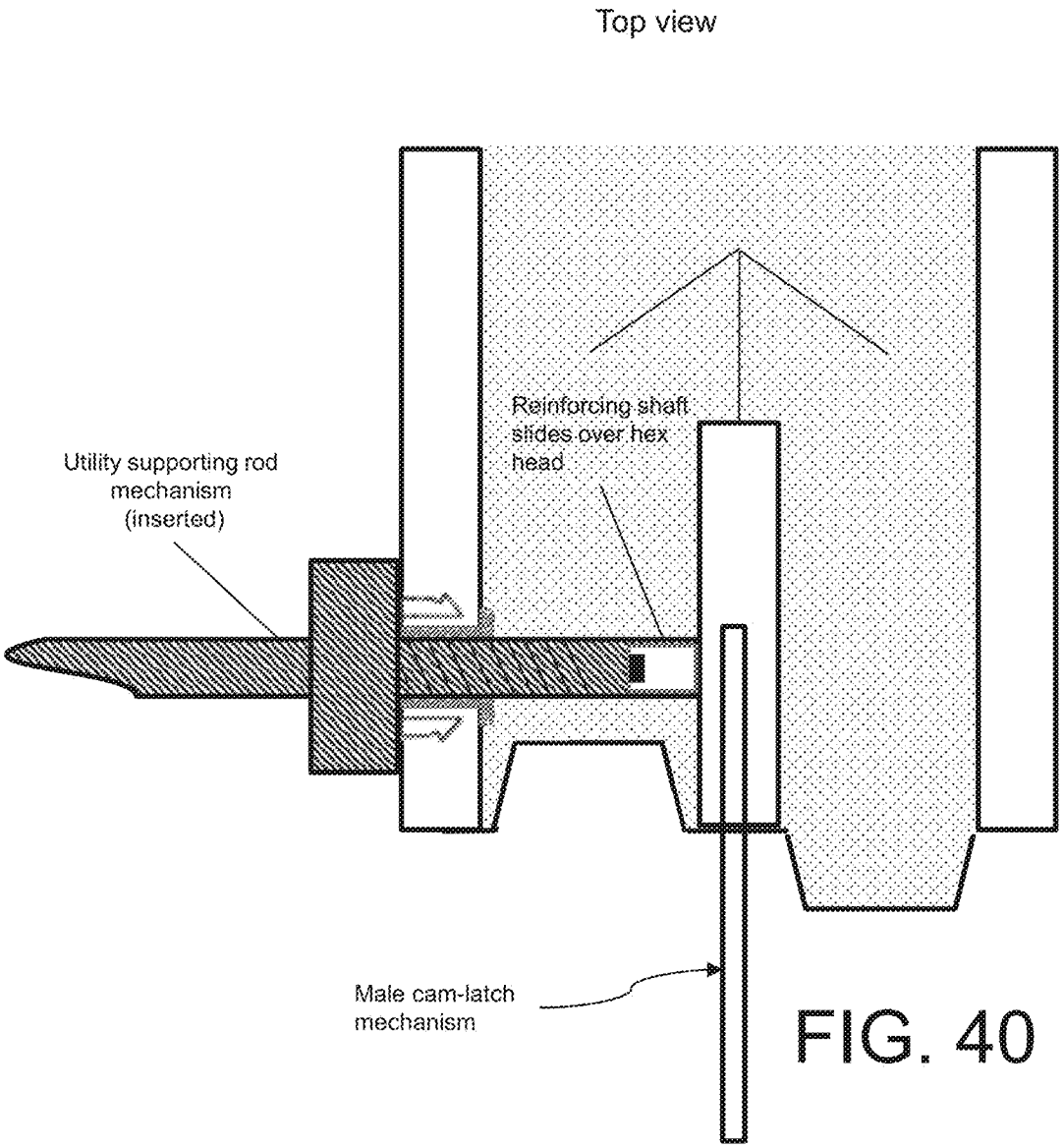
FIG. 40 illustrates another embodiment of a bracket mounted in a cam-lock according to the present invention.

The access shaft insert is furthermore designed and configured to receive brackets, as shown in FIGS. 38-40.

The cam-lock shaft bracket includes a structurally reinforcing shaft that inserts into the access shaft insert. In one embodiment, the reinforcing shaft is threaded on the exterior and thus screws into a matingly threaded access shaft insert (FIGS. 38 and 39). Additionally or alternatively, the reinforcing shaft slides over the cam-lock hex head (FIG. 40) to provide more support and prevent rotation of the bracket when weight is applied to the bracket.

Thus, some embodiment of the cam-lock components, both the locking point and/or the strike, include an attachment point for reinforcement of the access shaft insert or the reinforcing shaft.

Figures 41A, 41B, 41C:
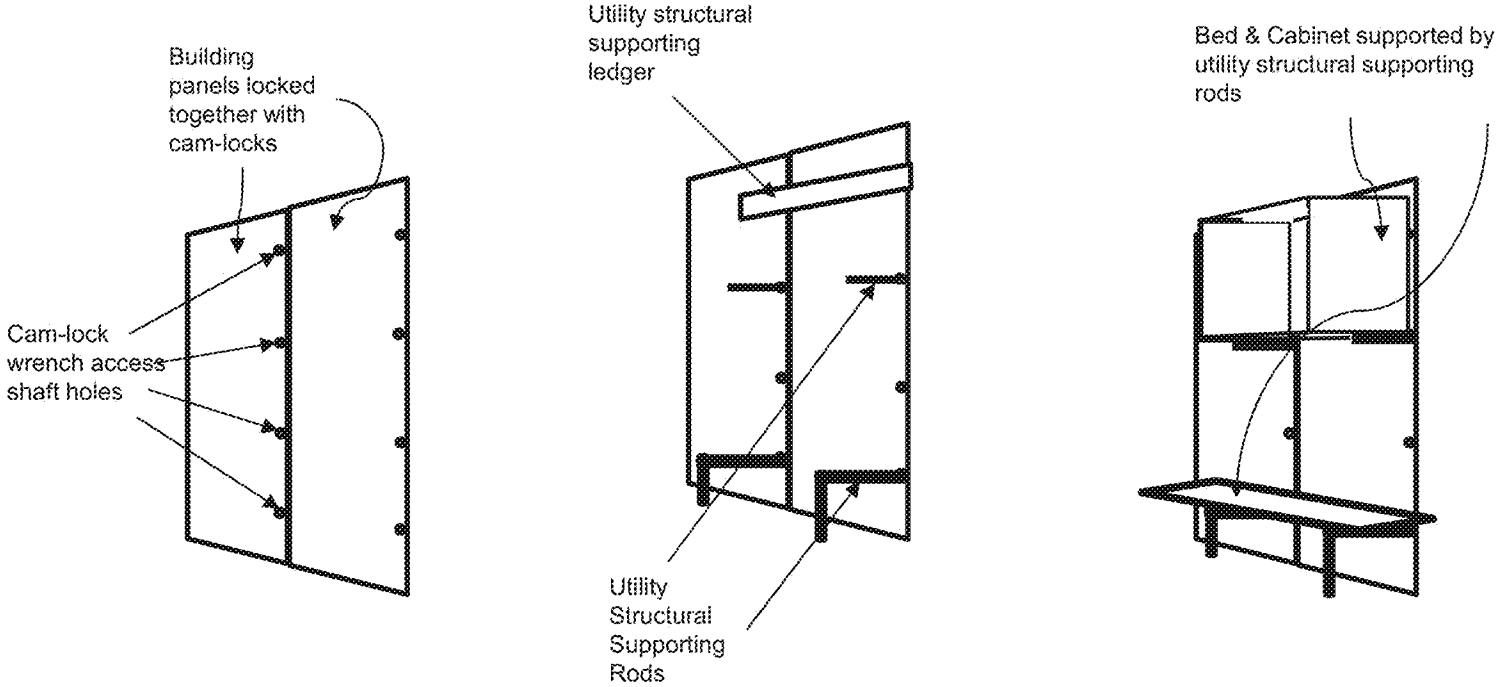
FIGS. 41A-C illustrate steps for assembling structures using the cam-lock/bracket system according to the present invention.

The brackets are inserted into the cam-locks, then structures such as furniture, beds, shelves, coat/equipment racks and the like are secured to the brackets (FIGS. 41A-C). Thus, the bracket types include a shelf bracket, a coat rack, a bed support, a desk support, a bench support, a chair support, cabinets, equipment hangers and even reinforcing structural components. The cam-locks are also used to secure additional structural bracing to add to the overall strength of the structure. The cam-lock access hole is thus designed, configured, and reinforced to support pegs or brackets and the weight they support.

In another embodiment, the cam system uses shape metals, such as nitinol. The shape of the metal is changed through a number of means, including technical, temperature, and electrical.

Up-Armored Buildings

Figure 43:
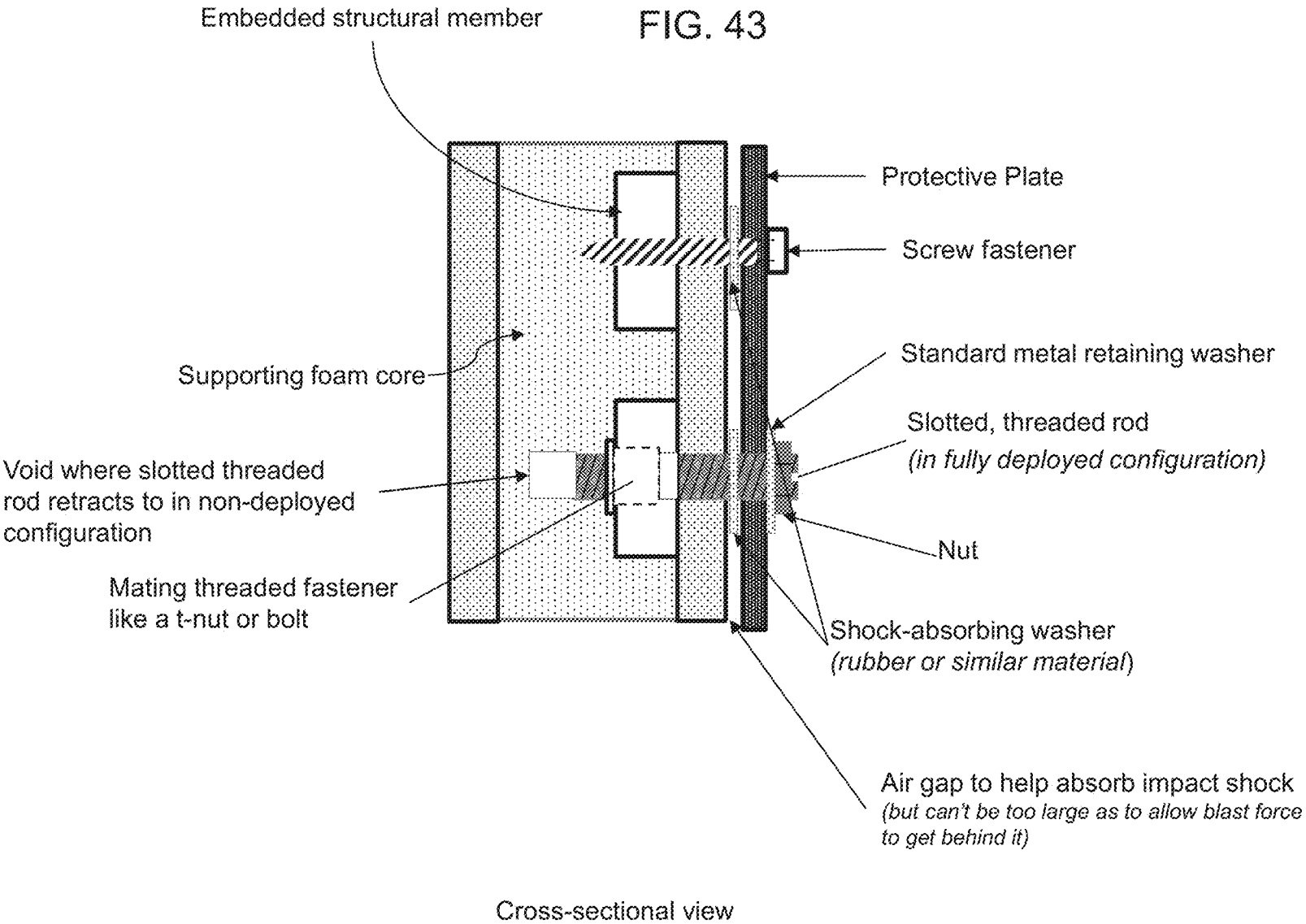
FIG. 43 is a sectional view illustrating two mechanisms for fastening protective plates to a panel for up-armoring a building according to the present invention.

The present invention provides for up-armoring buildings. As shown in FIGS. 42-44, supporting structures are embedded inside the panels to support armor affixed to the exterior of a panel. FIGS. 42A-C illustrate embedded structural members inside of insulated building panels in different locations and orientations as part of the system for system for up-armoring a building. The structural members are embedded vertically, horizontally, or diagonally. The structural members are supported by the foam core, making them structurally stronger than if not in the foam. In one embodiment, the foam core includes polyurethane. The foam core does not include polystyrene. The foam core does not include formaldehyde.

As shown in FIG. 43, fasteners such as washers, screws, bolts, nails, all-thread with nut and the like are used to affix protective plates to a panel by fastening them to an embedded structural member. FIG. 43 shows a lag screw and an all-thread slotted bolt being used as fasteners. The advantage of an all-thread slotted bolt is that it can be mounted recessed into the panel when not in use, and thus not hinder the stacking of panels and not snag or injure passersby. The all-thread slotted bolt is shown in FIG. 43 in use with a mating threaded fastener affixed to the embedded structural member.

FIGS. 44A-C are views of a wall without the panel skin showing the insulated structural panels with embedded structural members. FIG. 44D shows a wall with armor attached. The armor can be metal, ballistic cloth, ceramic armor and the like. Furthermore, combinations of armor types can be used. For example, ballistic cloth can be used to form pouches that support metal or ceramic armor.

Prior art cam-locks generally fail at the strike pin, which generally can support about 400 lbs. of load. In the present invention, the strike pin is rated to about 5,000 lbs. of load to withstand explosions and projectiles.

Personal Assistant

The present invention further provides for a voice-controlled personal assistant composed of microphones plugged into the data access ports throughout the structure in communication with a central computer system, the central computer system analyzing speech captured through the microphones and taking appropriate action based on the analysis.

Central Computer System

Figure 46:
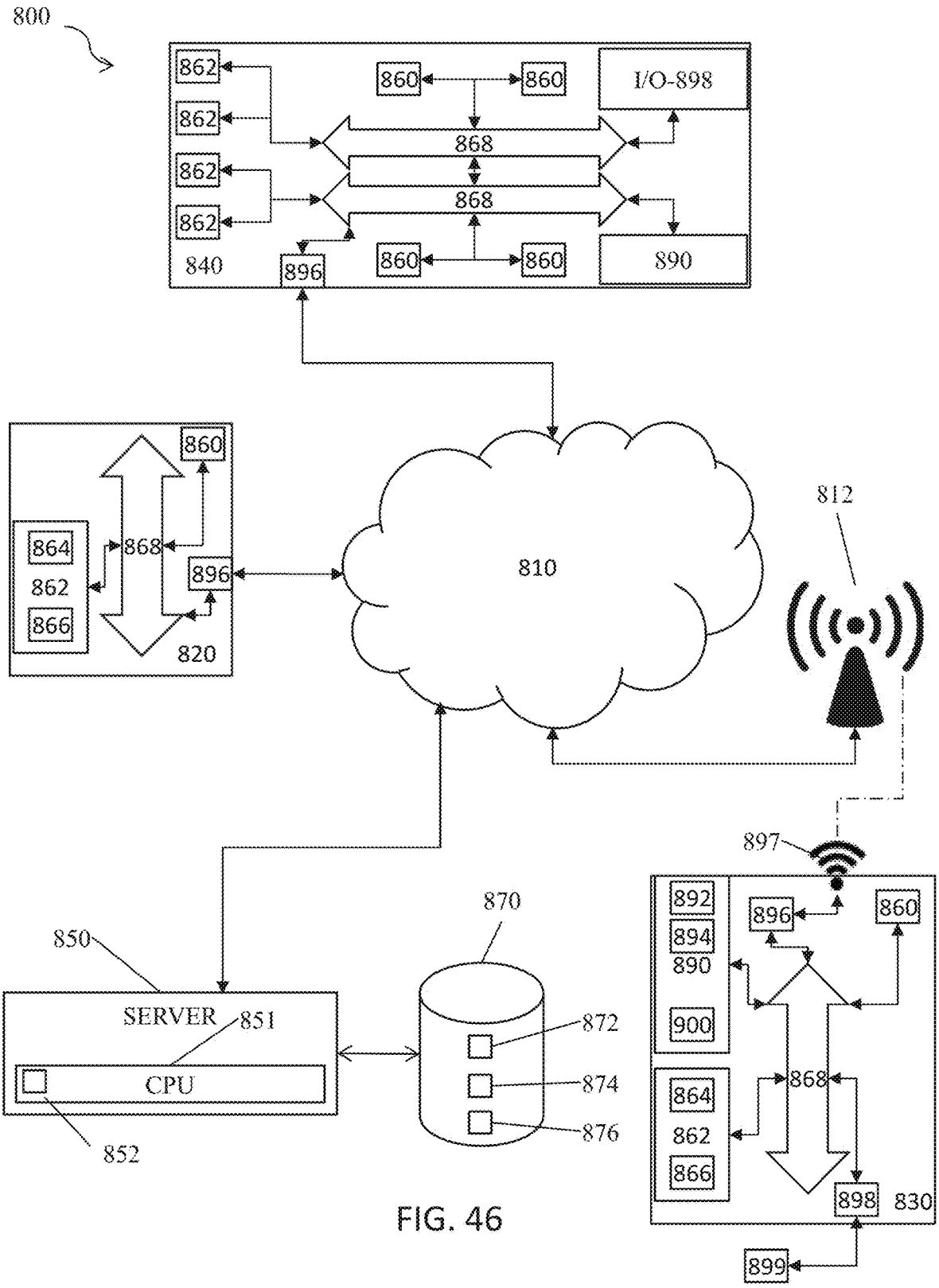
FIG. 46 illustrates a schematic diagram of a central computer system having a network, a plurality of computing devices, a server, and a database.

FIG. 46 is a schematic diagram of an embodiment of the invention illustrating a central computer system, generally described as 800, having a network 810, a plurality of computing devices 820, 830, 840, a server 850, and a database 870.

The server 850 is constructed, configured, and coupled to enable communication over a network 810 with a plurality of computing devices 820, 830, 840. The server 850 includes a processing unit 851 with an operating system 852. The operating system 852 enables the server 850 to communicate through network 810 with the remote, distributed user devices. Database 870 may house an operating system 872, memory 874, and programs 876.

In one embodiment of the invention, the system 800 includes a cloud-based network 810 for distributed communication via a wireless communication antenna 812 and processing by at least one mobile communication computing device 830. In another embodiment of the invention, the system 800 is a virtualized computing system capable of executing any or all aspects of software and/or application components presented herein on the computing devices 820, 830, 840. In certain aspects, the central computer system 800 may be implemented using hardware or a combination of software and hardware, either in a dedicated computing device, or integrated into another entity, or distributed across multiple entities or computing devices.

By way of example, and not limitation, the computing devices 820, 830, 840 are intended to represent various forms of digital computers 820, 840, 850 and mobile devices 830, such as a server, blade server, mainframe, mobile phone, personal digital assistant (PDA), smartphone, desktop computer, netbook computer, tablet computer, workstation, laptop, and other similar computing devices. The components shown here, their connections and relationships, and their functions, are meant to be exemplary only, and are not meant to limit implementations of the invention described and/or claimed in this document In one embodiment, the computing device 820 includes components such as a processor 860, a system memory 862 having a random access memory (RAM) 864 and a read-only memory (ROM) 866, and a system bus 868 that couples the memory 862 to the processor 860. In another embodiment, the computing device 830 may additionally include components such as a storage device 890 for storing the operating system 892 and one or more application programs 894, a network interface unit 896, and/or an input/output controller 898. Each of the components may be coupled to each other through at least one bus 868. The input/output controller 898 may receive and process input from, or provide output to, a number of other devices 899, including, but not limited to, alphanumeric input devices, mice, electronic styluses, display units, touch screens, signal generation devices (e.g., speakers), or printers.

By way of example, and not limitation, the processor 860 may be a general-purpose microprocessor (e.g., a central processing unit (CPU)), a graphics processing unit (GPU), a microcontroller, a Digital Signal Processor (DSP), an Application Specific Integrated Circuit (ASIC), a Field Programmable Gate Array (FPGA), a Programmable Logic Device (PLD), a controller, a state machine, gated or transistor logic, discrete hardware components, or any other suitable entity or combinations thereof that can perform calculations, process instructions for execution, and/or other manipulations of information.

In another implementation, shown as 840 in FIG. 46, multiple processors 860 and/or multiple buses 868 may be used, as appropriate, along with multiple memories 862 of multiple types (e.g., a combination of a DSP and a microprocessor, a plurality of microprocessors, one or more microprocessors in conjunction with a DSP core).

Also, multiple computing devices may be connected, with each device providing portions of the necessary operations (e.g., a server bank, a group of blade servers, or a multiprocessor system). Alternatively, some steps or methods may be performed by circuitry that is specific to a given function.

According to various embodiments, the central computer system 800 may operate in a networked environment using logical connections to local and/or remote computing devices 820, 830, 840, 850 through a network 810. A computing device 830 may connect to a network 810 through a network interface unit 896 connected to a bus 868. Computing devices may communicate communication media through wired networks, direct-wired connections or wirelessly, such as acoustic, RF, or infrared, through an antenna 897 in communication with the network antenna 812 and the network interface unit 896, which may include digital signal processing circuitry when necessary. The network interface unit 896 may provide for communications under various modes or protocols.

In one or more exemplary aspects, the instructions may be implemented in hardware, software, firmware, or any combinations thereof. A computer readable medium may provide volatile or non-volatile storage for one or more sets of instructions, such as operating systems, data structures, program modules, applications, or other data embodying any one or more of the methodologies or functions described herein. The computer readable medium may include the memory 862, the processor 860, and/or the storage media 890 and may be a single medium or multiple media (e.g., a centralized or distributed central computer system) that store the one or more sets of instructions 900. Non-transitory computer readable media includes all computer readable media, with the sole exception being a transitory, propagating signal per se. The instructions 900 may further be transmitted or received over the network 810 via the network interface unit 896 as communication media, which may include a modulated data signal such as a carrier wave or other transport mechanism and includes any delivery media. The term "modulated data signal" means a signal that has one or more of its characteristics changed or set in a manner as to encode information in the signal.

Storage devices 890 and memory 862 include, but are not limited to, volatile and non-volatile media such as cache, RAM, ROM, EPROM, EEPROM, FLASH memory, or other solid state memory technology; discs (e.g., digital versatile discs (DVD), HD-DVD, BLU-RAY, compact disc (CD), or CD-ROM) or other optical storage; magnetic cassettes, magnetic tape, magnetic disk storage, floppy disks, or other magnetic storage devices; or any other medium that can be used to store the computer readable instructions and which can be accessed by the central computer system 800.

It is also contemplated that the central computer system 800 may not include all of the components shown in FIG. 46, may include other components that are not explicitly shown in FIG. 46, or may utilize an architecture completely different than that shown in FIG. 46. The various illustrative logical blocks, modules, elements, circuits, and algorithms described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application (e.g., arranged in a different order or partitioned in a different way), but such implementation decisions should not be interpreted as causing a departure from the scope of the present invention.

Modular Seamless Corner Component

Figure 47:
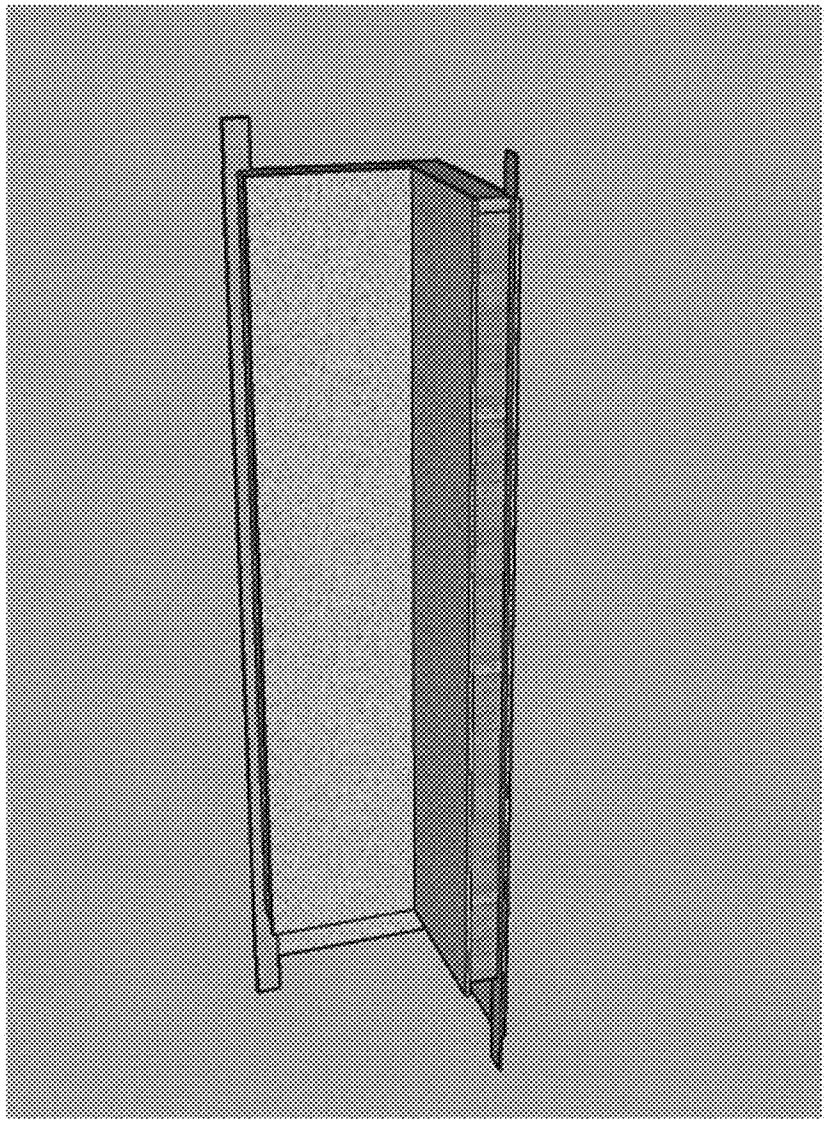
FIG. 47 illustrates a perspective view of a modular seamless corner component.
Figure 48C:
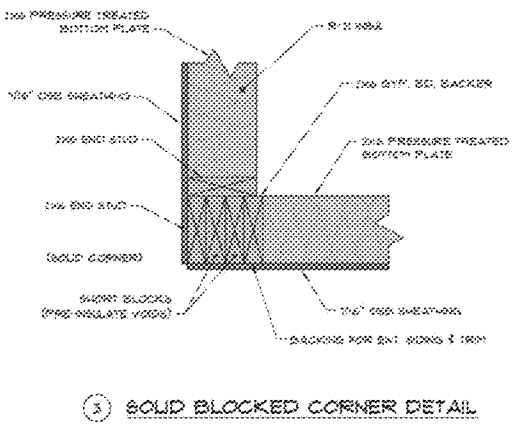
FIGS. 48A-I illustrate nine different prior art ways to frame a corner.
Figure 48B:
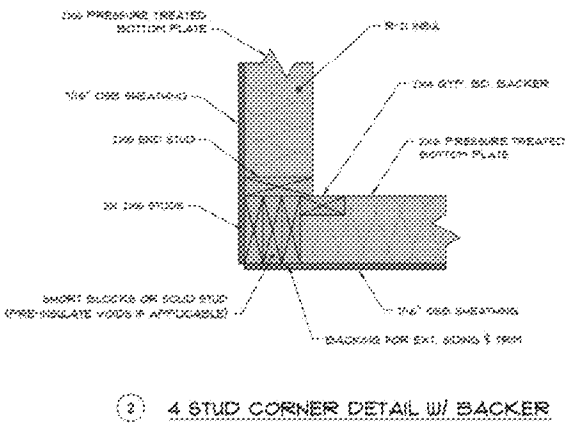
Figure 48A:
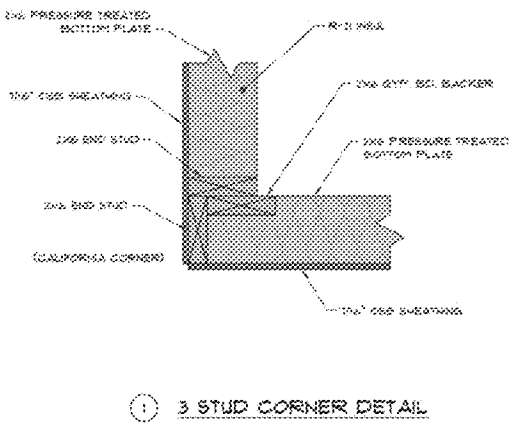
Figure 48D:
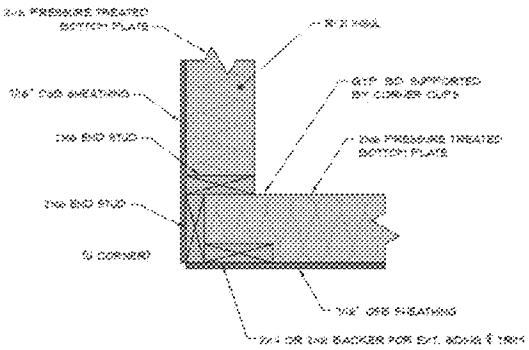
Figure 48E:
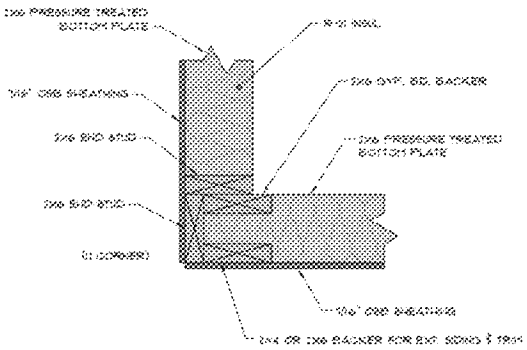
Figure 48F:
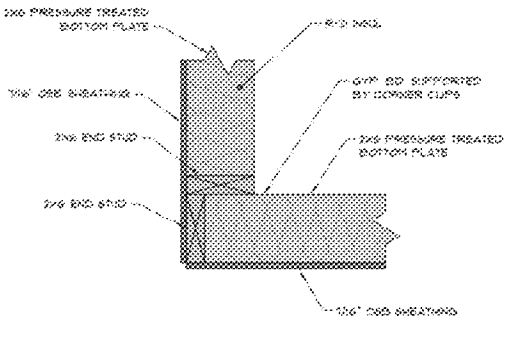
Figure 48I:
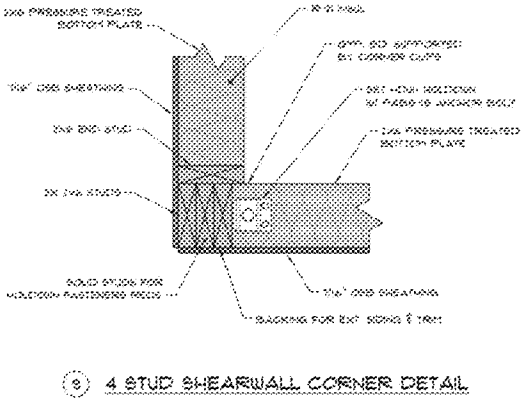
Figure 48H:
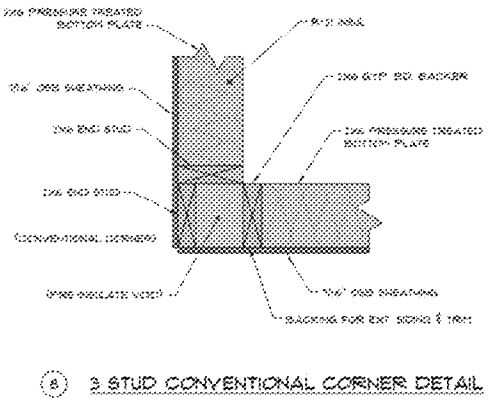
Figure 48G:
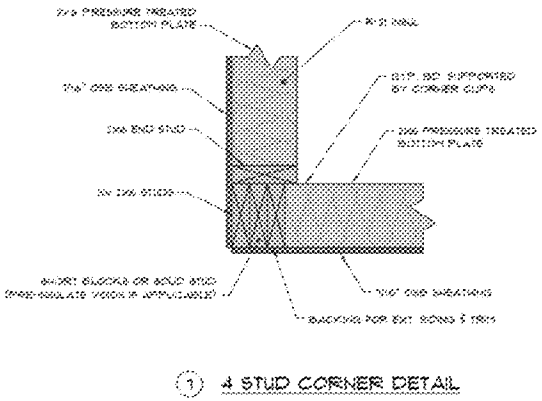

In an alternative embodiment, as shown in FIG. 47, a modular seamless corner component is used to provide a continuously insulated corner for a structure that is otherwise built using traditional wooden or steel framing methods. The modular seamless corner component for providing a continuously insulated corner to a structure includes an outer sheath, an inner sheath, and insulation. This component may also contain additional assisting structural members such as rigid strapping (e.g. hurricane ties) wherein the inner sheath, insulation, and outer sheath each include a top edge, a bottom edge, and two outside edges, wherein each of the inner sheath, the outer sheath, and the insulation is substantially L-shaped, including a bend defining a seamless corner wherein the inner seamless corner of the inner sheath is nested within the seamless corner of the insulation and the seamless corner of the insulation is nested within the seamless corner of the outer sheath, wherein the inner sheath is attached to the insulation and the insulation is attached to the outer sheath such that the top edges of the inner sheath, the insulation, and the outer sheath are flat and coplanar. In one embodiment, the outer sheath includes a lower portion extending below the bottom edges of the inner sheath and the insulation, the bottom edges of the inner sheath and the insulation and the lower portion of the outer sheath defining a lip, wherein the rigid straps are positioned between the outer sheath and the insulation, the rigid straps extending beyond both the top and the bottom of the outer sheath.

In an alternative embodiment, the present invention includes a method for providing a corner to a structure, the method including providing a modular seamless corner component including an L-shaped inner sheath, insulation, and outer sheath, wherein the outer sheath includes a lower portion extending below the inner sheath and insulation, attaching the lower portion of the modular seamless corner component to a base plate, placing and attaching two secondary top plates on top of the modular seamless corner component such that the two secondary top plates form an L-shape, cover the modular seamless corner component, and extend beyond the modular seamless corner component, wherein the modular seamless corner component includes two ends, and placing a sidewall adjacent to each end of the modular seamless corner component, wherein each of the two secondary top plates also covers and attaches to a top of a sidewall.

While building codes cover the size of studs in a wall, spacing of studs based on wall height, the frequency and size of nails for attaching those studs, and many other criteria, there are no such standards of construction for a framed corner. As a result, there exist many different ways to construct a framed corner, with varying tradeoffs between strength and insulation.

As shown in prior art FIGS. 48A-I, there are at least nine different prior art ways to frame a corner, with each method accepting a different compromise between safety and energy efficiency. In the prior art, safety and energy efficiency are on a spectrum such that focusing more on one entails a sacrifice of the other. Advantageously, the modular seamless corner component eliminates the need to calculate the trade-off by allowing for both high safety and high energy efficiency. The continuous insulation and structure of the modular seamless corner provides for a stronger corner because there are no seams to magnify stress and provides for a high energy efficiency because there is no thermal bridging through the insulation for most of the corner panel component.

Figure 49B:
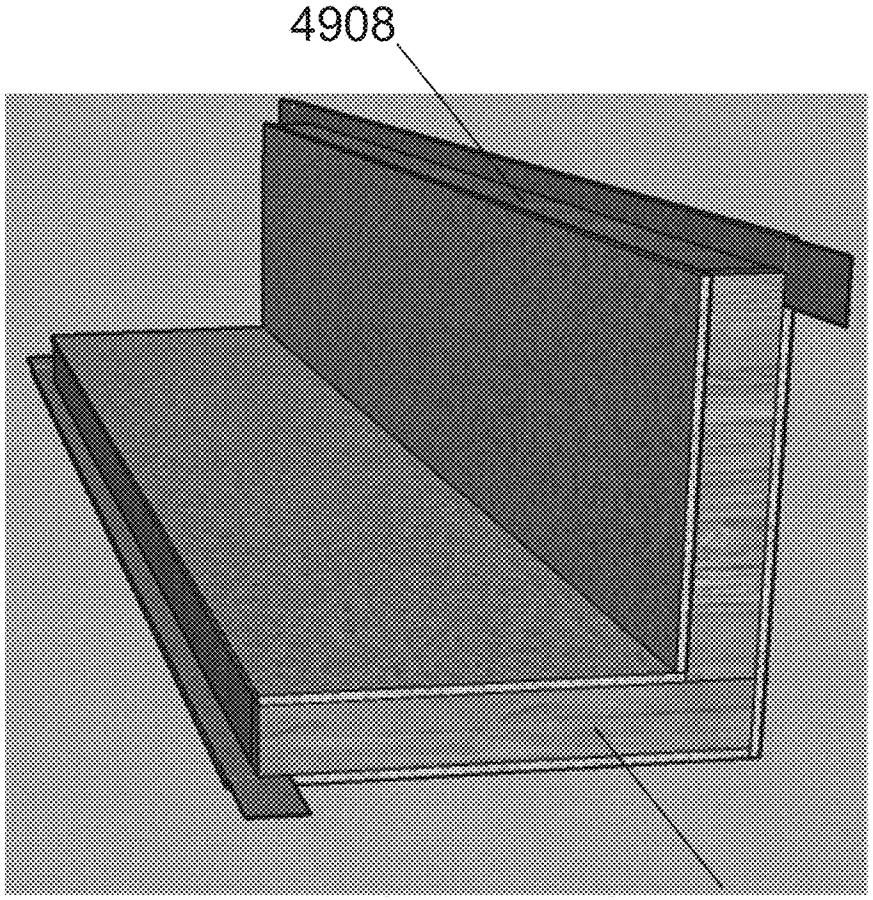
FIG. 49B shows two embedded top plates covering the top edge of the insulation.
Figure 49A:
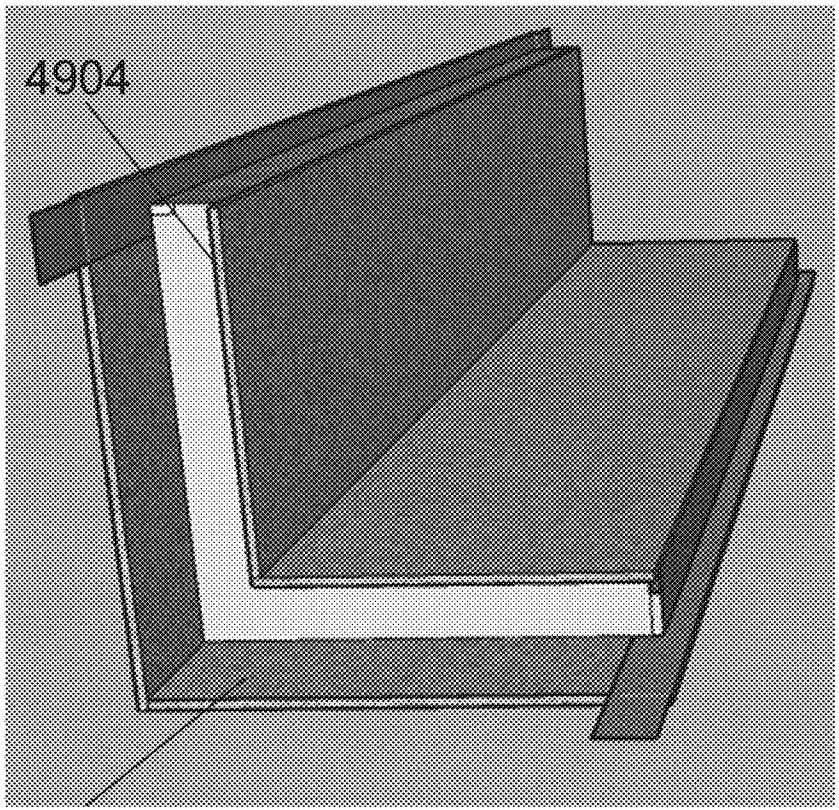
FIGS. 49A&B illustrate respectively bottom and top views of the modular seamless corner component.

In traditional structures, corners are the places at which failure occurs because corners are often not reinforced, and because corners naturally amplify stress. When the wind pushes on the side wall of a simple house, the corners will bear much of the force load applied by the wind. By making the corner component seamless through a molding and forming process, as shown in FIGS. 49A-B, the corner instead becomes one of the strongest places in a structure. Furthermore, the lack of a seam provides for continuous insulation without any areas for heat to escape.

The modular seamless corner component provides for energy efficiency as part of a system of passive cooling. Passive cooling is using shade, insulation, and other means to keep a building cool without using an air conditioner or other electronic devices, greatly reducing costs. Passive cooling relies both on keeping sunlight (e.g. radiant energy) out of a building and on promoting the bond between the earth and the interior of the house. Shaded earth will generally maintain a temperature floating around the average air temperature for that location. The deeper into the earth the more stable the temperature. For example and not limitation, by creating a more continuously insulated wall system around a concrete slab foundation, the coolness of the earth can radiate through a concrete slab and into a home and because just as hot air rises, cool air falls, so cooler temperature air can be held inside of a well-insulated wall system much as cold air in a cooler. Insulation is often critical to passive cooling, because it keeps heat out of a building. Energy efficiency is measured by the reduction in energy required to heat or cool a home. In one embodiment, the present invention includes 3 inches of foam. Alternatively, the present invention includes 5 inches of foam. The present invention further includes a corner comprising wood. The 5 inches of foam has a R value of R35, whereas a comparable, traditional corner having 5 inches of wood has a R value of R5. Accordingly, the combination of a thicker layer of foam and a thinner layer of wood in the present invention improves the energy efficiency of the present invention in comparison to a traditional stud frame with a steel corner because the steel corner of the traditional stud frame has a negative R value.

In one embodiment, the insulation of the modular seamless corner component is comprised of a bulk insulative material, preferably including polyurethane foam. Polyurethane foam is desirable in part due to its high R-value, meaning that it is an effective insulator.

In one embodiment, the polyurethane foam has an aged R value of 7/in at 52° F., and performs at R-8 value at 13° F. Furthermore, the modular seamless corner component, which includes closed-cell polyurethane foam, is advantageous over the prior art because the closed-cell polyurethane foam adheres to the inner and outer sheaths after the foam is injected and while the foam cures. This creates a stronger bond between the insulation and the inner and outer sheaths, and it eliminates delamination that typically occurs when gluing the sheathing material to a foam core is a separate process. Furthermore, the present invention reduces the opportunities for error during the manufacturing process (ex. imperfect glue, a poor volume to surface area ratio, and/or incorrect temperature).

In another embodiment, the closed cell polyurethane foam is injected between the inner and outer sheaths during the manufacturing process. The polyurethane foam expands at high pressure and fills out a space between the sheaths at a high density. Furthermore, there is no vertical stud or any type of stud in the modular seamless corner component. The absence of a stud is advantageous because studs wick thermal energy from the exterior to the interior of the structure when the external temperature is greater than the internal temperature. The studs further wick thermal energy from the interior to the exterior when the internal temperature is greater than the external temperature. Therefore, the corner panel of the present invention is an improvement over prior art panels as the corner panel of the present invention is more energy efficient.

Figures 50A, 50B:
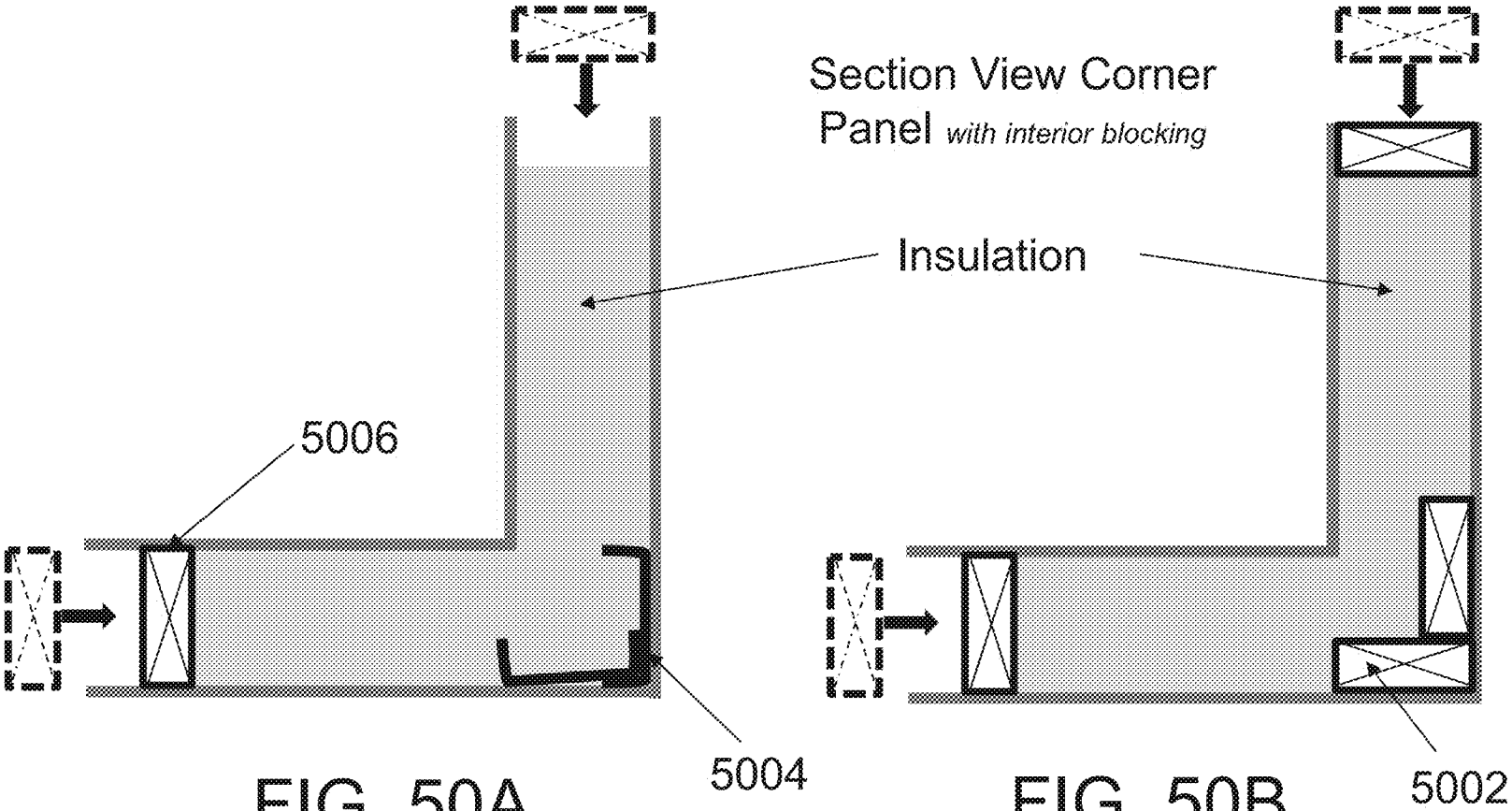
FIGS. 50A&B show top down views of the modular seamless corner component with studs inserted between the insulation, the inner sheathing, and the outer sheathing at ends of the corner component.
FIG. 50B shows at least one stud embedded in the modular seamless corner component.
Figure 51A:
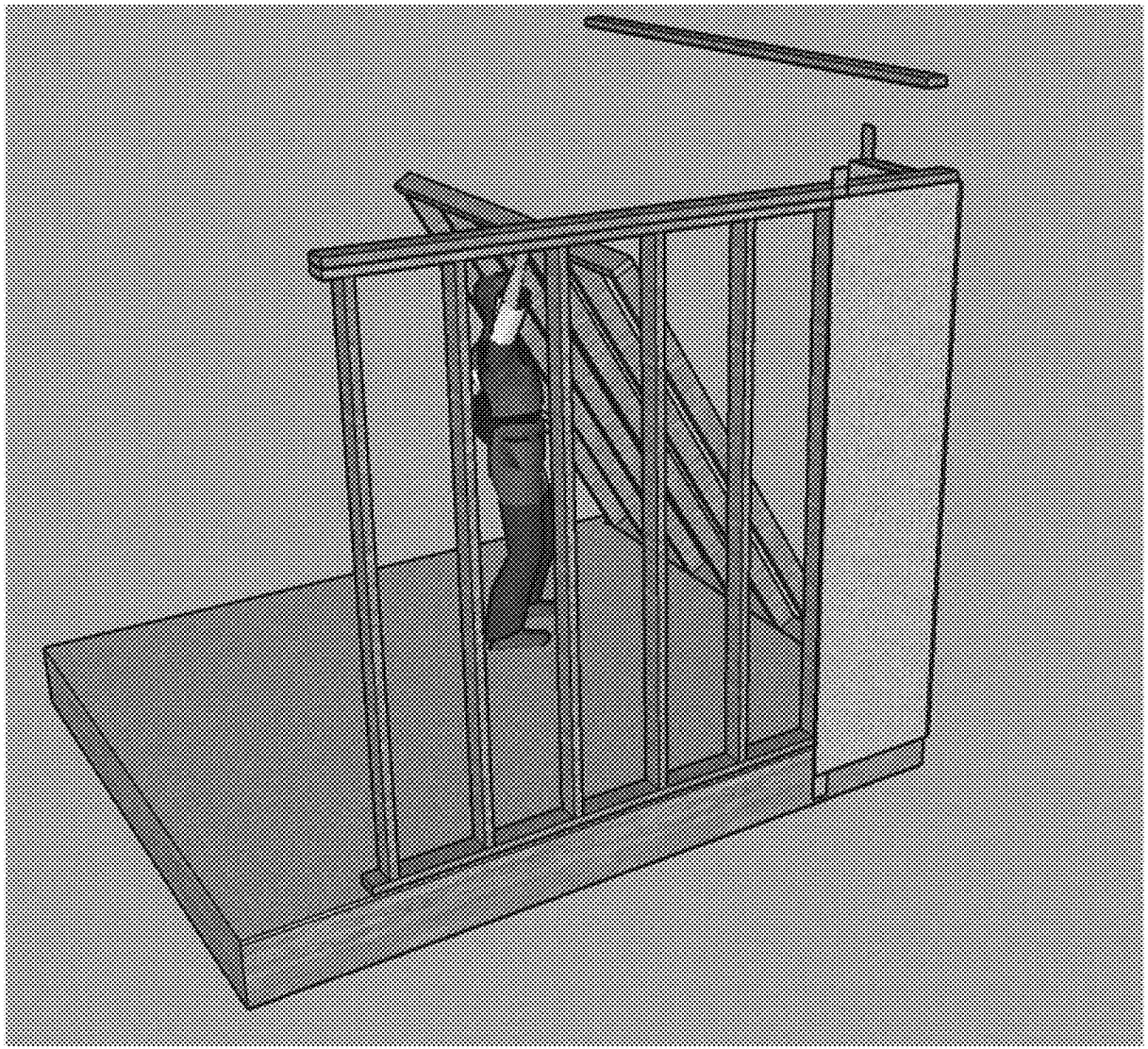
FIGS. 51A-E illustrate perspective views of sidewalls being installed adjacent to the modular seamless corner component.
Figure 51B:
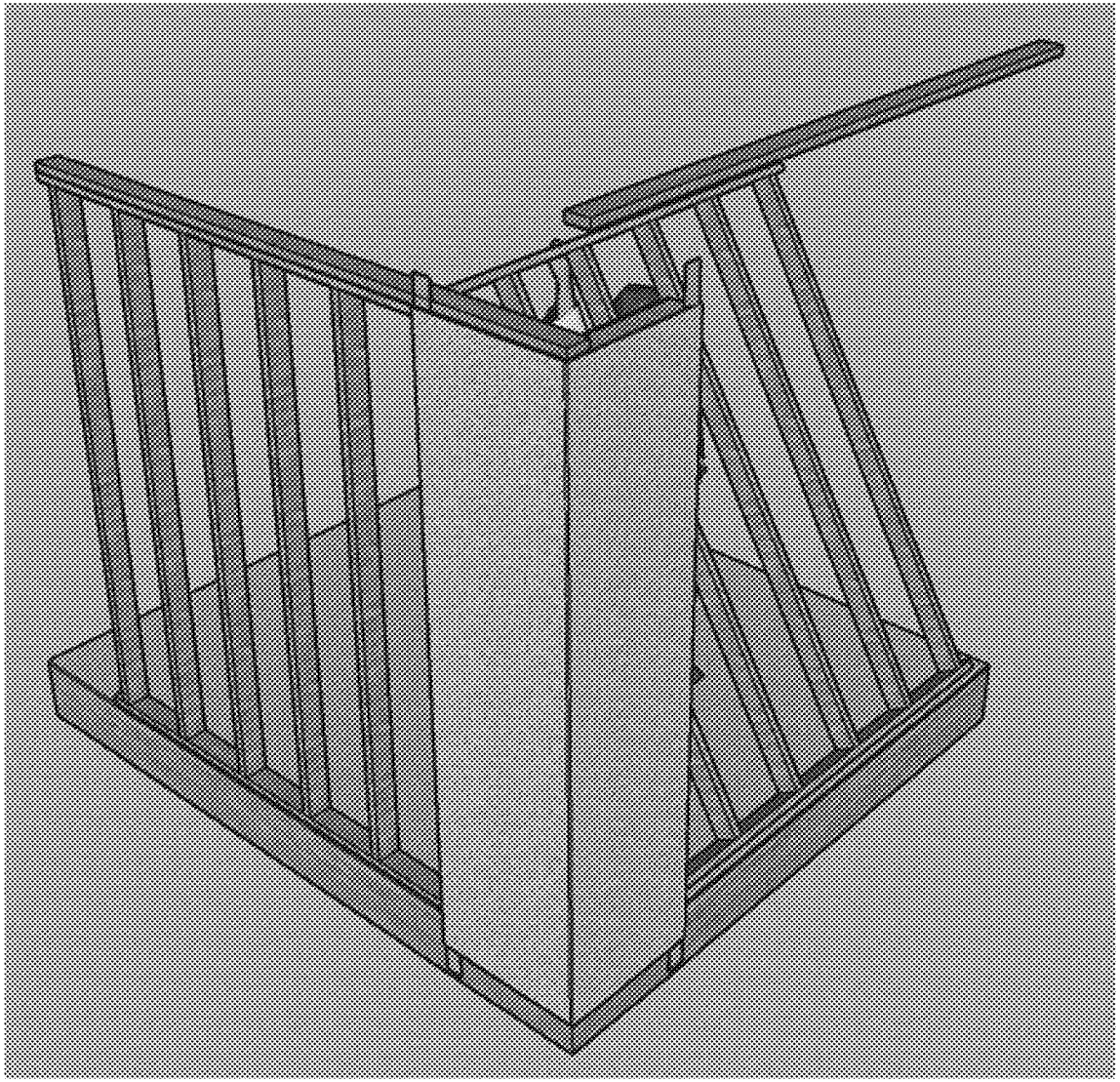
Figure 51C:
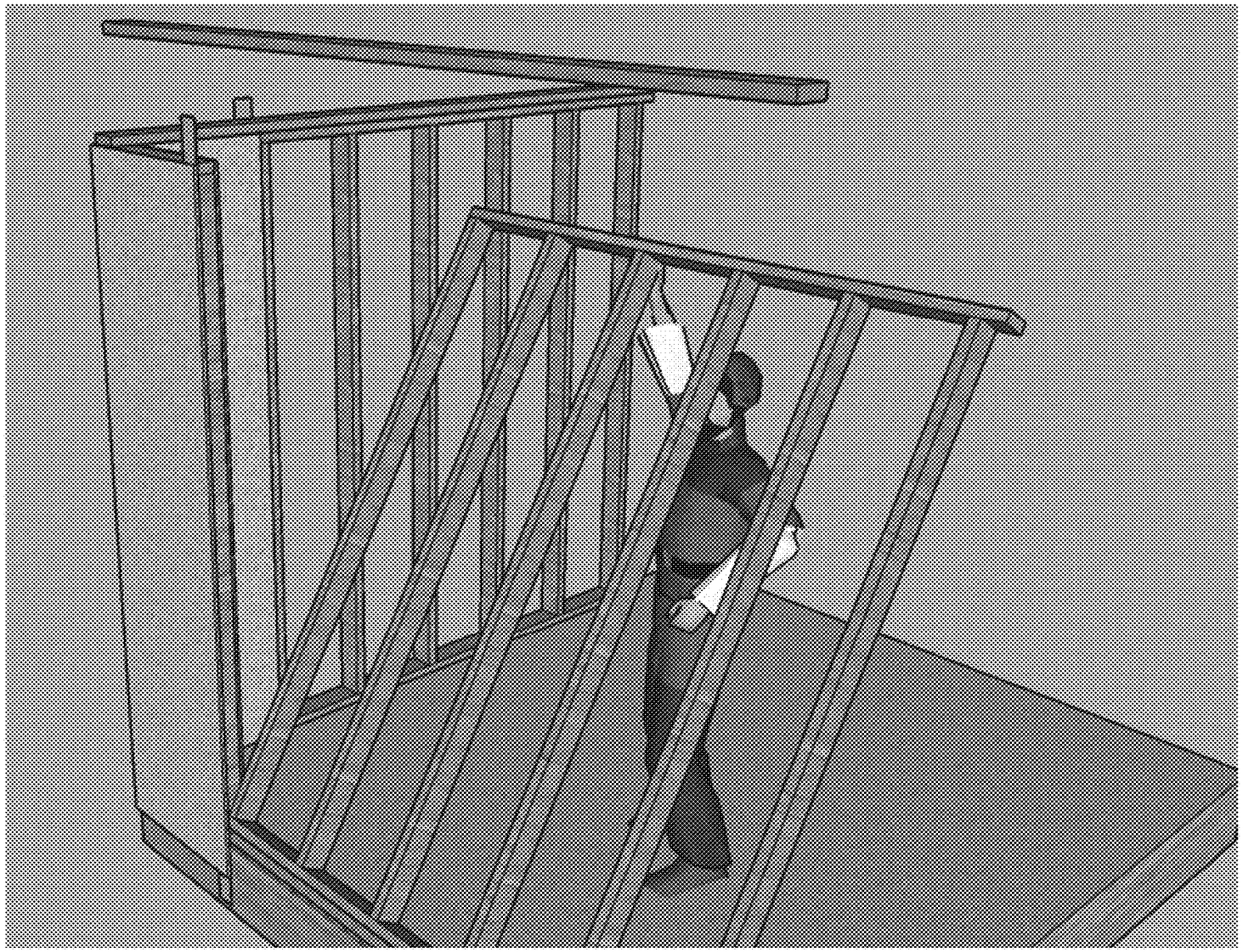
Figure 51D:
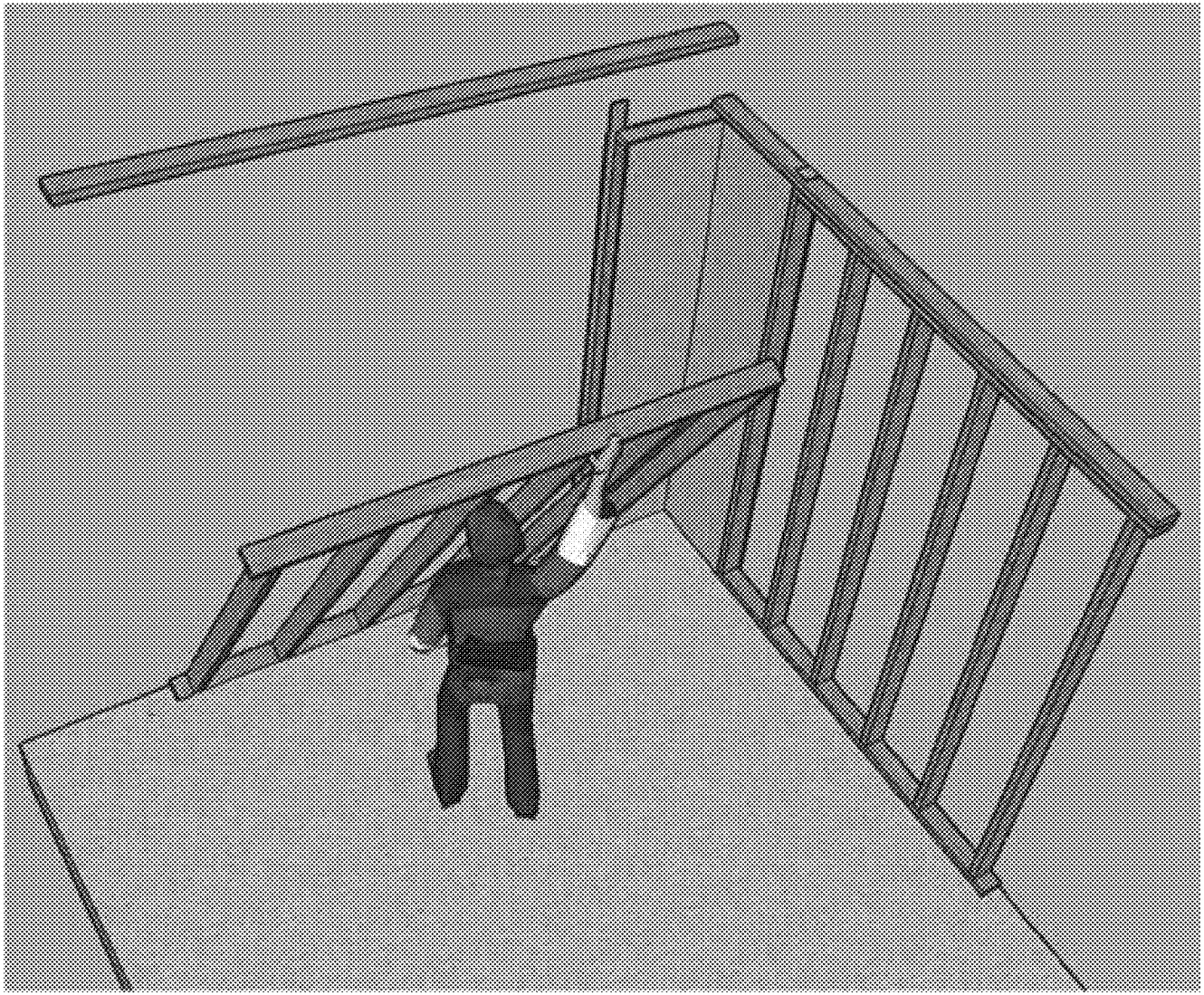
Figure 51E:
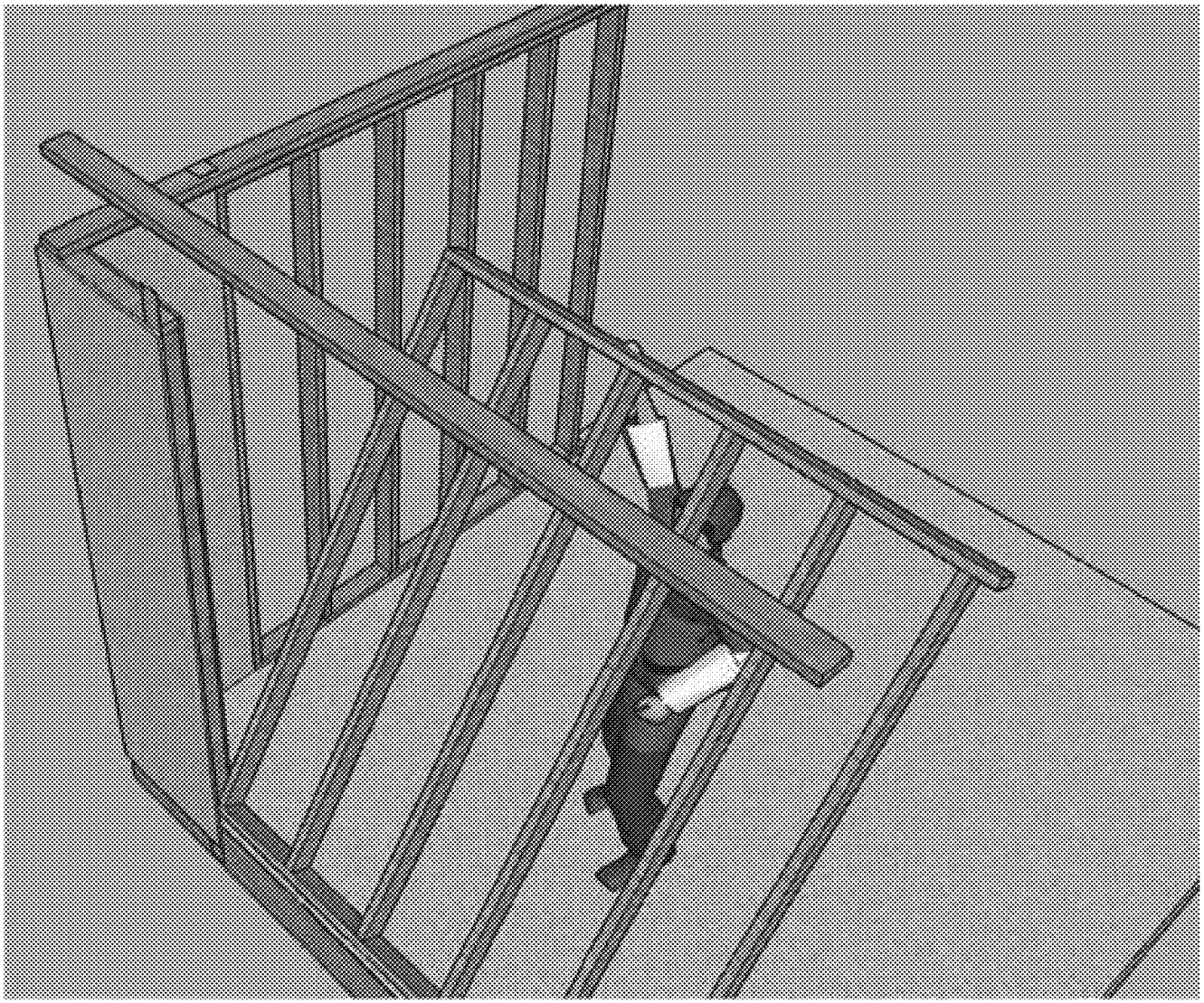

In an alternative embodiment, as shown in FIGS. 50A and 50B, a stud 5002 or other type of reinforcement 5004 is inserted into the corner panel before the closed cell polyurethane foam is injected during the manufacturing process. The stud or reinforcement makes it easier to resist compressive loading at the corners of a building, as well as offering fastening for exterior strapping. In FIGS. 50A and 50B, the stud 5002 or other type of reinforcement's 5004 position along the outside of the panel prevents the creation of a thermal bridge using the stud 5002 or reinforcement 5004 for conduction.

In one embodiment, the present invention includes a stud attached to a sheathing skin. Advantageously, this allows for fastening of exterior strapping since the fastener retention strength of sheathing is not significant enough to provide structural support to the strap. In another embodiment, the present invention includes at least one stud in the corner panel to allow for application of at least one strap. Alternatively, the present invention includes an embedded strap in the corner panel. In one embodiment, the strap is embedded in the corner panel during the manufacturing process.

In another embodiment, the closed cell polyurethane foam has a density between 2.2-2.4 lb/ft$^3$, a compress strength (@ 10% deformation) of 35 psi, a tensile strength of 58 psi, a thermal resistance per one inch of thickness at 75 deg. F. of approximately 6.9° F.*ft$^2$/Btu, a thermal resistance per one inch of thickness at 40 deg. F. of 1.30° F.*ft$^2$/Btu, a water vapor permeance of approximately 2, is nonflammable, and chars at 800° F. In one embodiment, the present invention includes an insulated building panel having a width of 48" and a height of 96" and a thickness of 4.5" including closed cell polyurethane foam can support a compressive load of 50,000 lbs.

In one embodiment, the polyurethane foam adheres to the inner and outer sheaths with a bonding strength of at least 50 pounds per square inch, and preferentially has a bonding strength of over 7000 pounds per square foot.

The outer sheath is substantially similar in size to the inner sheath, except that a lower portion of the outer sheath extends down further than the bottom of the inner sheath. A void or upside-down ledge is defined by the space between the lower portion of the outer sheath 4902 and the bottom of the inner sheath 4904 as shown in FIG. 49A. The modular seamless corner component is operable to matingly contact the corner of a base plate such that the bottom of the inner sheath and the bottom of the insulation rest on top of the base plate, while the lower portion of the outer sheath rests in contact with the sides of the base plate. The corner of the base plate is nested within the void of the modular seamless corner component.

Due to the lack of a standard for framing a corner, there is no standard method for testing a corner. However, testing of the corner component by means of a modified ASTM E72 test indicates that the modular seamless corner component adds 50% greater strength to a structure when compared to a stud framed wall and stud framed corner.

Sidewalls are placed adjacent to the corner component and are attached thereto. In one embodiment, the sidewalls are of stud frame construction, as can be seen in FIGS. 51A-E. Stud frame walls consist of a top plate and a bottom plate, which are horizontal beams that are placed at the top and bottom of the wall, and studs, which are vertical beams running from the bottom plate to the top plate. The studs offer structure and support to the stud frame wall.

Stud frame walls are advantageous because for several reasons. First, stud frames can be preconstructed off-site and then shipped in for construction. Second, stud frames can be erected faster than concrete block walls, at least because of the possibility of preconstruction. Finally, a stud frame structure can have greater thermal insulation than a stone or block structure of the same thickness. When the sidewalls are of stud frame construction, then camlocks cannot be used because the edges of the sidewalls are solid.

In one embodiment, as shown in FIGS. 50A and 50B, the inner and outer sheaths of the corner panel extend beyond the insulation at both ends. In a further embodiment, the insulation at either or both ends is terminated by a stud 5006 which is flush with the inner sheathing, the outer sheathing, and the insulation. In the alternative, the void created between the insulation and the inner and outer sheathing is left empty so that an existing sidewall can be set into the void of the corner panel and affixed to the inner sheathing, the outer sheathing, and the insulation.

In one embodiment, the modular seamless corner component has a thickness of about 4" for compatibility with a stud frame wall. In this embodiment, the insulation has a thickness of about 3.1".

Secondary top plates are used to attach the modular seamless corner component to sidewalls. The secondary top plates lay flat on top of embedded top plates of the modular seamless corner component and cover the embedded top plates, a top of the inner sheath, and a top of the outer sheath. The embedded top plates cover a top of the insulation, and embedded side plates 4908 cover exposed sides of the insulation. In one embodiment, the embedded top plates are of slightly different lengths from each other and only one 4906 of the embedded top plates covers the bend of the L-shape of the corner such that the embedded top plates do not overlap. The different lengths of the embedded top plates can be seen in FIG. 49B. In addition to covering the embedded top plates of the modular seamless corner component, the secondary top plates extend out beyond the corner component, as can be seen in FIGS. 51A-E. In a further embodiment, the portion of the secondary top plate extending beyond the corner component lays flat on top of sidewalls placed adjacent to the corner component.

In one embodiment, at least two rigid straps are attached between the outer sheath and the insulation and along the height of the outer sheath, extending beyond both the top and the bottom of the outer sheath. and can be used to attach the modular seamless corner component to the base plate and/or to the secondary top plates via physical bonding, chemical bonding, mechanical attachment, and/or adhesive.

Figure 52B:
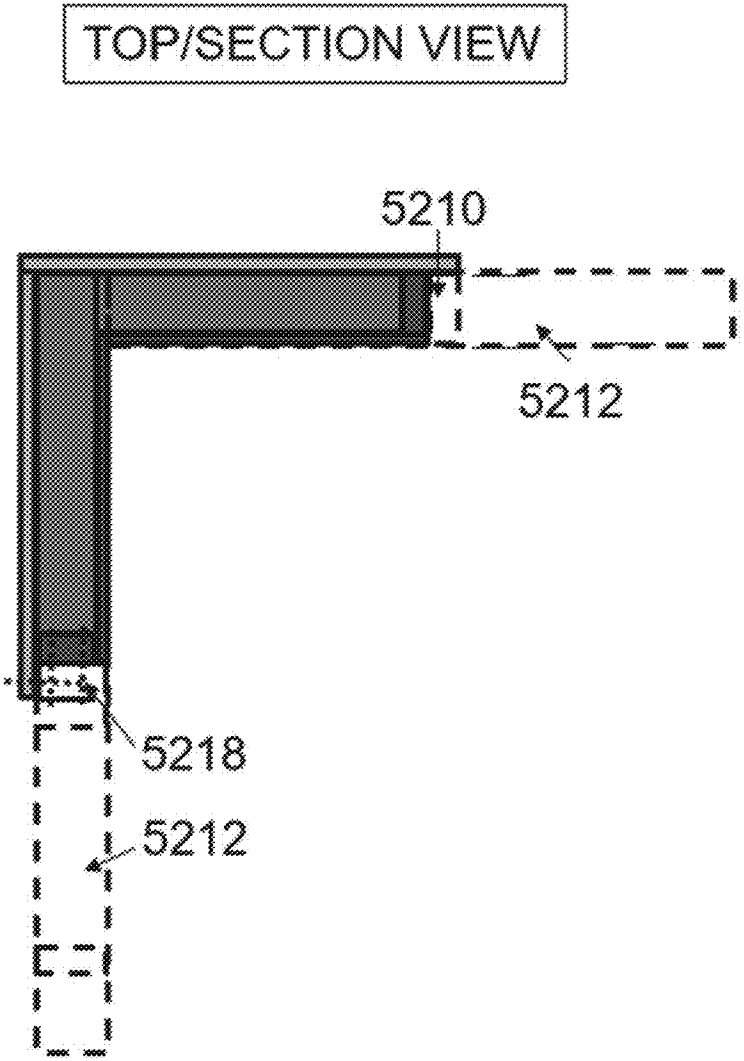
FIG. 52B shows a top down view of an attachment of a side wall to the modular seamless corner component.
Figure 52A:
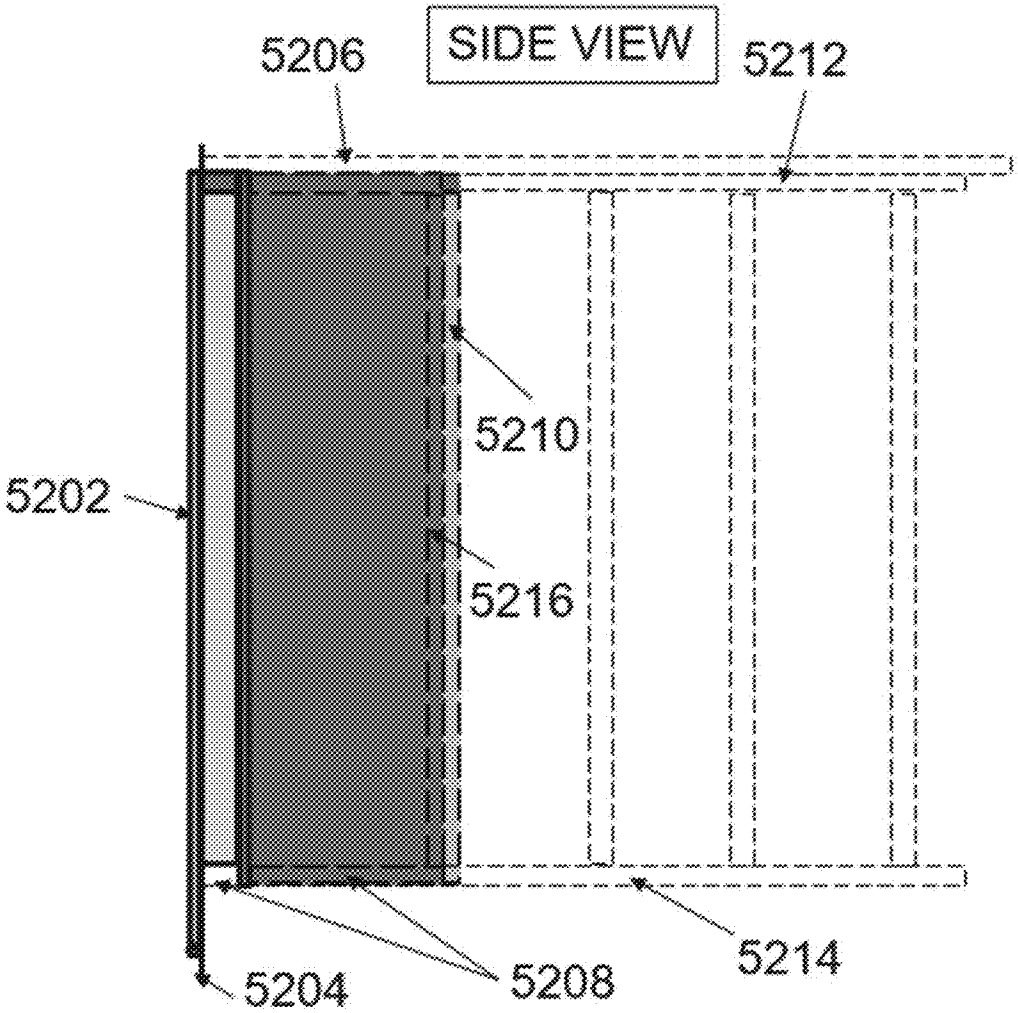
FIGS. 52A&B show side and top views respectively of the modular seamless corner component.

FIGS. 52A and 52B show the attachment of a sidewall to the modular seamless corner component. The outer sheathing layer 5202 comprises a weather resistive barrier, wherein the weather resistive barrier is a non-permeable rigid material. The weather resistive barrier resists racking, bending, and/or compression when used in conjunction with the insulation layer. In one embodiment, the weather resistive layer is distinct from and affixed to an exterior of the outer sheathing. In another embodiment, the weather resistive layer is the outer sheathing. A hurricane tie, or other rigid strap 5204 extends beyond the outer sheathing at both the top and bottom, and in one embodiment has a width of 3". Embedded top and side plates cover the top and sides of the insulation respectively. Secondary top plates 5206 are placed on top of the embedded top plates and are attached by means of screws or other attachment. Both the inner sheathing and the outer sheathing extend lower than the insulation, such that a void 5208 is formed between the outer sheath, the inner sheath, and the insulation. The outer sheathing extends horizontally beyond the insulation at each end of the modular seamless corner component, such that a void 5210 is formed on each side of the corner component. A sidewall comprises a top plate 5212, a bottom plate 5214, and studs. The top and bottom plates are horizontal beams, and the studs are vertical beams connecting the top and bottom plates. The top plate 5212 of the sidewall is covered by one of the secondary top plates 5206 and is coplanar with the embedded top plate. The secondary top plate 5206 is attached to the top plate 5212 by means of screws or other attachment. The bottom plate 5214 of the sidewall fits into the void 5208 formed between the outer sheath, the inner sheath, and the insulation. An edge of the sidewall fits into the void 5210 formed at the side of the corner component. The edge of the sidewall is attached to the corner component by means of screws or other attachment.

Figure 53B:
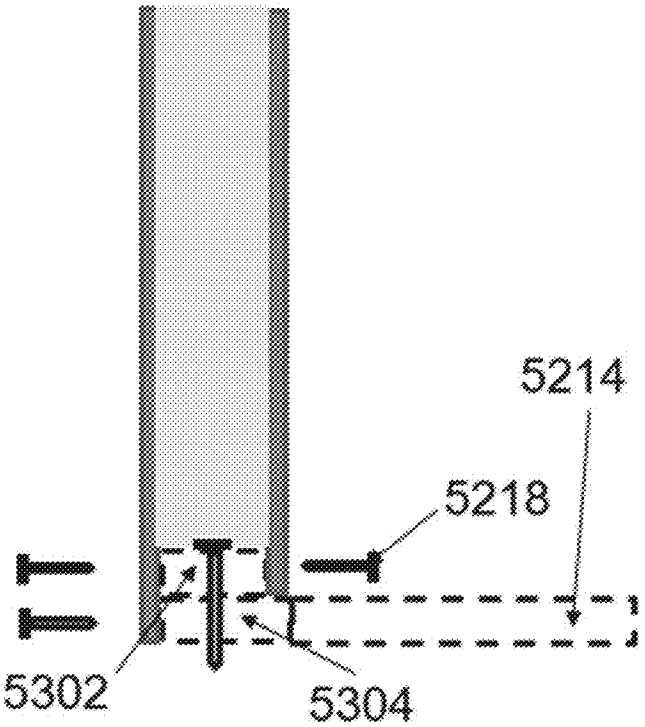
FIG. 53B shows a closer view of the attachment of a modular seamless corner component to a bottom plate and a secondary base plate.
Figure 53A:
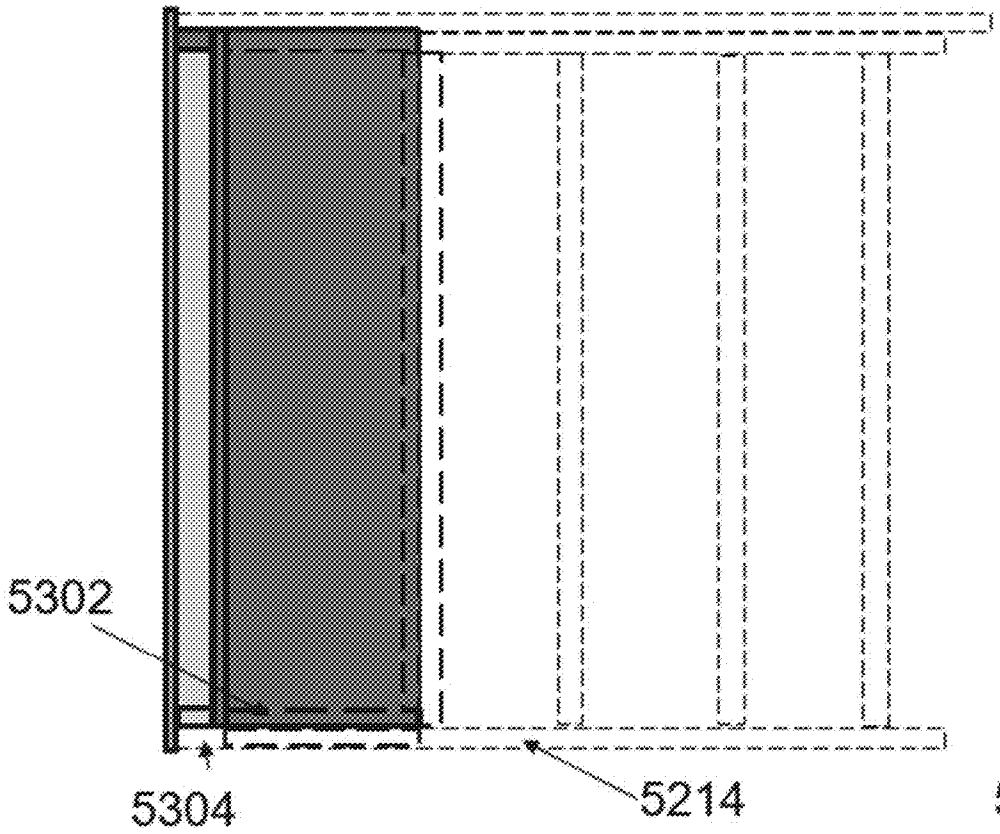
FIGS. 53A&B show side views of a modular seamless corner component.

In a further embodiment, as shown in FIGS. 53A and 53B, a secondary base plate is used. The secondary base plate 5302 fits into the gap or void 5208 formed between the outer sheath, the inner sheath, and the insulation. The secondary base plate 5302 is then set on top of a standard dimension base plate 5304 and is affixed to the inner sheath, the outer sheath, and the standard dimension base plate by means of screws 5218 or other attachment. The secondary base plate allows the inner sheathing of the corner panel to remain flush with the internal edge of other stud framing members in the wall, aiding in smooth interior sheetrock attachment. The secondary base plate also gives more surface area for screws or other attachment to be affixed to, allowing for greater strength of retention.

Certain modifications and improvements will occur to those skilled in the art upon a reading of the foregoing description. The above-mentioned examples are provided to serve the purpose of clarifying the aspects of the invention and it will be apparent to one skilled in the art that they do not serve to limit the scope of the invention. All modifications and improvements have been deleted herein for the sake of conciseness and readability but are properly within the scope of the present invention.

What is claimed is:

1. A substantially L-shaped modular seamless corner component for providing a corner to a structure, comprising;

an outer sheath, an inner sheath, an insulation, and two rigid straps including a first rigid strap and a second rigid strap;

wherein the inner sheath, the insulation, and the outer sheath each comprise a top edge, a bottom edge, and two outside edges, wherein each of the inner sheath, the insulation, and the outer sheath is substantially L-shaped, comprising a bend defining a seamless corner;

wherein the seamless corner of the inner sheath is nested within the seamless corner of the insulation, and the seamless corner of the insulation is nested within the seamless corner of the outer sheath;

wherein the inner sheath is attached to the insulation and the insulation is attached to the outer sheath such that the top edges of the inner sheath, insulation, and the outer sheath are substantially flat and coplanar;

wherein the substantially L-shaped insulation is continuous;

wherein the top edge of the insulation is directly covered by at least one embedded top plate positioned completely parallel to the top edge of the insulation;

wherein the outer sheath extends below the bottom edges of the inner sheath and the insulation, wherein the bottom edges of the inner sheath and the insulation and the portion of the outer sheath which extends below the bottom edges of the inner sheath and the insulation define a lip;

wherein the portion of the outer sheath which extends below the bottom edges of the inner sheath and the insulation is continuous with the remainder of the outer sheath and the lower portion of the outer sheath is in the same horizontal plane and the same vertical plane as the remainder of the outer sheath;

wherein the entirety of the first rigid strap is parallel to a first portion of the inner sheath and is positioned completely outside of the insulation;

wherein the entirety of the second rigid strap is parallel to a second portion of the inner sheath and is positioned completely outside of the insulation;

wherein the first portion of the inner sheath and the second portion of the inner sheath are substantially perpendicular;

wherein the first rigid strap is positioned between the insulation and a first portion of the outer sheath;

wherein the second rigid strap is positioned between the insulation and a second portion of the outer sheath;

wherein the first portion of the outer sheath and the second portion of the outer sheath are substantially perpendicular;

wherein the first rigid strap includes a first flat side and a second flat side, wherein the first flat side of the first rigid strap is parallel to the second flat side of the first rigid strap; and wherein the second rigid strap includes a first flat side and a second flat side, wherein the first flat side of the second rigid strap is parallel to the second flat side of the second rigid strap.

2. The substantially L-shaped modular seamless corner component of claim 1, wherein the lip is operable to fit over a corner of a base plate, wherein the bottom edge of the inner sheath and the bottom edge of the insulation rest on top of the base plate, and wherein the lower portion of the outer sheath and each of the two rigid straps are directly attached to the base plate.

3. The substantially L-shaped modular seamless corner component of claim 1, wherein the modular seamless corner component is attached to two secondary top plates, wherein the two secondary top plates lay flat on top of the modular seamless corner component such that the two secondary top plates cover the at least one embedded top plate, a top of the inner sheath, and a top of the outer sheath and wherein each of the two rigid straps are bent over the two secondary top plates to hold the two secondary top plates against the at least one embedded top plate.

4. The substantially L-shaped modular seamless corner component of claim 3, wherein the modular seamless corner component is attached to two sidewalls, wherein each of the two sidewalls is placed adjacent to an outside edge of the insulation, and wherein each of the two secondary top plates extends over one of the two sidewalls such that each of the two secondary top plates covers a top of at least one of the two sidewalls.

5. The substantially L-shaped modular seamless corner component of claim 4, wherein each of the two sidewalls include a top plate, a bottom plate, and a plurality of studs, wherein the top plate and the bottom plate are horizontal beams, and wherein each of the plurality of studs is a vertical beam connected at a bottom end to the bottom plate and connected at a top end to the top plate.

6. The substantially L-shaped modular seamless corner component of claim 1, wherein the insulation is comprised of polyurethane foam.

7. The modular seamless corner component of claim 1, wherein the insulation does not comprise polystyrene or formaldehyde.

8. The substantially L-shaped modular seamless corner component of claim 1, wherein the modular seamless corner component has a total thickness of about 4 inches and the insulation has a thickness of about 3.1 inches.

9. The substantially L-shaped modular seamless corner component of claim 1, wherein the insulation comprises a foam, wherein the foam is injected between the inner sheath and the outer sheath, and wherein the foam adheres to the inner sheath and the outer sheath as the foam cures.

10. The substantially L-shaped modular seamless corner component of claim 9, wherein the foam adheres to the inner sheath and the outer sheath with a bonding strength of at least 50 pounds per square inch.

11. The substantially L-shaped modular seamless corner component of claim 1, wherein the modular seamless corner component does not include a vertical stud or any other type of stud.

12. The substantially L-shaped modular seamless corner component of claim 1, wherein each of the two rigid straps is a continuous piece.

13. The substantially L-shaped modular seamless corner component of claim 1, wherein each of the two rigid straps is substantially uniform in width.

14. The substantially L-shaped modular seamless corner component of claim 1, further comprising side plates, wherein the side plates cover sides of the insulation and are perpendicular to the inner sheath.

* * * * *